US009382907B2

(12) United States Patent
Sekiya et al.

(10) Patent No.: US 9,382,907 B2
(45) Date of Patent: Jul. 5, 2016

(54) VANE-TYPE COMPRESSOR HAVING AN OIL SUPPLY CHANNEL BETWEEN THE OIL RESEVOIR AND VANE ANGLE ADJUSTER

(75) Inventors: Shin Sekiya, Chiyoda-ku (JP); Raito Kawamura, Chiyoda-ku (JP); Hideaki Maeyama, Chiyoda-ku (JP); Shinichi Takahashi, Chiyoda-ku (JP); Tatsuya Sasaki, Chiyoda-ku (JP); Kanichiro Sugiura, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 134 days.

(21) Appl. No.: 14/350,959

(22) PCT Filed: Jan. 11, 2012

(86) PCT No.: PCT/JP2012/000107

§ 371 (c)(1),
(2), (4) Date: Apr. 10, 2014

(87) PCT Pub. No.: WO2013/105129

PCT Pub. Date: Jul. 18, 2013

(65) Prior Publication Data

US 2014/0271303 A1 Sep. 18, 2014

(51) Int. Cl.
*F03C 2/00* (2006.01)
*F03C 4/00* (2006.01)
(Continued)

(52) U.S. Cl.
CPC ..... *F04C 18/02* (2013.01); *F01C 21/0809* (2013.01); *F01C 21/0836* (2013.01);
(Continued)

(58) Field of Classification Search
CPC ..... F04C 2/344; F04C 2/3446; F04C 18/321; F04C 18/344; F04C 18/3441; F04C 18/352; F04C 29/02; F04C 29/023; F04C 29/025; F04C 29/12; F04C 2240/809; F04C 2240/63; F01C 21/0809; F01C 21/0818; F01C 21/0836
USPC ..... 418/82, 88, 93, 94, 136–137, 145, 148, 418/241, 259, 266–268
See application file for complete search history.

(56) References Cited

U.S. PATENT DOCUMENTS 1,291,618 A 1/1919 Olson
1,339,723 A 5/1920 Smith
(Continued)

FOREIGN PATENT DOCUMENTS

CH 181039 A 11/1935
DE 874 944 C 4/1953
(Continued)

OTHER PUBLICATIONS

International Search Report and Written Opinion issued Jul. 2, 2013 in PCT/JP2013/059582 (with English translation of categories of cited documents).
(Continued)

*Primary Examiner* — Theresa Trieu
(74) *Attorney, Agent, or Firm* — Oblon, McClelland, Maier & Neustadt, L.L.P.

(57) ABSTRACT

A vane-type compressor includes a rotor shaft that includes rotating shaft portions and a rotor portion, which are integrated with one another. A lower end of the rotating shaft is disposed in an oil reservoir. The vane-type compressor also includes vane aligners disposed at both end portions of vanes, and recess portions, which are respectively formed in a frame and a cylinder head so as to be concentric with an inner circumferential surface of a cylinder. Outer circumferential surfaces of the vane aligners are slidably supported by the recess portions. In the rotor shaft, oil supply channels, which allow communication between the oil reservoir and the recess portions of the frame and the cylinder head, and an oil pump, which supplies refrigerating machine oil in the oil reservoir to the oil supply channels, are provided.

13 Claims, 35 Drawing Sheets

(51) Int. Cl.

| | |
|---|---|
| ***F04C 2/00*** | (2006.01) |
| ***F04C 18/02*** | (2006.01) |
| ***F01C 21/08*** | (2006.01) |
| ***F04C 18/344*** | (2006.01) |
| ***F04C 29/02*** | (2006.01) |
| ***F04C 18/32*** | (2006.01) |
| ***F04C 18/352*** | (2006.01) |
| *F04C 23/00* | (2006.01) |

(52) U.S. Cl.

CPC ..... *F04C18/321* (2013.01); *F04C 18/3441* (2013.01); *F04C 18/352* (2013.01); *F04C 29/025* (2013.01); *F04C 29/028* (2013.01); *F04C 23/008* (2013.01); *F04C 2240/603* (2013.01); *F04C 2240/809* (2013.01)

(56) References Cited

U.S. PATENT DOCUMENTS

| | | | |
|---|---|---|---|
| 1,444,269 | A | 2/1923 | Piatt |
| 1,607,383 | A | 11/1926 | Aurand |
| 2,044,873 | A | 6/1936 | Beust |
| 4,955,985 | A | 9/1990 | Sakamaki et al. |
| 4,958,995 | A | 9/1990 | Sakamaki et al. |
| 4,997,351 | A | 3/1991 | Sakamaki et al. |
| 4,997,353 | A | 3/1991 | Sakamaki et al. |
| 4,998,867 | A | 3/1991 | Sakamaki et al. |
| 4,998,868 | A | 3/1991 | Sakamaki et al. |
| 5,002,473 | A | 3/1991 | Sakamaki et al. |
| 5,011,390 | A | 4/1991 | Sakamaki et al. |
| 5,022,842 | A | 6/1991 | Sakamari et al. |
| 5,030,074 | A | 7/1991 | Sakamaki et al. |
| 5,032,070 | A | 7/1991 | Sakamaki et al. |
| 5,033,946 | A | 7/1991 | Sakamaki et al. |
| 5,044,910 | A | 9/1991 | Sakamaki et al. |
| 5,087,183 | A | 2/1992 | Edwards |
| 5,536,153 | A | 7/1996 | Edwards |
| 6,193,906 | B1 | 2/2001 | Kaneko et al. |
| 6,223,554 | B1 | 5/2001 | Adachi |
| 8,602,760 | B2 | 12/2013 | Maeyama et al. |

FOREIGN PATENT DOCUMENTS

| | | | | |
|---|---|---|---|---|
| GB | 26718 | A | | 0/1910 |
| GB | 244181 | A | | 12/1925 |
| JP | 51-128704 | A | | 11/1976 |
| JP | 52-60911 | A | | 5/1977 |
| JP | 52 47571 | | | 12/1977 |
| JP | 53 8809 | | | 1/1978 |
| JP | 56-29001 | A | | 3/1981 |
| JP | 58 70087 | | | 4/1983 |
| JP | 61 132793 | | | 6/1986 |
| JP | 63-73593 | U | | 5/1988 |
| JP | 63-131883 | A | | 6/1988 |
| JP | 4 187887 | | | 7/1992 |
| JP | 5-133367 | A | | 5/1993 |
| JP | 6-501758 | A | | 2/1994 |
| JP | 8-247063 | A | | 9/1996 |
| JP | 8-247064 | A | | 9/1996 |
| JP | 10 252675 | | | 9/1998 |
| JP | 2000 352390 | | | 12/2000 |
| JP | 2009062820 | A | * | 3/2009 ..... F04C 29/02 |
| JP | 2009264175 | A | * | 11/2009 ..... F04C 18/321 |
| WO | WO 96/00852 | A1 | | 1/1996 |
| WO | WO 2010/150816 | A1 | | 12/2010 |

OTHER PUBLICATIONS

Office Action issued Oct. 29, 2013 in Japanese Patent Application No. 2012-529553 (with English language translation).

Extended European Search Report issued Jun. 17, 2014 in Patent Application No. 11818068.6.

Extended European Search Report issued Jun. 17, 2014 in Patent Application No. 11818070.2.

Office Action mailed Aug. 14, 2014 in co-pending U.S. Appl. No. 13/700,634.

Office Action issued Sep. 30, 2014 in Japanese Patent Application No. 2012-002807 (with English language translation).

Office Action issued Sep. 30, 2014 in Japanese Patent Application No. 2012-003556 (with English language translation).

U.S. Appl. No. 14/350,998, filed Apr. 10, 2014, Sekiya, et al.

U.S. Appl. No. 14/350,989, filed Apr. 10, 2014, Sekiya, et al.

U.S. Appl. No. 14/350,937, filed Apr. 10, 2014, Sekiya, et al.

International Search Report Issued Apr. 10. 2012 in PCT/JP12/000107 Filed Jan. 11, 2012.

Extended European Search Report issued Sep. 21, 2015 in Patent Application No. 12865224.5.

* cited by examiner

B: DIRECTION IN WHICH VANE ALIGNER PROJECTING PORTION 6a IS ATTACHED AND LONGITUDINAL DIRECTION OF VANE
C: NORMAL TO ARC OF TIP END 9a OF FIRST VANE 9

(a)

(b)

(a)

(b)

(a)

(b)

(a)

(b)

(a)

(b)

VANE-TYPE COMPRESSOR HAVING AN OIL SUPPLY CHANNEL BETWEEN THE OIL RESEVOIR AND VANE ANGLE ADJUSTER

TECHNICAL FIELD

The present invention relates to a vane-type compressor.

BACKGROUND ART

In the related-art, a typical vane-type compressors having been proposed has the following structure: a vane or vanes are inserted into a single or a plurality of vane grooves formed in a rotor portion of a rotor shaft (a component formed by integrating a cylindrical rotor portion, which is rotated in a cylinder, and a shaft, through which a rotational force is transmitted to the rotor portion, with each other). The tip end portion or the tip end portions of the vane or the vanes are in contact with and slide against an inner circumferential surface of the cylinder (see, for example, Patent Literature 1).

Another vane-type compressor having been proposed has the following structure: vanes are rotatably attached to a vane fixing shaft disposed in a hollow formed inside a rotor shaft. The vanes are each rotatably (swingably) held relative to a rotor portion by using a pair of semi-cylindrical clamping members near an outer circumferential surface of a rotor portion (see, for example, Patent Literature 2).

CITATION LIST

Patent Literature

Patent Literature 1: Japanese Unexamined Patent Application Publication No. 10-252675 (Abstract, FIG. 1)

Patent Literature 2: Japanese Unexamined Patent Application Publication No. 2000-352390 (Abstract, FIG. 1)

SUMMARY OF INVENTION

Technical Problem

In a typical related-art vane-type compressor (for example, Patent Literature 1), the orientations of the vanes are regulated by the vane grooves formed in the rotor portion of the rotor shaft. That is, the vanes are held so as to be constantly inclined in fixed angles relative to the rotor portion. Thus, as the rotor shaft is rotated, angles formed between the vanes and the inner circumferential surface of the cylinder vary. Accordingly, in order to allow the tip ends of the vanes to be in contact with the inner circumferential surface of the cylinder through the entire circumference, the radius of the arcs of the tip ends of the vanes needs to be smaller than the radius of the inner circumferential surface of the cylinder.

That is, in the typical related-art vane-type compressor, in the case where the tip ends of the vanes are in contact with the inner circumferential surface of the cylinder through the entire circumference, the tips of the vanes and the inner circumferential surface of the cylinder, the radii of which are significantly different from one another, slide against one another. For this reason, a lubrication state between the two components (cylinder and vane) is not in a hydrodynamic lubrication state, in which two components slide on each other with an oil film, which is formed therebetween, interposed therebetween, but is in a boundary lubrication state. In general, a frictional coefficient in a lubrication state is about 0.001 to 0.005 in the hydrodynamic lubrication state. This frictional coefficient is significantly increased to about 0.05 or greater in the boundary lubrication state.

Thus, in the structure of the typical related-art vane-type compressor, sliding resistance is increased due to the tip end of the vane and the inner circumferential surface of the cylinder sliding on each other in the boundary lubrication state. Thus, there is a problem in that compressor efficiency is significantly reduced due to an increase in mechanical loss. Furthermore, in the structure of the typical related-art vane-type compressor, the tip end of the vane and the inner circumferential surface of the cylinder easily wear. This causes a problem in that ensuring a long life of the vane-type compressor is difficult. In order to address this, in the related-art vane-type compressor, techniques are used to reduce a pressing force applied from the vane to the inner circumferential surface of the cylinder as much as possible.

Examples of proposals to solve the above-described problems include the related-art vane-type compressor described in Patent Literature 2. With the structure of the related-art vane-type compressor described in Patent Literature 2, the vanes are rotatably supported at the center of the inner circumferential surface of the cylinder. Thus, the longitudinal direction of the vanes is constantly coincident with a direction normal to the inner circumferential surface of the cylinder. Accordingly, the radius of the inner circumferential surface of the cylinder can be set to substantially equal to the radius of the arcs of the tip ends of the vanes so that the shape of the tip end portions of the vanes follows the shape of the inner circumferential surface of the cylinder. Thus, a structure, in which the tip ends of the vanes and the inner circumferential surface of the cylinder are not in contact with one another, can be achieved. Alternatively, even in the case where the tip ends of the vanes and the inner circumferential surface of the cylinder are in contact with one another, the lubrication state between both the components can be a hydrodynamic lubrication state with a sufficient oil film interposed therebetween. Thus, a concern for the related-art vane-type compressor, that is, improvement of the sliding state at the tip end portions of the vanes, can be achieved.

However, in the related-art vane-type compressor described in Patent Literature 2, a hollow needs to be formed inside the rotor shaft. Thus, it is difficult to impart a rotational force to the rotor portion and rotatably support the rotor portion. More specifically, the related-art vane-type compressor described in the above-described Patent Literature 2 is provided with end plates (rotation base plate 2*a*, rotation holding member 2*b*) on both end surfaces of the rotor portion. One of the end plates (rotation base plate 2*a*) has a disc shape because the end plate needs to transmit power from the rotational shaft, and a rotational shaft is connected to the center of the end plate. The other end plate (rotation holding member 2*b*) needs to avoid interference with rotational ranges of a vane fixing shaft (fixing shaft 1*b*) and a vane shaft support member (shaft support member 1*a*), and accordingly, needs to have a ring shape having a hole at its center. For this reason, portions, by which the end plates rotated with the rotor portion are rotatably supported, need to have larger diameters than that of the rotational shaft (rotational shaft 2*c*). Thus, there is a problem of sliding loss in the bearing being increased.

Furthermore, since a small gap is formed between the rotor portion and the inner circumferential surface of the cylinder so as to avoid leakage of a compressed gas (gaseous refrigerant), the outer diameter of the rotor portion and the rotational center need to be highly accurate. However, since the rotor portion and the end plates are separate components in the related-art vane-type compressor described in the above-described Patent Literature 2, there is a problem of the accuracy of the outer diameter of the rotor portion and the rotational center being degraded due to distortion caused when the rotor portion and the end plates are fastened to one another, a shift of the coaxial axes of the rotor portion and the end plates from one another, and the like.

The present invention is proposed to solve the above-described problems. An object of the present invention is to provide a vane-type compressor having a mechanism required to allow a compressing operation to be performed while constantly maintaining a normal to an inner circumferential surface of a cylinder to be substantially coincident with a normal to an arc of a tip end portion of a vane (mechanism in which the vane is rotated about the center of the cylinder) in order to reduce sliding loss in a bearing of a rotational shaft and reduce leakage loss by forming a small gap between a rotor portion and the inner circumferential surface of the cylinder. In the vane-type compressor, this mechanism is achieved by integrating the rotor portion and the rotational shaft with each other instead of using end plates, with which accuracy of the outer diameter of the rotor portion and the rotational center may be degraded, in the rotor portion.

Solution to Problem

A vane-type compressor according to an aspect of the present invention includes a sealed container, an oil reservoir that is disposed at a bottom portion of the sealed container and allows refrigerating machine oil to be accumulated therein, and an electrical drive element and a compressing element disposed in the sealed container. The compressing element includes a cylinder having a cylindrical inner circumferential surface, a rotor shaft that includes a cylindrical rotor portion that rotates in the cylinder about a rotational axis offset from a central axis of the inner circumferential surface by a predetermined distance, and a shaft portion, through which a rotational force is transmitted from the electrical drive element to the rotor portion. A lower end of the shaft portion is disposed in the oil reservoir. The compressing element also includes a frame that closes one of open ends of the inner circumferential surface of the cylinder. The shaft portion is rotatably supported by a bearing portion of the frame. The compressing element also includes a cylinder head that closes the other open end of the inner circumferential surface of the cylinder. The shaft portion is rotatably supported by a bearing portion of the cylinder head.

The compressing element also includes at least one vane disposed in the rotor portion. The vane has a tip end portion on an outer circumferential side. The tip end portion projects from the rotor portion and has a convex arc shape.

In the vane-type compressor, vane angle adjusting means is provided which holds the vane so as to allow a compressing operation to be performed while constantly maintaining a normal to the arc shape of the tip end portion of the vane substantially coincident with a normal to the inner circumferential surface of the cylinder and which supports the vane such that the vane is swingable and movable relative to the rotor portion. The vane angle adjusting means at least includes vane aligners and vane aligner bearing portions. The vane aligners have respective base portions having a ring shape or a partial ring shape. Each base portion has one of a projection and a recess, the vane has end portions, and each end portion of the vane has the other of the projection and the recess. The vane aligners is connected to the vane each projecting portion being inserted into a corresponding one of the recesses, or the base portions of the vane aligners are integrated with the respective end portions of the vane. The vane aligner bearing portions is disposed in outer circumferential surfaces of recess portions formed in cylinder-side end surfaces of the frame and the cylinder head. The recess portions each have a bottomed cylindrical shape and are coaxial with the inner circumferential surface of the cylinder. The base portions of the vane aligners are inserted into the recess portions, and outer circumferential surfaces of the base portions of the vane aligners are slidably supported by the vane aligner bearing portions. In the vane-type compressor, an oil supply channel that is formed in the rotor shaft and allows communication between the oil reservoir and the recess portions of the frame and the cylinder head and oil supply means that supplies the refrigerating machine oil in the oil reservoir to the oil supply channel are provided.

A vane-type compressor according to another aspect of the present invention includes a sealed container, an oil reservoir that is disposed at a bottom portion of the sealed container and allows refrigerating machine oil to be accumulated therein, and an electrical drive element and a compressing element disposed in the sealed container. The compressing element includes a cylinder having a cylindrical inner circumferential surface, a rotor shaft that includes a cylindrical rotor portion that rotates in the cylinder about a rotational axis offset from a central axis of the inner circumferential surface by a predetermined distance, and a shaft portion, through which a rotational force is transmitted from the electrical drive element to the rotor portion. A lower end of the shaft portion is disposed in the oil reservoir. The compressing element also includes a frame that closes one of open ends of the inner circumferential surface of the cylinder. The shaft portion is rotatably supported by a bearing portion of the frame. The compressing element also includes a cylinder head that closes the other open end of the inner circumferential surface of the cylinder. The shaft portion is rotatably supported by a bearing portion of the cylinder head. The compressing element also includes at least one vane disposed in the rotor portion. The vane has a tip end portion on an outer circumferential side. The tip end portion projects from the rotor portion and has a convex arc shape.

In the vane-type compressor, vane angle adjusting means is provided which holds the vane so as to allow a compressing operation to be performed while constantly maintaining a normal to the arc shape of the tip end portion of the vane substantially coincident with a normal to the inner circumferential surface of the cylinder and which supports the vane such that the vane is swingable and movable relative to the rotor portion. The vane angle adjusting means at least includes a bush holding portion and a bush. The substantially cylindrical bush holding portion is formed in the rotor portion and penetrates though the rotor portion in the rotational axis direction. The bush includes a pair of substantially semi-cylindrical parts and is inserted into the bush holding portion with the vane clamped between the pair of substantially semi-cylindrical parts. In the vane-type compressor, the rotor portion has a substantially cylindrical vane relief portion that is formed on a side closer to an inner circumferential side than the bush holding portion of the rotor portion so as not to cause a tip end portion of the vane, the tip end portion being on the inner circumferential side, to be brought into contact with the rotor portion and penetrates therethrough in the rotational axis direction so as to communicate with the bush holding portion. In the vane-type compressor, an oil supply channel that allows communication between the oil reservoir and the vane relief portion and oil supply means that supplies the refrigerating machine oil in the oil reservoir to the oil supply channel are provided.

A vane-type compressor according to another aspect of the present invention includes a sealed container, an oil reservoir that is disposed at a bottom portion of the sealed container and allows refrigerating machine oil to be accumulated therein, and an electrical drive element and a compressing element disposed in the sealed container. The compressing element includes a cylinder having a cylindrical inner circumferential surface, a rotor shaft that includes a cylindrical rotor portion that rotates in the cylinder about a rotational axis offset from a central axis of the inner circumferential surface by a predetermined distance, and a shaft portion, through which a rotational force is transmitted from the electrical drive element to the rotor portion. A lower end of the shaft portion is disposed in the oil reservoir. The compressing element also includes a frame that closes one of open ends of the inner circumferential surface of the cylinder. The shaft portion is rotatably supported by a bearing portion of the frame. The compressing element also includes a cylinder head that closes the other open end of the inner circumferential surface of the cylinder. The shaft portion is rotatably supported by a bearing portion of the cylinder head. The compressing element also includes at least one vane disposed in the rotor portion. The vane has a tip end portion on an outer circumferential side. The tip end portion projects from the rotor portion and has a convex arc shape.

In the vane-type compressor, vane angle adjusting means is provided which holds the vane so as to allow a compressing operation to be performed while constantly maintaining a normal to the arc shape of the tip end portion of the vane substantially coincident with a normal to the inner circumferential surface of the cylinder and which supports the vane such that the vane is swingable and movable relative to the rotor portion. The vane angle adjusting means at least includes vane aligners and vane aligner bearing portions. The vane aligners have respective base portions having a ring shape or a partial ring shape. Each base portion has one of a projection and a recess, the vane has end portions, and each end portion of the vane has the other of the projection and the recess. The vane aligners is connected to the vane each projecting portion being inserted into a corresponding one of the recesses, or the base portions of the vane aligners are integrated with the respective end portions of the vane. The vane aligner bearing portions is disposed in outer circumferential surfaces of recess portions formed in cylinder-side end surfaces of the frame and the cylinder head. The recess portions each have a bottomed cylindrical shape and are coaxial with the inner circumferential surface of the cylinder. The base portions of the vane aligners are inserted into the recess portions, and outer circumferential surfaces of the base portions of the vane aligners are slidably supported by the vane aligner bearing portions. In the vane-type compressor, an oil supply channel that is formed in the rotor shaft and allows communication between the oil reservoir and the recess portions of the frame and the cylinder head, oil supply means that supplies the refrigerating machine oil in the oil reservoir to the oil supply channel, and oil supply channels that allow communication between the vane aligner bearing portion and the recess portion of the frame and between the vane aligner bearing portion and the recess portion of the cylinder head are provided.

A vane-type compressor according to another aspect of the present invention includes a sealed container, an oil reservoir that is disposed at a bottom portion of the sealed container and allows refrigerating machine oil to be accumulated therein, and an electrical drive element and a compressing element disposed in the sealed container. The compressing element includes a cylinder having a cylindrical inner circumferential surface, a rotor shaft that includes a cylindrical rotor portion that rotates in the cylinder about a rotational axis offset from a central axis of the inner circumferential surface by a predetermined distance, and a shaft portion, through which a rotational force is transmitted from the electrical drive element to the rotor portion. A lower end of the shaft portion is disposed in the oil reservoir. The compressing element also includes a frame that closes one of open ends of the inner circumferential surface of the cylinder. The shaft portion is rotatably supported by a bearing portion of the frame. The compressing element also includes a cylinder head that closes the other open end of the inner circumferential surface of the cylinder. The shaft portion is rotatably supported by a bearing portion of the cylinder head. The compressing element also includes at least one vane disposed in the rotor portion. The vane has a tip end portion on an outer circumferential side. The tip end portion projects from the rotor portion and has a convex arc shape.

In the vane-type compressor, vane angle adjusting means is provided which holds the vane so as to allow a compressing operation to be performed while constantly maintaining a normal to the arc shape of the tip end portion of the vane substantially coincident with a normal to the inner circumferential surface of the cylinder and which supports the vane such that the vane is swingable and movable relative to the rotor portion. The vane angle adjusting means at least includes a bush holding portion and a bush. The substantially cylindrical bush holding portion is formed in the rotor portion and penetrates though the rotor portion in the rotational axis direction. The bush includes a pair of substantially semi-cylindrical parts and is inserted into the bush holding portion with the vane clamped between the pair of substantially semi-cylindrical parts. In the vane-type compressor, the rotor portion has a substantially cylindrical vane relief portion that is formed on a side closer to an inner circumferential side than the bush holding portion of the rotor portion so as not to cause a tip end portion of the vane, the tip end portion being on the inner circumferential side, to be brought into contact with the rotor portion and penetrates therethrough in the rotational axis direction so as to communicate with the bush holding portion. In the vane-type compressor, an oil supply channel that allows communication between the oil reservoir and the vane relief portion, oil supply means that supplies the refrigerating machine oil in the oil reservoir to the oil supply channel, and at least one oil supply channel that is formed in the vane and penetrates through the vane from the inner circumferential side to the outer circumferential side are provided.

A vane-type compressor according to another aspect of the present invention includes a sealed container, an oil reservoir that is disposed at a bottom portion of the sealed container and allows refrigerating machine oil to be accumulated therein, and an electrical drive element and a compressing element disposed in the sealed container. The compressing element includes a cylinder having a cylindrical inner circumferential surface, a rotor shaft that includes a cylindrical rotor portion that rotates in the cylinder about a rotational axis offset from a central axis of the inner circumferential surface by a predetermined distance, and a shaft portion, through which a rotational force is transmitted from the electrical drive element to the rotor portion. A lower end of the shaft portion is disposed in the oil reservoir. The compressing element also includes a frame that closes one of open ends of the inner circumferential surface of the cylinder. The shaft portion is rotatably supported by a bearing portion of the frame. The compressing element also includes a cylinder head that closes the other open end of the inner circumferential surface of the cylinder.

The shaft portion is rotatably supported by a bearing portion of the cylinder head. The compressing element also includes at least one vane disposed in the rotor portion. The vane has a tip end portion on an outer circumferential side. The tip end portion projects from the rotor portion and has a convex arc shape.

In the vane-type compressor, vane angle adjusting means is provided which holds the vane so as to allow a compressing operation to be performed while constantly maintaining a normal to the arc shape of the tip end portion of the vane substantially coincident with a normal to the inner circumferential surface of the cylinder and which supports the vane such that the vane is swingable and movable relative to the rotor portion. The vane angle adjusting means at least includes a bush holding portion and a bush. The substantially cylindrical bush holding portion is formed in the rotor portion and penetrates though the rotor portion in the rotational axis direction. The bush includes a pair of substantially semi-cylindrical parts and is inserted into the bush holding portion with the vane clamped between the pair of substantially semi-cylindrical parts. In the vane-type compressor, the rotor portion has a substantially cylindrical vane relief portion that is formed on a side closer to an inner circumferential side than the bush holding portion of the rotor portion so as not to cause a tip end portion of the vane, the tip end portion being on the inner circumferential side, to be brought into contact with the rotor portion and penetrates therethrough in the rotational axis direction so as to communicate with the bush holding portion. In the vane-type compressor, an oil supply channel that allows communication between the oil reservoir and the vane relief portion, oil supply means that supplies the refrigerating machine oil in the oil reservoir to the oil supply channel, and oil supply channels in the bush, which is formed in the bush, one end of each of which is open at a side surface on a corresponding one of the vane sides, and the other end of each of which is open at a side surface on a corresponding one of the bush holding portion sides, are provided.

A vane-type compressor according to another aspect of the present invention includes a sealed container, an oil reservoir that is disposed at a bottom portion of the sealed container and allows refrigerating machine oil to be accumulated therein, and an electrical drive element and a compressing element disposed in the sealed container. The compressing element includes a cylinder having a cylindrical inner circumferential surface, a rotor shaft that includes a cylindrical rotor portion that rotates in the cylinder about a rotational axis offset from a central axis of the inner circumferential surface by a predetermined distance, and a shaft portion, through which a rotational force is transmitted from the electrical drive element to the rotor portion. A lower end of the shaft portion is disposed in the oil reservoir. The compressing element also includes a frame that closes one of open ends of the inner circumferential surface of the cylinder. The shaft portion is rotatably supported by a bearing portion of the frame. The compressing element also includes a cylinder head that closes the other open end of the inner circumferential surface of the cylinder. The shaft portion is rotatably supported by a bearing portion of the cylinder head. The compressing element also includes at least one vane disposed in the rotor portion. The vane has a tip end portion on an outer circumferential side. The tip end portion projects from the rotor portion and has a convex arc shape.

In the vane-type compressor, vane angle adjusting means is provided which holds the vane so as to allow a compressing operation to be performed while constantly maintaining a normal to the arc shape of the tip end portion of the vane substantially coincident with a normal to the inner circumferential surface of the cylinder and which supports the vane such that the vane is swingable and movable relative to the rotor portion. The vane angle adjusting means at least includes a bush holding portion and a bush. The substantially cylindrical bush holding portion is formed in the rotor portion and penetrates though the rotor portion in the rotational axis direction. The bush includes a pair of substantially semi-cylindrical parts and is inserted into the bush holding portion with the vane clamped between the pair of substantially semi-cylindrical parts. In the vane-type compressor, the rotor portion has a substantially cylindrical vane relief portion that is formed on a side closer to an inner circumferential side than the bush holding portion of the rotor portion so as not to cause a tip end portion of the vane, the tip end portion being on the inner circumferential side, to be brought into contact with the rotor portion and penetrates therethrough in the rotational axis direction so as to communicate with the bush holding portion. In the vane-type compressor, an oil supply channel that allows communication between the oil reservoir and the vane relief portion, oil supply means that supplies the refrigerating machine oil in the oil reservoir to the oil supply channel, and an oil supply channel, which is formed in the rotor shaft, one end of which is open at the vane relief portion, and the other end of which is open at the bush holding portion, are provided.

Advantageous Effects of Invention

The vane-type compressor according to the present invention has the oil supply channel that allows communication between the oil reservoir and the vane angle adjusting means (the recess portions formed in the frame and the cylinder head, or the vane relief portion). Thus, by using the oil supply channel, sliding portions of the vane angle adjusting means, the bearing portions by which the shaft portion of the rotor shaft is rotatably supported, and sliding portion, where the vane and the inner circumferential surface of the cylinder slide on each other, can be reliably lubricated with the refrigerating machine oil. Accordingly, the rotor shaft and the vane can be stably supported.

When the oil supply channels that allow communication between the above-described oil supply channel, which communicates with the oil reservoir, and the vane aligner bearing portions are provided, the vane aligner bearing portions can be more reliably lubricated, and accordingly, the vane can be stably supported.

When the oil supply channel that penetrates through the vane is provided, a sliding portion, where the vane and the inner circumferential surface of the cylinder slide on each other, can be more reliably lubricated, and accordingly, the vane can be more stably supported.

When the oil supply channel in the bush or the oil supply channel that allows communication between the above-described oil supply channel, which communicates with the oil reservoir, and the bush holding portion is provided, a sliding portion, where the bush and the bush holding portion slide on each other, can be more reliably lubricated, and accordingly, the vane can be more stably supported.

Thus, the mechanism required to allow the compressing operation to be performed while constantly maintaining the normal to the inner circumferential surface of the cylinder substantially coincident with the normal to the arc of the tip end portion of the vane (mechanism in which the vane is rotated about the center of the cylinder) can be achieved by integrating the rotor portion and the shaft portion (rotational shaft) with each other. Thus, sliding loss in the bearing can be reduced by allowing the rotating shaft to be supported by a structure having a small diameter, and accuracy of the outer diameter of the rotor portion and the rotational center can be improved. Accordingly, leakage loss can be reduced by forming the small gap between the rotor portion and the inner circumferential surface of the cylinder.

DESCRIPTION OF EMBODIMENTS

Examples of a vane-type compressor according to the present invention will be described in Embodiments below.

Embodiment 1

Figure 1:
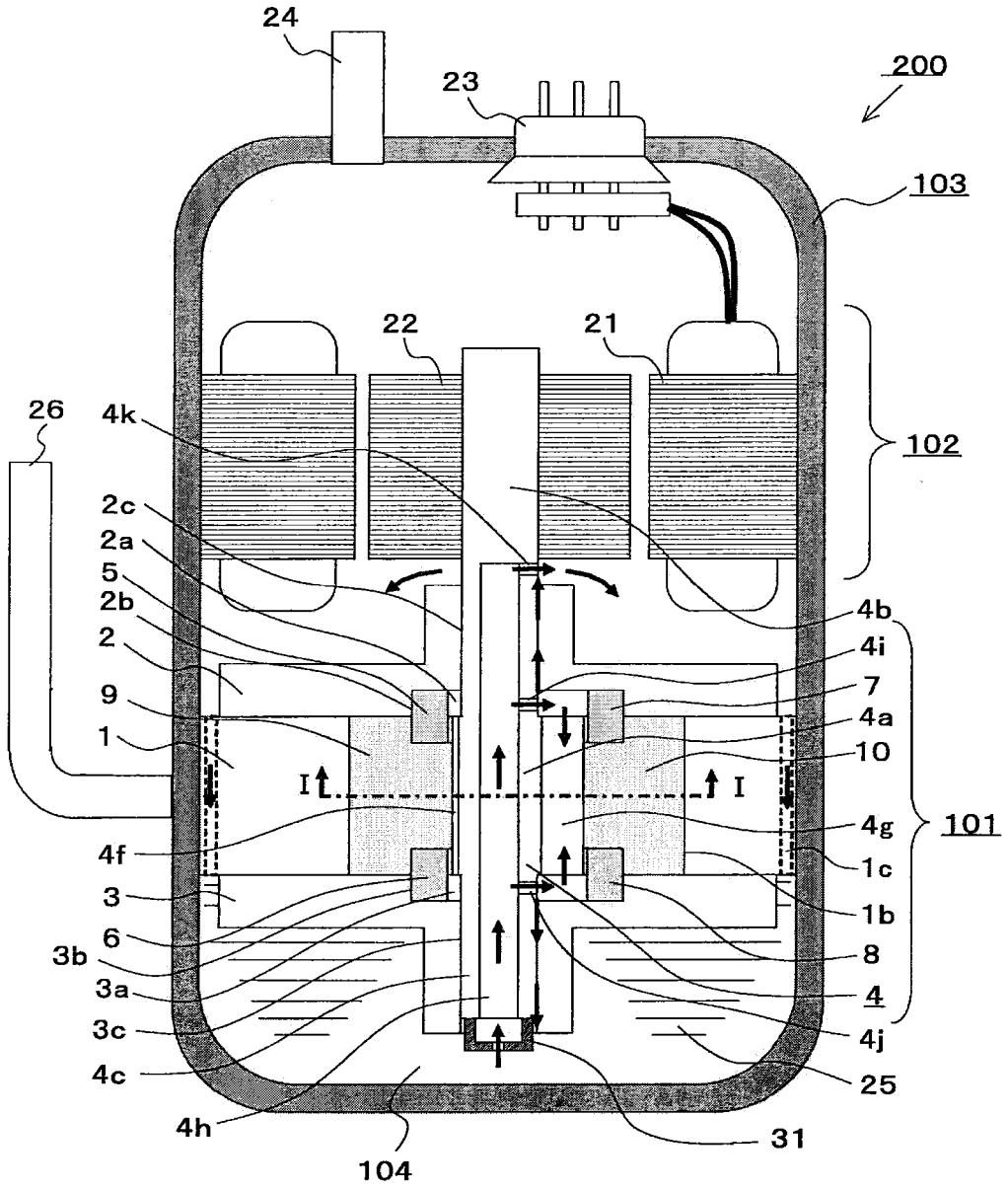
FIG. 1 is a longitudinal sectional view of a vane-type compressor according to Embodiment 1 of the present invention.
Figure 2:
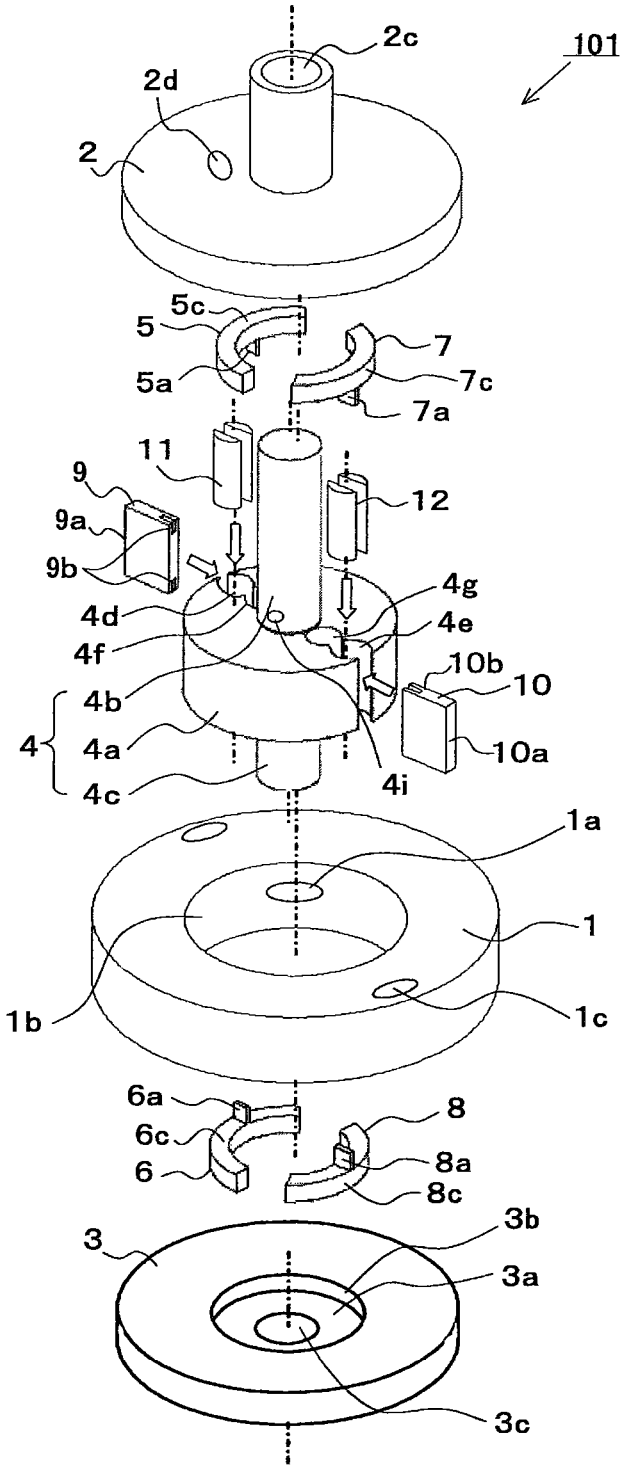
FIG. 2 is an exploded perspective view of a compressing element of the vane-type compressor according to Embodiment 1 of the present invention.
Figure 3:
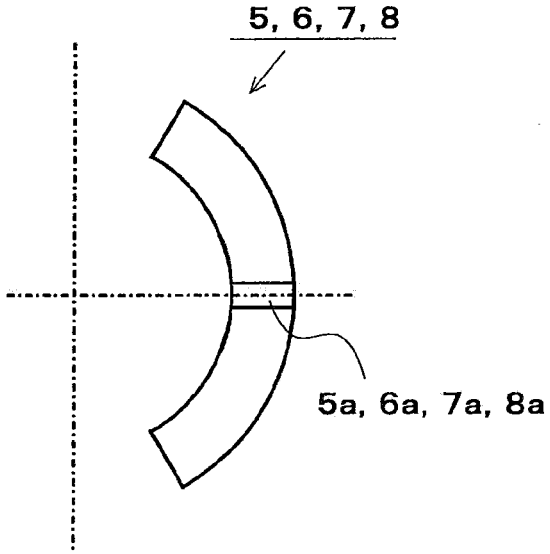
FIG. 3 is a plan view or a bottom view of vane aligners of the compressing element according to Embodiment 1 of the present invention.

FIG. 1 is a longitudinal sectional view of a vane-type compressor according to Embodiment 1 of the present invention. FIG. 2 is an exploded perspective view of a compressing element of the vane-type compressor. FIG. 3 is a plan view or a bottom view of vane aligners of the compressing element. Arrows in FIG. 1 indicate flows of refrigerating machine oil 25. FIG. 3 illustrates a bottom view of vane aligners 5 and 7 and a plan view of vane aligners 6 and 8. A vane-type compressor 200 according to Embodiment 1 is described below with reference to FIGS. 1 to 3.

The vane-type compressor 200 includes a sealed container 103, a compressing element 101, and an electrical drive element 102 that drives the compressing element 101. The compressing element 101 and the electrical drive element 102 are housed in the sealed container 103. The compressing element 101 is disposed in a lower portion in the sealed container 103. The electrical drive element 102 is disposed in an upper portion in the sealed container 103 (more specifically, above the compressing element 101). An oil reservoir 104 is provided at a bottom portion of the sealed container 103. The oil reservoir 104 allows the refrigerating machine oil 25 to be accumulated therein. A suction pipe 26 is attached to a side surface of the sealed container 103 and a discharge pipe 24 is attached to an upper surface of the sealed container 103.

The electrical drive element 102 that drives the compressing element 101 uses, for example, a brushless DC motor. The electrical drive element 102 includes a stator 21 and a rotor 22. The stator 21 is secured to an inner circumference of the sealed container 103. The rotor 22 is disposed inside the stator 21. When power is supplied to a coil of the stator 21 through a glass terminal unit 23, which is secured to the sealed container 103 by welding or the like, a magnetic field is generated in the stator 21, thereby imparting a drive force to a permanent magnet of the rotor 22 and rotating the rotor 22.

The compressing element 101 sucks a low-pressure gas refrigerant into a compressing chamber through the suction pipe 26, compresses the refrigerant, and discharges the compressed refrigerant into the sealed container 103. The refrigerant discharged into the sealed container 103 passes through the electrical drive element 102 and is discharged to the outside of the sealed container 103 (high-pressure side of a refrigeration cycle) through the discharge pipe 24 secured (welded) to an upper portion of the sealed container 103. The compressing element 101, the compressing element 101 to be described below, includes the following sub-elements. The vane-type compressor 200 according to Embodiment 1 is described as a vane-type compressor equipped with two vanes (first vane 9 and second vane 10).

(1) Cylinder 1: a cylinder 1 generally has a substantially cylindrical shape and opens at both end portions in a central axis direction. A suction port 1*a* extends from an outer circumferential surface to an inner circumferential surface 1*b*, which has a substantially cylindrical shape. Oil return ports 1*c* penetrate through an outer circumferential portion of the cylinder 1 in the axial direction (direction along a central axis of the inner circumferential surface 1*b*).

(2) Frame 2: a frame 2 includes a substantially disc-shaped member and a cylindrical member disposed on the upper side of the substantially disc-shaped member. The frame 2 has a substantially T-shaped section. The substantially disc-shaped member closes one of the openings (upper opening in FIG. 2) of the cylinder 1. The substantially disc-shaped member has a recess portion 2*a* in a cylinder 1-side end surface (lower surface in FIG. 2) thereof. The recess portion 2*a* is concentric with the inner circumferential surface 1*b* of the cylinder 1 and has a bottomed cylindrical shape. The vane aligners 5 and 7, which will be described later, are inserted into the recess portion 2*a*. The vane aligners 5 and 7 are rotatably supported by a vane aligner bearing portion 2*b*, which is an outer circumferential surface of the recess portion 2*a*. The frame 2 has a through hole that penetrates through the substantially cylindrical member from the cylinder 1-side end surface of the substantially disc-shaped member. A main bearing portion 2*c* is provided in the through hole. A rotating shaft portion 4*b* of a rotor shaft 4, which will be described later, is rotatably supported by the main bearing portion 2*c*. Furthermore, a discharge port 2*d* is formed in a substantially central portion of the frame 2. The discharge port 2*d* may be formed in a cylinder head 3, which will be described later.

(3) Cylinder head 3: the cylinder head 3 includes a substantially disc-shaped member and a cylindrical member disposed on the lower side of the substantially disc-shaped member. The cylinder head 3 has a substantially T-shaped section (see FIG. 1). The substantially disc-shaped member closes the other opening (lower opening in FIG. 2) of the cylinder 1. The substantially disc-shaped member has a recess portion 3*a* in a cylinder 1-side end surface (upper surface in FIG. 2) thereof. The recess portion 3*a* is concentric with the inner circumferential surface 1*b* of the cylinder 1 and has a bottomed cylindrical shape. The vane aligners 6 and 8, which will be described later, are inserted into the recess portion 3*a*. The vane aligners 6 and 8 are rotatably supported by a vane aligner bearing portion 3*b*, which is an outer circumferential surface of the recess portion 3*a*. The cylinder head 3 has a through hole that penetrates through the substantially cylindrical member from the cylinder 1-side end surface of the substantially disc-shaped member. A main bearing portion 3*c* is provided in the through hole. A rotating shaft portion 4*c* of the rotor shaft 4, which will be described later, is rotatably supported by the main bearing portion 3*c*.

(4) Rotor shaft 4: the rotor shaft 4 includes a substantially cylindrical rotor portion 4*a*, the rotating shaft portion 4*b*, and the rotating shaft portion 4*c*. The rotating shaft portion 4*b* is provided on the upper side of the rotor portion 4*a* so as to be concentric with the rotor portion 4*a*. The rotating shaft portion 4*c* is provided on the lower side of the rotor portion 4*a* so as to be concentric with the rotor portion 4*a*. The rotor portion 4*a* is rotated about a rotational axis, which is eccentric with respect to a central axis of the cylinder 1 by a predetermined distance. The rotating shaft portion 4*b* and rotating shaft portion 4*c* are, as described above, rotatably supported by the main bearing portion 2*c* and the main bearing portion 3*c*, respectively. The rotor portion 4*a* has a plurality of substantially cylindrical (substantially circular in section) through holes (bush holding portions 4*d* and 4*e* and vane relief portions 4*f* and 4*g*) that penetrate through the rotor portion 4*a* in the axial direction. Out of these through holes, the bush holding portion 4*d* and the vane relief portion 4*f* are communicated with each other at side surface portions thereof, and the bush holding portion 4*e* and the vane relief portion 4*g* are communicated with each other at side surface portions thereof. The bush holding portions 4*d* and 4*e* are open at the side surface portions thereof on an outer circumferential portion side of the rotor portion 4*a*. End portions of the vane relief portions 4*f* and 4*g*, the end portions being at ends in the axial direction, are communicated with the recess portion 2*a* of the frame 2 and the recess portion 3*a* of the cylinder head 3. The bush holding portion 4*d* and the bush holding portion 4*e* are disposed at positions substantially symmetrical about the rotational axis of the rotor portion 4*a*, and the vane relief portion 4*f* and the vane relief portion 4*g* are disposed at positions substantially symmetrical about the rotational axis of the rotor portion 4*a* (also see FIG. 4, which will be described later).

An oil pump 31 (illustrated only in FIG. 1) is provided at a lower end portion of the rotor shaft 4. The oil pump 31 is such an oil pump as described in, for example, Japanese Unexamined Patent Application Publication No. 2009-264175. The oil pump 31 sucks the refrigerating machine oil 25 in the oil reservoir 104 by utilizing the centrifugal force of the rotor shaft 4. The oil pump 31 communicates with an oil supply channel 4*h*, which is provided at a shaft central portion of the rotor shaft 4 and extends in the axial direction. An oil supply channel 4*i* is provided between the oil supply channel 4*h* and the recess portion 2*a*, and an oil supply channel 4*j* is provided between the oil supply channel 4*h* and the recess portion 3*a*. An oil discharge port 4*k* (illustrated only in FIG. 1) is provided in the rotating shaft portion 4*b* at a position above the main bearing portion 3*c*.

(5) Vane aligners 5 and 7: the vane aligners 5 and 7 respectively have a base portions 5*c* and 7*c*, which each have a partial ring shape, and vane holding portions 5*a* and 7*a*. The vane holding portions 5*a* and 7*a* each stand erect on one of end surfaces (lower end surface in FIG. 2) of a corresponding one of the base portions 5*c* and 7*c*. The vane holding portions 5*a* and 7*a* are, for example, a plate-shaped projection having a substantially quadrangular section. In Embodiment 1, the vane holding portions 5*a* and 7*a* are formed in a normal direction (radial direction) of the base portions 5*c* and 7*c*.

(6) Vane aligners 6 and 8: the vane aligners 6 and 8 respectively have a base portions 6*c* and 8*c*, which each have a partial ring shape, and vane holding portions 6*a* and 8*a*. The vane holding portions 6*a* and 8*a* each stand erect on one of end surfaces (upper end surface in FIG. 2) of a corresponding one of the base portions 6*c* and 8*c*. The vane holding portions 6*a* and 8*a* are, for example, a plate-shaped projection having a substantially quadrangular section. In Embodiment 1, the vane holding portions 6*a* and 8*a* are formed in a normal direction of the base portions 6*c* and 8*c*.

(7) First vane 9: the first vane 9 is a plate-shaped member having a substantially quadrangular section. A tip end portion 9*a* (tip end portion on a projecting side from the rotor portion 4*a*) is positioned on the side of the inner circumferential surface 1*b* of the cylinder 1 and has an arc shape projecting outward in plan view. The radius of the arc shape of the tip end portion 9*a* is substantially equal to the radius of the inner circumferential surface 1*b* of the cylinder 1. A slit-shaped rear surface groove 9*b* is formed in an upper surface (surface opposite the frame 2) near an end portion (hereafter, referred to as an inner circumferential end portion) opposite to the tip end portion 9*a* of the first vane 9. The vane holding portion 5*a* of the vane aligner 5 is inserted into the rear surface groove 9*b*. Likewise, the other slit-shaped rear surface groove 9*b* is formed in a lower surface (surface opposite the cylinder head 3) near the inner circumferential end portion of the first vane 9. The vane holding portion 6*a* of the vane aligner 6 is inserted into the other rear surface groove 9*b*. In Embodiment 1, the rear surface grooves 9*b* are formed in the longitudinal direction of the first vane 9 from the inner circumferential end portion. The rear surface grooves 9*b* each extend to a position so as to allow a corresponding one of the vane holding portions 5*a* and 6*a* to be inserted thereinto. Of course, these rear surface grooves 9*b* may be formed in the longitudinal direction of the first vane 9 over the entire regions of the upper and lower surfaces of the first vane 9.

(8) Second vane 10: the second vane 10 is a plate-shaped member having a substantially quadrangular section. A tip end portion 10*a* (tip end portion on a projecting side from the rotor portion 4*a*) is positioned on the side of the inner circumferential surface 1*b* of the cylinder 1 and has an arc shape projecting outward in plan view. The radius of the arc shape of the tip end portion 10*a* is substantially equal to the radius of the inner circumferential surface 1*b* of the cylinder 1. A slit-shaped rear surface groove 10*b* is formed in an upper surface (surface opposite the frame 2) near an inner circumferential end portion of the second vane 10. The vane holding portion 7*a* of the vane aligner 7 is inserted into the rear surface groove 10*b*. Likewise, another slit-shaped rear surface groove 10*b* is formed in a lower surface (surface opposite the cylinder head 3) near the inner circumferential end portion of the second vane 10. The vane holding portion 8*a* of the vane aligner 8 is inserted into the other rear surface groove 10*b*. In Embodiment 1, the rear surface grooves 10*b* are formed in the longitudinal direction of the second vane 10 from the inner circumferential end portion. The rear surface grooves 10*b* each extend to a position so as to allow a corresponding one of the vane holding portions 7*a* and 8*a* to be inserted thereinto. Of course, these rear surface grooves 10*b* may be formed in the longitudinal direction of the second vane 10 over the entire regions of the upper and lower surfaces of the second vane 10.

(9) Bushes 11 and 12: the bushes 11 and 12 each include a pair of substantially semi-cylindrical members. The bush 11 is rotatably inserted into the bush holding portion 4*d* of the rotor portion 4*a* while clamping the first vane 9. The bush 12 is rotatably inserted into the bush holding portion 4*e* of the rotor portion 4*a* while clamping the second vane 10. That is, the first vane 9 can be moved in a substantially centrifugal direction relative to the rotor portion 4*a* (centrifugal direction relative to the center of the inner circumferential surface 1*b* of the cylinder 1) by sliding the first vane 9 in the bush 11. Also, the first vane 9 can be swung by rotation of the bush 11 in the bush holding portion 4*d* of the rotor portion 4*a*. Likewise, the second vane 10 can be moved in the substantially centrifugal direction relative to the rotor portion 4*a* by sliding the second vane 10 in the bush 12. Also, the second vane 10 can be swung by rotation of the bush 12 in the bush holding portion 4*e* of the rotor portion 4*a*.

By insertion of the vane holding portions 5*a* and 6*a* of the vane aligners 5 and 6 into the rear surface grooves 9*b* of the first vane 9 and inserting the vane holding portions 7*a* and 8*a* of the vane aligners 7 and 8 into the rear surface grooves 10*b* of the second vane 10, the directions of the normals to the arcs of the tip ends of the first and second vanes 9 and 10 are regulated so as to be constantly coincident with that of the normal to the cylinder inner circumferential surface 1*b*.

Here, the vane aligners 5, 6, 7, and 8, the vane aligner bearing portions 2*b* and 3*b* of the recess portions 2*a* and 3*a*, the bush holding portions 4*d* and 4*e*, and the bushes 11 and 12 correspond to vane angle adjusting means of the present invention.

(Description of Operation)

Next, operation of the vane-type compressor 200 according to Embodiment 1 is described.

When the rotating shaft portion 4*b* of the rotor shaft 4 receives a rotational drive force from the electrical drive element 102 as a drive unit, the rotor portion 4*a* is rotated in the cylinder 1. As the rotor portion 4*a* is rotated, the bush holding portions 4*d* and 4*e* disposed near the outer circumference of the rotor portion 4*a* is moved in a circular path about the rotor shaft 4 as the rotational axis (central axis). A pair of bushes 11 and 12, which are held in the bush holding portions 4*d* and 4*e*, and the first and second vanes 9 and 10, which are rotatably held in the pair of bushes 11 and 12, are rotated together with the rotor portion 4*a*. As these are rotated, the bush 11 and side surfaces of the first vane 9 slide on one another, and the bush 12 and side surfaces of the second vane 10 slide on one another. Furthermore, the bush holding portion 4*d* of the rotor shaft 4 and the bush 11 slide on each other, and the bush holding portion 4*e* and the bush 12 slide on each other.

At this time, the vane aligner 5, the vane holding portion 5*a* of which is slidably inserted into the rear surface groove 9*b* of the first vane 9, is rotated in the recess portion 2*a*. The vane aligner 6, the vane holding portion 6*a* of which is slidably inserted into the rear surface groove 9*b* of the first vane 9, is also rotated in the recess portion 3*a*. As described above, the recess portion 2*a*, into which the vane aligner 5 is inserted, and the recess portion 3*a*, into which the vane aligner 6 is inserted, are concentric with the inner circumferential surface 1*b* of the cylinder 1. Thus, the vane holding portions 5*a* and 6*a* are rotated about the central axis of the inner circumferential surface 1*b* of the cylinder 1, and accordingly, the direction of the first vane 9 is regulated such that the longitudinal direction of the first vane 9 is coincident with the normal direction of the inner circumferential surface 1*b* of the cylinder 1.

Likewise, the vane aligner 7, the vane holding portion 7*a* of which is slidably inserted into the rear surface groove 10*b* of the second vane 10, is rotated in the recess portion 2*a*. The vane aligner 8, the vane holding portion 8*a* of which is slidably inserted into the rear surface groove 10*b* of the second vane 10, is also rotated in the recess portion 3*a*. As described above, the recess portion 2*a*, into which the vane aligner 7 is inserted, and the recess portion 3*a*, into which the vane aligner 8 is inserted, are concentric with the inner circumferential surface 1*b* of the cylinder 1. Thus, the vane holding portions 7*a* and 8*a* are rotated about the central axis of the inner circumferential surface 1*b* of the cylinder 1, and accordingly, the direction of the second vane 10 is regulated such that the longitudinal direction of the second vane 10 is coincident with the normal direction of the inner circumferential surface 1*b* of the cylinder 1.

Furthermore, the first vane 9 and the second vane 10 are pressed toward the inner circumferential surface 1*b* of the cylinder 1 by the centrifugal force or the like, and the tip end portion 9*a* of the first vane 9 and the tip end portion 10*a* of the second vane 10 slide along the inner circumferential surface 1*b* of the cylinder 1. In so doing, the radius of the arc of the tip end portion 9*a* of the first vane 9 and the radius of the arc of the tip end portion 10*a* of the second vane 10 are substantially coincident with the radius of the inner circumferential surface 1*b* of the cylinder 1. Furthermore, the normals to the arcs are substantially coincident with the normal to the inner circumferential surface 1*b*. Thus, a sufficient oil film is formed between the inner circumferential surface 1*b* and the arcs of the tip end portions 9*a* and 10*a* of the first and second vanes 9 and 10, thereby hydrodynamic lubrication is achieved therebetween. A structure with which the first vane 9 is moved toward the inner circumferential surface 1*b* of the cylinder 1 may be, for example, as follows: that is, a high-pressure or a middle-pressure refrigerant is introduced into a space near the inner circumferential end portion of the first vane 9 so as to utilize a pressure difference between a pressure on the tip end portion 9*a* side and a pressure on the inner circumferential end portion side of the first vane 9. Alternatively, the first vane 9 is pushed by, for example, an elastic member such as a spring so as to move the first vane 9 toward the inner circumferential surface 1*b* of the cylinder 1. The second vane 10 is moved toward the inner circumferential surface 1*b* of the cylinder 1 by using a similar structure.

As described above, by operating members of the compressing element 101, a refrigerant is compressed by the compressing element 101 as follows.

Figure 4:
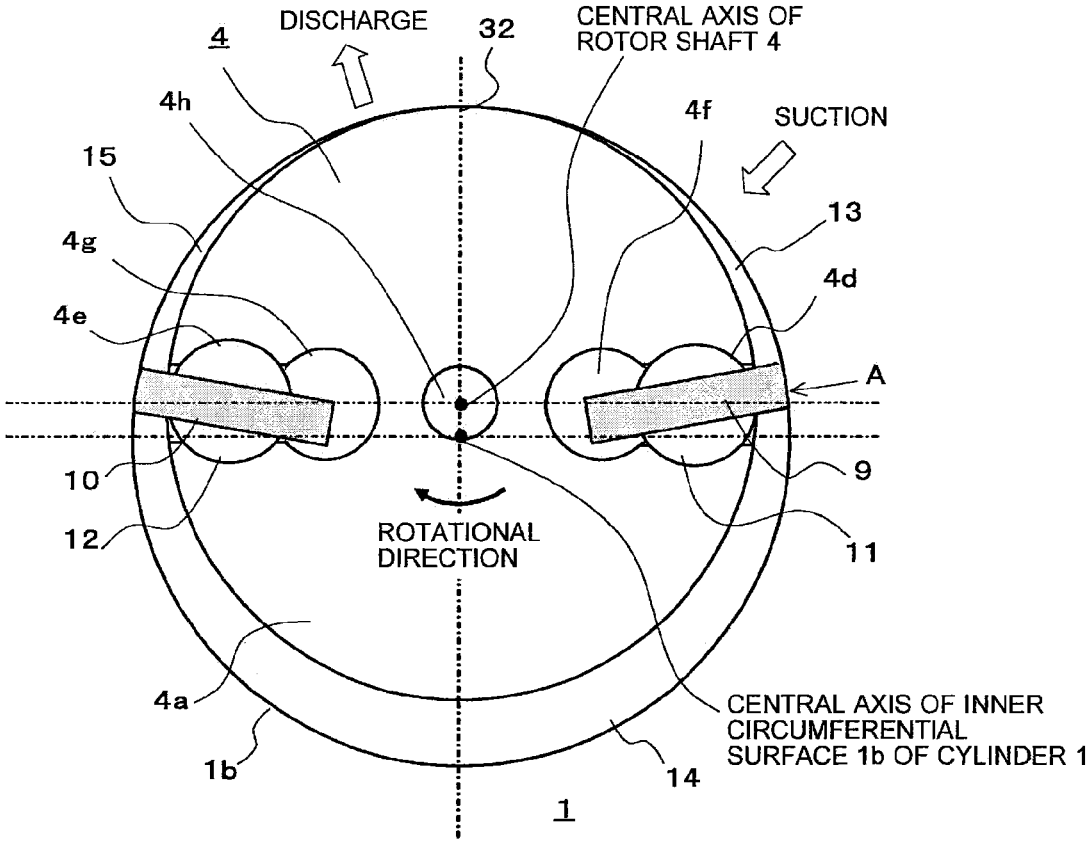
FIG. 4 is a sectional view of the compressing element according to Embodiment 1 of the present invention taken along line I-I in FIG. 1.

FIG. 4 is a sectional view of the compressing element according to Embodiment 1 of the present invention. FIG. 4 is a sectional view taken along line I-I in FIG. 1 and illustrates a state in which the rotor portion 4*a* (rotor shaft 4) is rotated by 90° as will be described later with reference to FIG. 5. A refrigerant compressing operation performed by the compressing element 101 according to Embodiment 1 is described below with reference to FIG. 4.

As illustrated in FIG. 4, the rotor portion 4*a* of the rotor shaft 4 and the inner circumferential surface 1*b* of the cylinder 1 are closest to each other at a single position (closest point 32 in FIG. 4). The first vane 9 and the inner circumferential surface 1*b* of the cylinder 1 slide on each other at a single position and the second vane 10 and the inner circumferential surface 1*b* of the cylinder 1 slide on each other at a single position, thereby forming three spaces (suction chamber 13, middle chamber 14, and compressing chamber 15) in the cylinder 1. The suction port 1*a* that communicates with a low-pressure side of the refrigeration cycle is open at the suction chamber 13. The compressing chamber 15 communicates with the discharge port 2*d* formed in the frame 2. The discharge port 2*d* is closed by a discharge valve (not shown) except when the refrigerant is discharged. The middle chamber 14 communicates with the suction port 1*a* in a certain rotational angle range of the rotor portion 4*a*. After that, there is a rotational angle range where the middle chamber 14 is communicates with neither the suction port 1*a* nor the discharge port 2*d*. After that, the middle chamber 14 communicates with the discharge port 2*d*.

Figure 5:
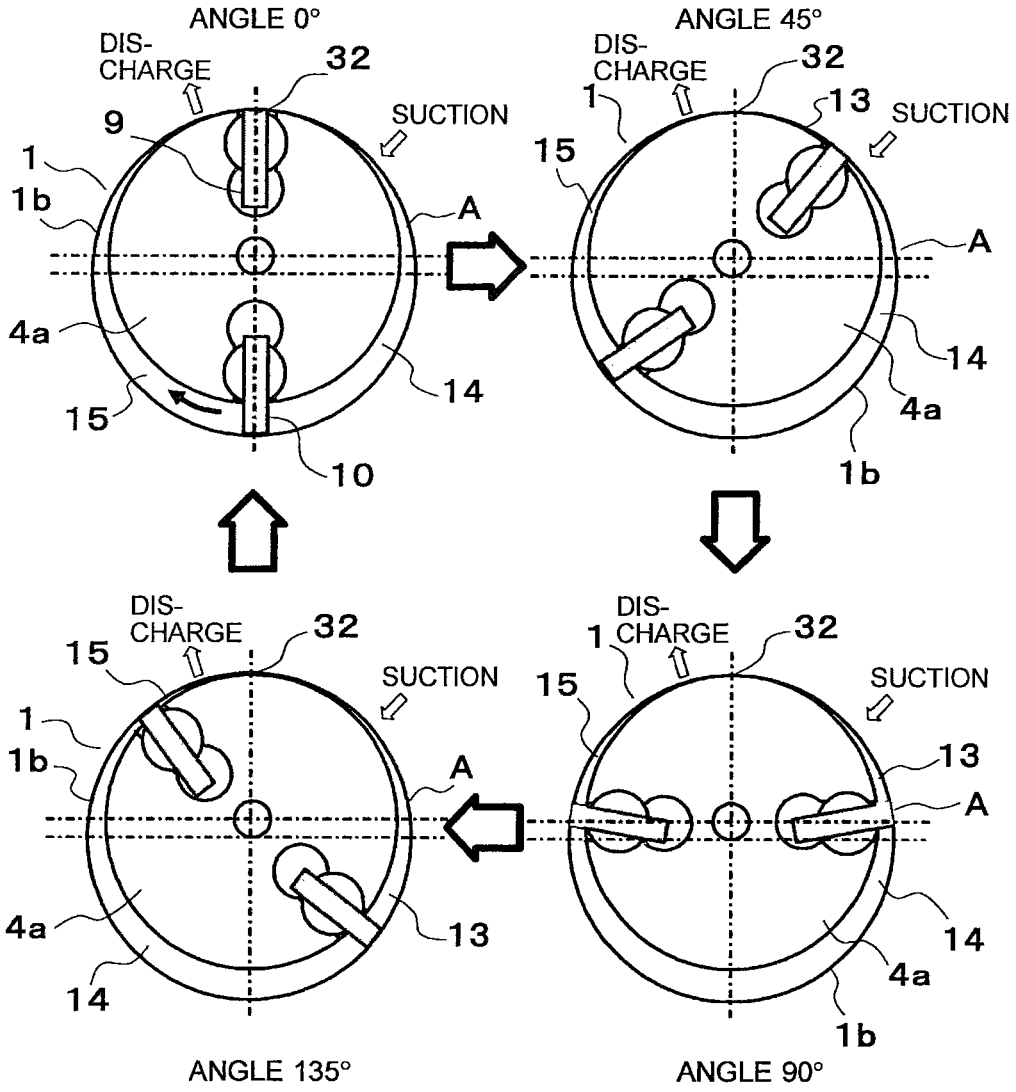
FIG. 5 includes explanatory views of a compressing operation of the compressing element according to Embodiment 1 of the present invention, illustrating a section taken along line I-I in FIG. 1.

FIG. 5 includes explanatory views of the compressing operation of the compressing element according to Embodiment 1 of the present invention. Sectional views in FIG. 5 are taken along line I-I in FIG. 1. How the volumes of the suction chamber 13, the middle chamber 14, and the compressing chamber 15 are changed as the rotor portion 4*a* (rotor shaft 4) is rotated is described below with reference to FIG. 5. In order to describe the changes in the volumes of the spaces (suction chamber 13, middle chamber 14, and compressing chamber 15), the rotational angle of the rotor portion 4*a* (rotor shaft 4) is defined as follows. Initially, when the rotor shaft 4 is in a state in which a position where the first vane 9 and the inner circumferential surface 1*b* of the cylinder 1 slide on (in contact with) each other is coincident with the closest point 32, it is defined that the rotor shaft 4 is in an "ANGLE 0°" position.

In FIG. 5, the positions of the first vane 9 and the second vane 10 and the states of the suction chamber 13, the middle chamber 14, and the compressing chamber 15 are illustrated when the rotor shaft 4 is in the "ANGLE 0°", "ANGLE 45°", "ANGLE 90°", and "ANGLE 135°" positions.

An arrow in one of the views of FIG. 5 that illustrates "ANGLE 0°" indicates a rotational direction (clockwise in FIG. 5) of the rotor shaft 4. The allow indicating the rotational direction of the rotor shaft 4 is omitted from other views in FIG. 5. Also in FIG. 5, the states in the "ANGLE 180°" position and in larger angle positions are not illustrated. The reason for this is that when the rotor portion 4*a* is in the "ANGLE 180°" position, the state becomes the same as that in the "ANGLE 0°" position except for the first vane 9 and the second vane 10 being interchanged with each other, and after that, the compressing operation is the same as that performed in the "ANGLE 0°" position to the "ANGLE 135°" position.

The suction port 1*a* is provided at a position between a point A (see FIG. 4) and the closest point 32 (for example, at about 45° position). At the point A, the tip end portion 9*a* of the first vane 9 and the inner circumferential surface 1*b* of the cylinder 1 slide on each other in the "ANGLE 90°" state. That is, the suction port 1*a* opens in a range from the closest point 32 to the point A. It is noted that, in FIGS. 4 and 5, the suction port 1*a* is simply represented as "SUCTION".

The discharge port 2*d* is positioned near the closest point 32. The position of the discharge port 2*d* is on an upstream side (left side in FIGS. 4 and 5) of the closest point 32 in the rotational direction of the rotor portion 4*a* and spaced apart from the closest point 32 by a specified angle (distance) (for example, on the upstream side of the closest point 32 in the rotational direction of the rotor portion 4*a* and spaced apart from the closest point 32 by about 30°). It is noted that, in FIGS. 4 and 5, the discharge port 2*d* is simply represented as "DISCHARGE".

Referring to "ANGLE 0°" in FIG. 5, out of the spaces defined by the closest point 32 and the second vane 10, the space on the right side is the middle chamber 14, which communicates with the suction port 1*a* and allows the gas (refrigerant) to be sucked therethrough. Out of the spaces defined by the closest point 32 and the second vane 10, the space on the left side is the compressing chamber 15, which communicates with the discharge port 2*d*.

Referring to "ANGLE 45°" in FIG. 5, the space defined by the first vane 9 and the closest point 32 is the suction chamber 13, and the space defined by the first vane 9 and the second vane 10 is the middle chamber 14. In this state, the middle chamber 14 communicates with the suction port 1*a*. The middle chamber 14, the volume of which is larger than that in the "ANGLE 0°" position, continues to suck the gas. The space defined by the second vane 10 and the closest point 32 is the compressing chamber 15. The volume of the compressing chamber 15 is smaller than that in the "ANGLE 0° position", and accordingly, the refrigerant is compressed and the pressure thereof is gradually increased.

Referring to "ANGLE 90°" in FIG. 5, since the tip end portion 9*a* of the first vane 9 is superposed with the point A on the inner circumferential surface 1*b* of the cylinder 1, the middle chamber 14 does not communicate with the suction port 1*a*. Thus, the suction of the gas into the middle chamber 14 ends. In this state, the volume of the middle chamber 14 is substantially the maximum. The volume of the compressing chamber 15 is reduced compared to that in the "ANGLE 45°" position, and the pressure of the refrigerant is increased. The volume of the suction chamber 13 is larger than that in the "ANGLE 45°" position, and the suction is continued.

Referring to "ANGLE 135°" in FIG. 5, the volume of the middle chamber 14 is smaller than that in the "ANGLE 90°" position, and the pressure of the refrigerant is increased. The volume of the compressing chamber 15 is also smaller than in the "ANGLE 90°" position, and the pressure of the refrigerant is increased. The volume of the suction chamber 13 is larger than that in the "ANGLE 90°" position, and the suction is continued.

After that, the second vane 10 approaches the discharge port 2*d*. When the pressure in the compressing chamber 15 exceeds the high pressure of the refrigeration cycle (including a pressure required to open the discharge valve, which is not shown), the discharge valve is opened and the refrigerant in the compressing chamber 15 is discharged into the sealed container 103. The refrigerant discharged into the sealed container 103 passes through the electrical drive element 102 and is discharged to the outside of the sealed container 103 (high-pressure side of a refrigeration cycle) through the discharge pipe 24 secured (welded) to the upper portion of the sealed container 103. Accordingly, the pressure in the sealed container 103 becomes a discharge pressure, which is a high pressure.

When the second vane 10 passes through the discharge port 2*d*, a small amount of the high-pressure refrigerant remains in the compressing chamber 15 (is lost). In the "ANGLE 180°" position (not shown), where the compressing chamber 15 no longer exists, the high-pressure refrigerant changes into a low-pressure refrigerant in the suction chamber 13. In the "ANGLE 180°" position (not shown), the suction chamber 13 transitions to the middle chamber 14 and the middle chamber 14 transitions to the compressing chamber 15, thereby repeating the compressing operation after that.

As described above, by rotation of the rotor portion 4*a* (rotor shaft 4), the volume of the suction chamber 13 is gradually increased and the suction of the gas is continued. After that, the suction chamber 13 transitions to the middle chamber 14, the volume of the middle chamber 14 is gradually increased until the compressing operation reaches a certain middle stage thereof, and the suction of the gas is continued. In the middle of the compressing operation, the volume of the middle chamber 14 becomes maximum and the middle chamber 14 no longer communicates with the suction port 1*a*. At this state, the suction of the gas ends. Then, the volume of the middle chamber 14 is gradually reduced, thereby compressing the gas. After that, the middle chamber 14 transitions to the compressing chamber 15 and continues to compress the gas. The gas having compressed to a specified pressure is discharged through a discharge port (for example, discharge port 2*d*) formed at a portion of the cylinder 1, the frame 2, or the cylinder head 3, the portion opening at the compressing chamber 15.

Figure 6:
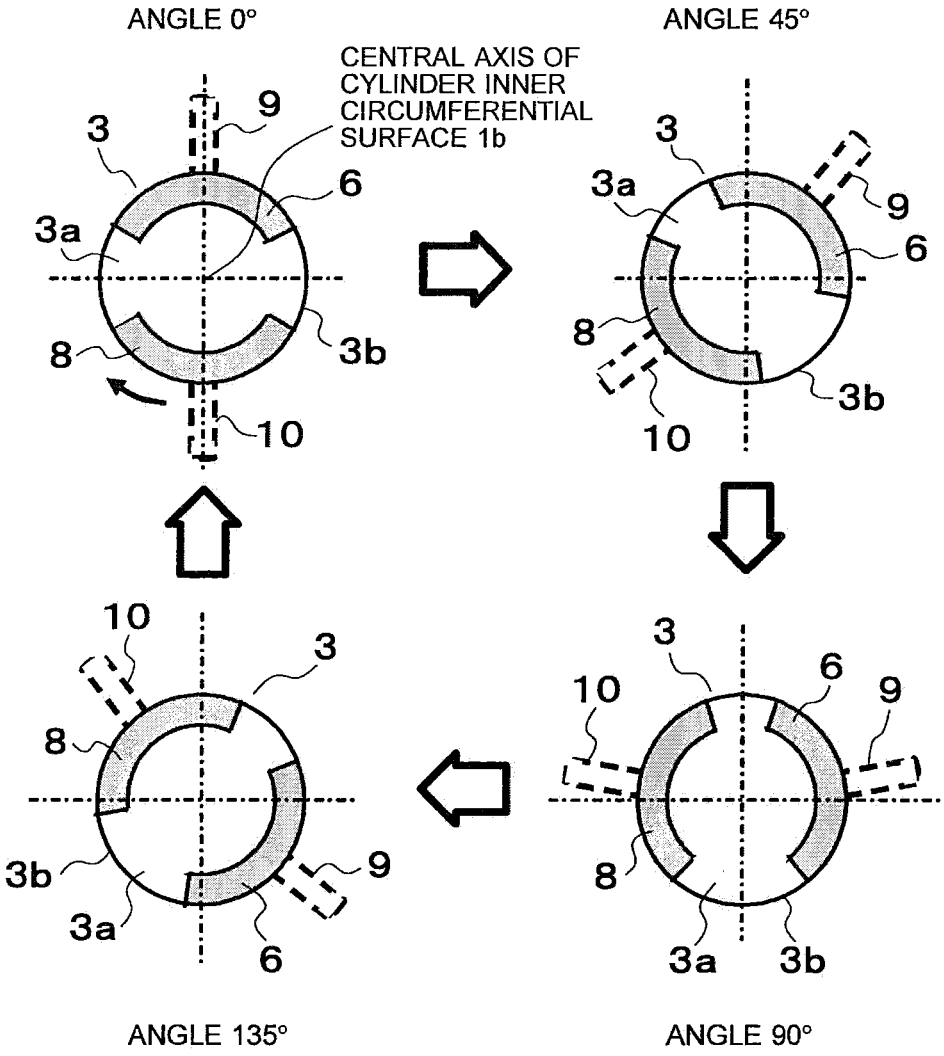
FIG. 6 includes bottom sectional views illustrating a rotational operation of the vane aligners according Embodiment 1 of the present invention.

FIG. 6 includes bottom sectional views illustrating a rotational operation of the vane aligners according Embodiment 1 of the present invention. In FIG. 6, the rotational operation of the vane aligners 6 and 8 are illustrated. An arrow in one of the views of FIG. 6 that illustrates "ANGLE 0°" indicates a rotational direction (clockwise in FIG. 6) of the vane aligners 6 and 8. The allow indicating the rotational direction of the vane aligners 6 and 8 is omitted from other views in FIG. 6. By rotation of the rotor shaft 4, the first vane 9 and the second vane 10 are rotated about the center of the cylinder 1 (FIG. 5). Accordingly, as illustrated in FIG. 6, the vane aligners 6 and 8, which are respectively engaged with the first vane 9 and the second vane 10, are also rotated about the center of the cylinder 1 in the recess portion 3*a* while being supported by the vane aligner bearing portion 3*b*. The vane aligners 5 and 7 are similarly rotated in the recess portion 2*a* while being supported by the vane aligner bearing portion 2*b*.

By rotation of the rotor shaft 4 in the above-described refrigerant compressing operation, the refrigerating machine oil 25 is sucked from the oil reservoir 104 by the oil pump 31 and fed to the oil supply channel 4*h* as indicated by the arrows in FIG. 1. The refrigerating machine oil 25 having been fed to the oil supply channel 4*h* is fed to the recess portion 2*a* of the frame 2 through the oil supply channel 4*i* and fed to the recess portion 3*a* of the cylinder head 3 through the oil supply channel 4*j*.

The refrigerating machine oil 25 having been fed to the recess portions 2*a* and 3*a* lubricates the vane aligner bearing portions 2*b* and 3*b*. Part of the refrigerating machine oil 25 having been fed to the recess portions 2*a* and 3*a* is supplied to the vane relief portions 4*f* and 4*g*, which communicate with the recess portions 2*a* and 3*a*. Here, since the pressure inside the sealed container 103 is the discharge pressure, which is a high pressure, the pressures in the recess portions 2*a* and 3*a* and the vane relief portions 4*f* and 4*g* are also the discharge pressure. Furthermore, part of the refrigerating machine oil 25 having been fed to the recess portions 2*a* and 3*a* is supplied to the main bearing portion 2*c* of the frame 2 and the main bearing portion 3*c* of the cylinder head 3.

The refrigerating machine oil 25 having been fed to the vane relief portions 4*f* and 4*g* flows as follows.

Figure 7:
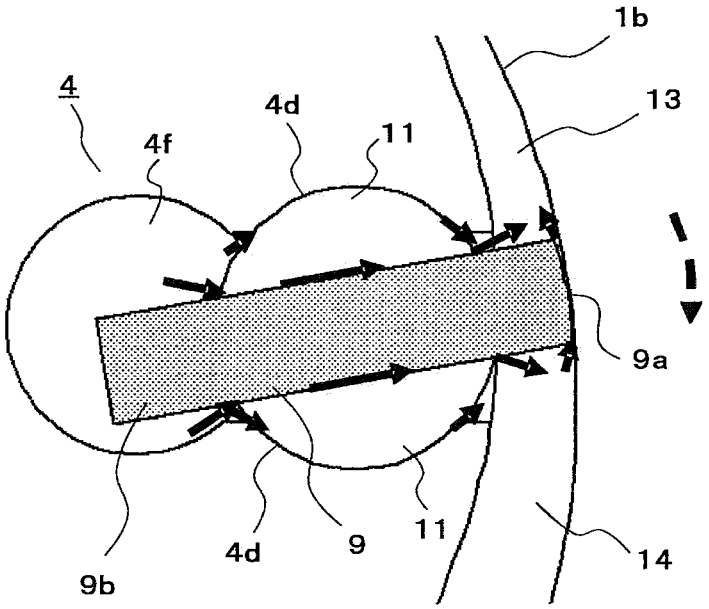
FIG. 7 is an enlarged view of a main portion of a vane and a region around the vane according to Embodiment 1 of the present invention.

FIG. 7 is an enlarged view of a main portion of the vane and a region around the vane according to Embodiment 1 of the present invention. FIG. 7 illustrates the enlarged main portion of the vane 9 and the region around the vane 9 in FIG. 4. In FIG. 7, solid arrows indicate the flows of the refrigerating machine oil 25, and a dashed arrow indicates the rotational direction.

As described above, the pressure in the vane relief portion 4*f* is the discharge pressure, and higher than the pressures in the suction chamber 13 and the middle chamber 14. Thus, the refrigerating machine oil 25 is fed to the suction chamber 13 and the middle chamber 14 by pressure differences and the centrifugal force while lubricating sliding portions, where the side surfaces of the first vane 9 and the bush 11 slide on one another. Also, the refrigerating machine oil 25 is fed to the suction chamber 13 and the middle chamber 14 by the pressure differences and the centrifugal force while lubricating a sliding portion, where the bush 11 and the bush holding portion 4*d* of the rotor shaft 4 slide on each other. The first vane 9 is pressed against the inner circumferential surface 1*b* of the cylinder 1 by the centrifugal force and the pressure differences between the vane relief portion 4*f* and the suction chamber 13 and between the vane relief portion 4*f* and the middle chamber 14. Thus, the tip end portion 9*a* of the first vane 9 slides along the inner circumferential surface 1*b* of the cylinder 1. At this time, part of the refrigerating machine oil 25 having been fed to the middle chamber 14 flows into the suction chamber 13 while lubricating the tip end portion 9*a* of the first vane 9. In so doing, the radius of the arc of the tip end portion 9*a* of the first vane 9 is substantially coincident with the radius of the inner circumferential surface 1*b* of the cylinder 1. Furthermore, the normal to the arc is substantially coincident with the normal to the inner circumferential surface 1*b*. Thus, a sufficient oil film is formed between the inner circumferential surface 1*b* and the arc of the tip end portion 9*a* of the first vanes 9, thereby hydrodynamic lubrication is achieved therebetween.

In FIG. 7, the case where the spaces separated from each other by the first vane 9 are the suction chamber 13 and the middle chamber 14 is illustrated. The operation is similarly performed in the case where the spaces separated from each other by the first vane 9 are the middle chamber 14 and the compressing chamber 15 when the rotor shaft 4 is further rotated. Furthermore, even when the pressure in the compressing chamber 15 reaches the discharge pressure that is the same as the pressure in the vane relief portion 4*f*, the refrigerating machine oil 25 is fed toward the compressing chamber 15 by the centrifugal force. The operation with the first vane 9 has been described, the operation with the second vane 10 is similarly performed.

In the above-described oil supplying operation, the refrigerating machine oil 25 having been supplied to the main bearing portion 2*c* is discharged to a space above the frame 2 through the gap in the main bearing portion 2*c*, and then returned to the oil reservoir 104 through the oil return ports 1*c* provided in the outer circumferential portion of the cylinder 1. The refrigerating machine oil 25 having been supplied to the main bearing portion 3*c* is also returned to the oil reservoir 104 through the gap in the main bearing portion 2*c*. The refrigerating machine oil 25 having been fed to the suction chamber 13, the middle chamber 14, and the compressing chamber 15 through the vane relief portions 4*f* and 4*g* is finally discharged along with the refrigerant to the space above the frame 2 through the discharge port 2*d*, and then returned to the oil reservoir 104 through the oil return ports 1*c* provided in the outer circumferential portion of the cylinder 1. The excess refrigerating machine oil 25 out of the refrigerating machine oil 25 having been fed to the oil supply channel 4*h* by the oil pump 31 is discharged to the space above the frame 2 through the oil discharge port 4*k* in an upper portion of the rotor shaft 4, and then returned to the oil reservoir 104 through the oil return ports 1*c* provided in the outer circumferential portion of the cylinder 1.

In the vane-type compressor 200 according to Embodiment 1 that has been described, the oil pump 31 is provided at the lower end portion of the rotor shaft 4 and the oil supply channels 4*h*, 4*i*, and 4*j* are provided in the rotor shaft 4. Thus, the main bearing portions 2*c* and 3*c* and the vane aligner bearing portions 2*b* and 3*b* can be reliably supplied and lubricated with the refrigerating machine oil 25. Furthermore, the end portions of the vane relief portions 4*f* and 4*g*, the end portions being at the ends in the axial direction, communicate with the recess portion 2*a* of the frame 2 and the recess portion 3*a* of the cylinder head 3. Thus, the refrigerating machine oil 25 passes through the vane relief portions 4*f* and 4*g* and is fed to the suction chamber 13 and the middle chamber 14 or fed to the middle chamber 14 and the compressing chamber 15 by the pressure differences and the centrifugal force while lubricating the sliding portions, where the side surfaces of the first vane 9 and the bush 11 slide on one another, and sliding portions, where the side surfaces of the second vane 10 and bush 12 slide on one another. Furthermore, part of the refrigerating machine oil 25 having been fed to the middle chamber 14 and the compressing chamber 15 flows into the suction chamber 13 or the middle chamber 14 while lubricating the tip end portion 9*a* of the first vane 9 and the tip end portion 10*a* of the second vane 10. Thus, the sliding portions, where the side surfaces of the vanes and the bushes slide on one another, the sliding portions, where the bushes and the bush holding portions slide on one another, and sliding portions at the vane tip end portions can be reliably supplied with and lubricated with the refrigerating machine oil 25.

This achieves a mechanism required to perform the compressing operation in such a way as follows by integrating the rotor portion 4*a* and the rotating shaft portions 4*b* and 4*c* with one another: that is, the normals to the arcs of the tip end portion 9*a* of the first vane 9 and the tip end portion 10*a* of the second vane 10 are constantly substantially coincident with the normal to the inner circumferential surface 1*b* of the cylinder 1 (a mechanism in which the first vane 9 and the second vane 10 are rotated about the center of the cylinder 1) (that is, the mechanism is achieved without end plates provided at both ends of a rotor portion of the related-art vane-type compressor). Thus, in the vane-type compressor 200 according to Embodiment 1, sliding loss in the bearings can be reduced by allowing the rotating shaft portions 4*b* and 4*c* to be supported by the main bearing portions 2*c* and 3*c* having a small diameter, and accuracy of the outer diameter of the rotor portion 4*a* and the rotational center can be improved. Accordingly, in the vane-type compressor 200 according to Embodiment 1, leakage loss can be reduced by reducing the gap between the rotor portion 4*a* and the cylinder inner circumferential surface 1*b*. Thus, the highly efficient vane-type compressor 200 can be obtained.

In the above-described vane-type compressor 200, the vane holding portions 5*a*, 6*a*, 7*a*, and 8*a* of the vane aligners 5, 6, 7, and 8 are inserted into the rear surface grooves 9*b* and 10*b* of the first vane 9 and the second vane 10, thereby regulating the directions of the first vane 9 and the second vane 10. In this method, the vane holding portions 5*a*, 6*a*, 7*a*, and 8*a* and the rear surface grooves 9*b* and 10*b* of the first vane 9 and the second vane 10 have thin portions.

As illustrated in FIG. 2, since the vane holding portions 5*a*, 6*a*, 7*a*, and 8*a* are projections having a quadrangular plate shape, the strength thereof is low.

Figure 8:
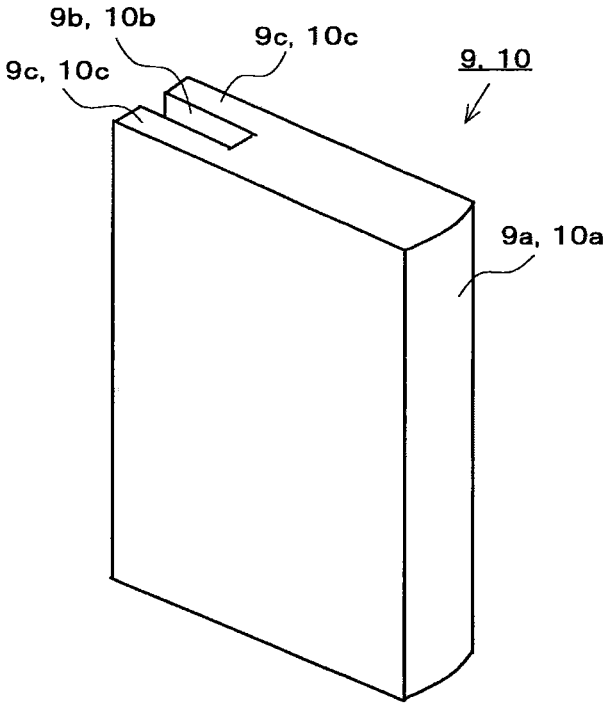
FIG. 8 is a perspective view of the vane according to Embodiment 1 of the present invention.

FIG. 8 is a perspective view of the vane according to Embodiment 1 of the present invention. As illustrated in FIG. 8, the first vane 9 and the second vane 10 have thin portions 9*c* and 10*c* on both side portions of the rear surface grooves 9*b* and 10*b*.

Thus, in order to apply the method according to Embodiment 1, it is preferable that a refrigerant that applies small forces to the first vane 9 and the second vane 10, that is, a refrigerant, the operational pressure of which is low, be used. For example, a refrigerant, the normal boiling point of which is equal to or higher than −45° C., is preferable, and with a refrigerant such as R600a (isobutane), R600 (butane), R290 (propane), R134a, R152a, R161, R407C, R1234yf, or R1234ze, the vane holding portions 5*a*, 6*a*, 7*a*, and 8*a* and the rear surface grooves 9*b* and 10*b* of the first vane 9 and the second vane 10 can be used without problems related to the strength thereof.

Here, the method of regulating the direction of the vane 10 of the vane-type compressor 200 according to Embodiment 1 is not limited to the above-described method. For example, the direction of the vane 10 may be regulated as follows.

Figure 9:
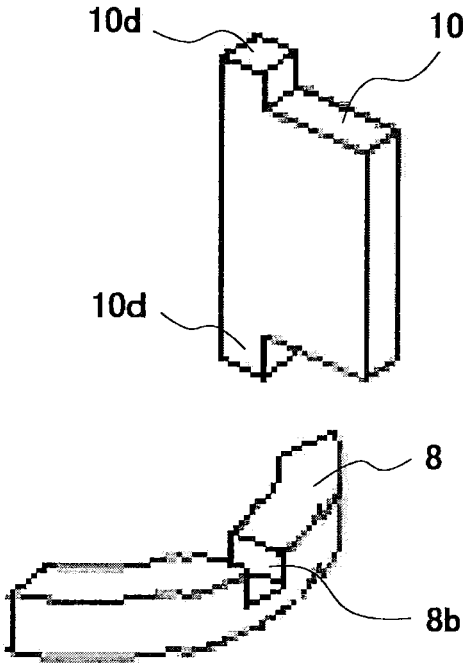
FIG. 9 is a perspective view of other examples of the vane and the vane aligner according to Embodiment 1 of the present invention.

FIG. 9 is a perspective view of other examples of the vane and the vane aligner according to Embodiment 1 of the present invention. In FIG. 9, the vane 10 and the vane aligner 8 are illustrated.

Instead of the rear surface grooves 10*b*, projecting portions 10*d* are provided in the second vane 10 illustrated in FIG. 9. Instead of the vane holding portion 8*a*, which is a plate-shaped projection, a slit-shaped vane holding groove 8*b* is provided in the vane aligner 8 illustrated in FIG. 9. Although it is not illustrated, similarly to the vane aligner 8, a slit-shaped vane holding groove 7*b* is provided instead of the vane holding portion 7*a* in the vane aligner 7. By insertion of the projecting portions 10*d*, which are provided in the end surfaces of the second vane 10, into the vane holding grooves 7*b* and 8*b*, the direction of the vane 10 is regulated such that the normal to the arc of the tip end of the second vane 10 and the normal to the inner circumferential surface 1*b* of the cylinder 1 are constantly substantially coincident with each other. The vane holding grooves 7*b* and 8*b* of the vane aligners 7 and 8 may be closed instead of being opened at respective radially inner sides so as to regulate an excessive movement of the second vane 10 toward a direction opposite to the inner circumferential surface 1*b* side of the cylinder 1. Also, the first vane 9 and the vane aligners 5 and 6 may be similarly structured. The similar effects can be obtained also with the above-described structure.

Alternatively, for example, the direction of the vane 10 may be regulated as follows.

Figure 10:
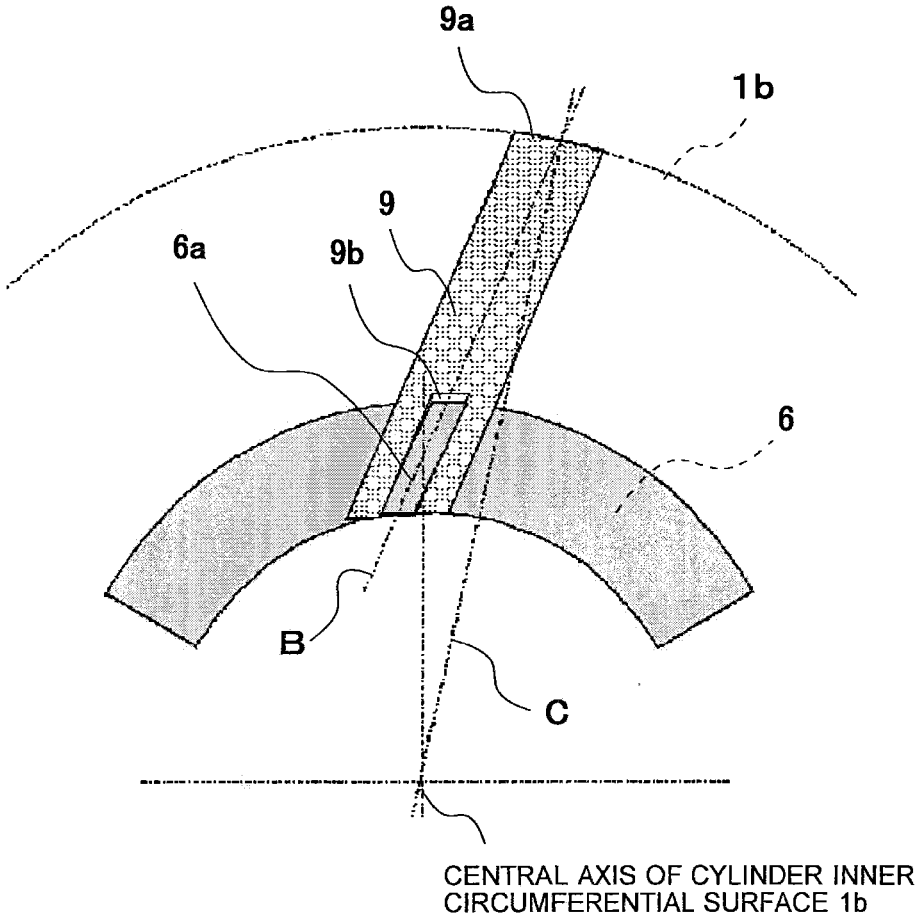
FIG. 10 is an enlarged view (sectional plan view) of a main portion of a vane and a region around the vane of another example of the compressing element according to Embodiment 1 of the present invention.

FIG. 10 is an enlarged view (sectional plan view) of a main portion of the vane and a region around the vane of another example of the compressing element according to Embodiment 1 of the present invention.

In FIG. 10, B denotes a direction in which the vane holding portion 6*a* of the vane aligner 6 is attached and a longitudinal direction of the first vane 9. Also in FIG. 10, C denotes the normal to the arc of the tip end portion 9*a* of the first vane 9. That is, the vane holding portion 6*a* of the vane aligner 6 is attached to the end surface of the ring-shaped member of the vane aligner 6, the end surface being on the vane side in the central axis direction, and inclined in a B direction. Thus, the first vane 9 is provided in the rotor portion 4*a* of the rotor shaft 4 such that the longitudinal direction of the first vane 9 is inclined relative to the normal to the inner circumferential surface 1*b* of the cylinder 1. The normal C to the arc of the tip end portion 9*a* of the first vane 9 is inclined relative to the vane longitudinal direction B and directed to the center of the inner circumferential surface 1*b* of the cylinder 1 when the vane holding portion 6*a* of the vane aligner 6 is inserted into the rear surface groove 9*b* of the first vane 9. That is, the normal C to the arc of the tip end portion 9*a* of the first vane 9 is substantially coincident with the normal to the inner circumferential surface 1*b* of the cylinder 1. The first vane 9 and the vane aligner 5 and the second vane 10 and the vane aligners 7 and 8 are structured similarly to the above-described structure.

Also in the structure illustrated in FIG. 10, the compressing operation can be performed while the normals to the arcs of the vane tip end portions (the tip end portion 9*a* of the first vane 9 and the tip end portion 10*a* of the second vane 10) are constantly coincident with the normals to the inner circumferential surface 1*b* of the cylinder 1 during the rotation. Furthermore, since the flows of the refrigerating machine oil 25 are also similar to those in the above description, the effects similar to those described above can be obtained. Furthermore, the lengths of the arcs of the vane tip end portions (the tip end portion 9*a* of the first vane 9 and the tip end portion 10*a* of the second vane 10) can be increased. Thus, a sealing length is increased, and accordingly, the leakage loss at the vane tip end portions (the tip end portion 9*a* of the first vane 9 and the tip end portion 10*a* of the second vane 10) can be further reduced.

Embodiment 2

A groove portion, for example, a groove portion as described below, may be formed in a bottom portion of each of the recess portions 2*a* and 3*a* having a bottomed cylindrical shape described in Embodiment 1. In Embodiment 2, items not specifically described are similar to those in Embodiment 1, and the same functions and structures are denoted by the same reference signs.

Figure 11:
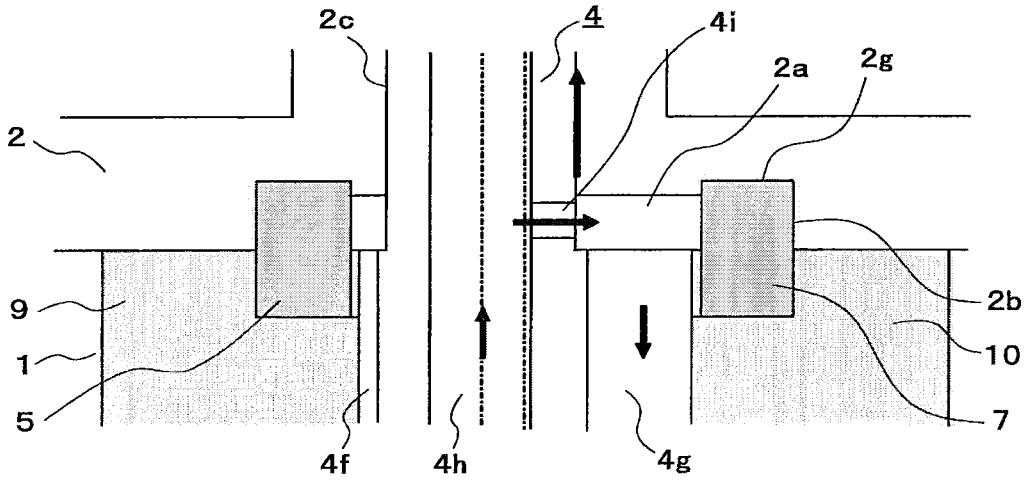
FIG. 11 is an enlarged view (longitudinal sectional view) of a main portion of a vane aligner bearing portion and a region around the vane aligner bearing portion of a vane-type compressor according to Embodiment 2 of the present invention.

FIG. 11 is an enlarged view (longitudinal sectional view) of a main portion of the vane aligner bearing portion and a region around the vane aligner bearing portion of the vane-type compressor according to Embodiment 2 of the present invention. FIG. 11 illustrates the vane aligner bearing portion 2*b* (in other words, the recess portion 2*a* of the frame 2) and the region around the vane aligner bearing portion 2*b*. Although it is not illustrated, the vane aligner bearing portion 3*b* (in other words, the recess portion 3*a* of the cylinder head 3) and a region around the vane aligner bearing portion 3*b* have the similar shapes. Arrows in FIG. 11 indicate the flows of the refrigerating machine oil 25.

In the vane-type compressor 200 according to Embodiment 2, an annular groove portion 2*g* is formed by a step provided on the outer circumferential side of the bottom portion of the recess portion 2*a* of the frame 2. The groove portion 2*g* is concentric with the inner circumferential surface 1*b* of the cylinder 1. The vane aligners 5 and 7 (more specifically, base portions 5*c* and 7*c*) are inserted into the groove portion 2*g* of the recess portion 2*a*. By insertion of the vane aligners 5 and 7 into the groove portion 2*g* of the recess portion 2*a*, movements of the vane aligners 5 and 7 in the radial directions are regulated. Thus, the vane aligners 5 and 7 can be more stably held in the recess portion 2*a* than that in Embodiment 1. When the step of the recess portion 2*a* of the frame 2 is excessively large, a height of a radially inside space of the recess portion 2*a* of the frame 2, the height of the radially inside space being in the axial direction, is reduced. This may be resistive against the refrigerating machine oil 25 being fed to the recess portion 2*a* of the frame 2 through the oil supply channel 4*i*, and accordingly, may obstruct supply of the oil. Thus, the step of the recess portion 2*a* of the frame 2, that is, the depth of the groove portion 2*g*, is preferably formed to have an appropriate degree of size so as not to obstruct the supply of the oil.

In the vane-type compressor 200 according to Embodiment 2 that has been described, the flows of the refrigerating machine oil 25 is similar to those in Embodiment 1 and the effects similar to those obtained in Embodiment 1 can be obtained. Furthermore, in the vane-type compressor 200 according to Embodiment 2, the vane aligners 5 and 7 can be more stably held in the recess portion 2*a* of the frame 2 and the vane aligners 6 and 8 can be more stably held in the recess portion 3*a* of the cylinder head 3 that those the vane-type compressor 200 described in Embodiment 1.

Embodiment 3

In Embodiments 1 and 2, the first vane 9 and the vane aligners 5 and 6 are separately formed, and the second vane 10 and the vane aligners 7 and 8 are separately formed. However, this does not limit the structures of these components. At least one of the vane aligners 5 and 6 may be integrated with the first vane 9. Likewise, at least one of the vane aligners 7 and 8 may be integrated with the second vane 10. In Embodiment 3, items not specifically described are similar to those in Embodiments 1 and 2, and the same functions and structures are denoted by the same reference signs.

Figure 12:
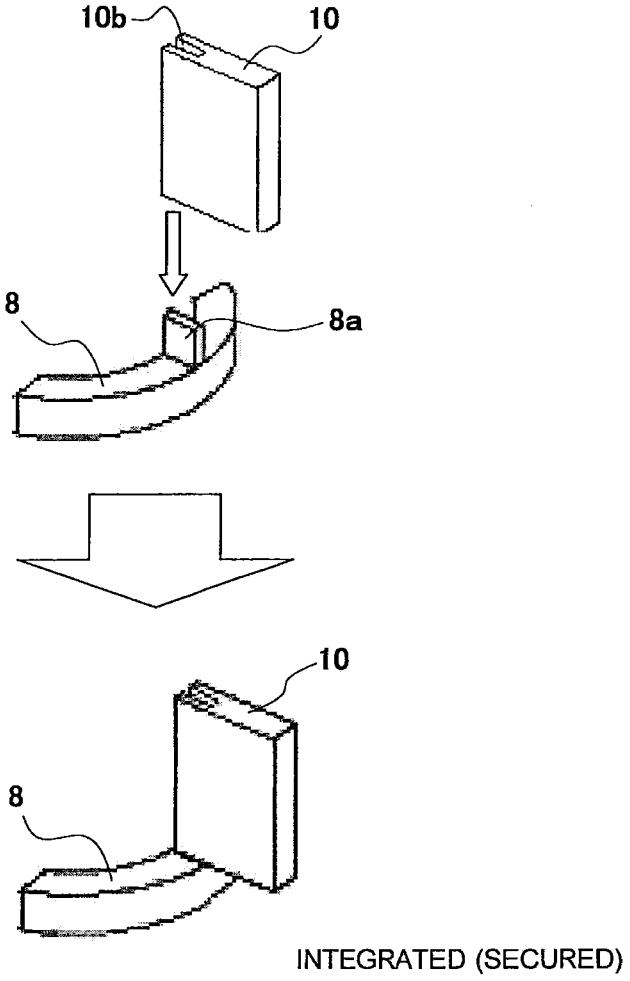
FIG. 12 is a perspective view of a vane and a vane aligner of a vane-type compressor according to Embodiment 3 of the present invention.

FIG. 12 is a perspective view of the vane and the vane aligner of the vane-type compressor according to Embodiment 3 of the present invention. In FIG. 12, as examples of the vane and the vane aligner integrated with each other, a second vane 20 and the vane aligner 8, which are integrated with each other, are illustrated.

As can be understood from Embodiment 1, the relative positional relationships between the rear surface grooves 9*b* of the first vane 9 and the vane holding portions 5*a* and 6*a* of the vane aligners 5 and 6 are not changed in the operation of the vane-type compressor 200 (sealed type). Likewise, the relative positional relationships between the rear surface grooves 10*b* of the second vane 10 and the vane holding portions 7*a* and 8*a* of the vane aligners 7 and 8 are not changed in the operation of the vane-type compressor 200 (sealed type). Thus, these (the first vane 9 and the vane aligners 5 and 6; and the second vane 10 and the vane aligners 7 and 8) can be integrated with one another. In Embodiment 3, the second vane 10 and the vane aligner 8 having been separately formed are integrated with each other by insertion of the vane holding portion 8*a* of the vane aligner 8 into the rear surface grooves 10*b* of the second vane 10 and then securing the vane aligner 8 and the second vane 10 to each other.

In Embodiment 3, the second vane 10 and the vane aligner 8 are integrated with each other. The vane aligner 7 may also be similarly integrated with the second vane 10 or remain separated from the second vane 10. That is, the second vane 10 and at least one of the vane aligners 7 and 8 are integrated with each other. This is also applicable to the first vane 9. The first vane 9 may be integrated with at least one of the vane aligners 5 and 6.

Next, operation of the compressing element 101 of the vane-type compressor 200 according to Embodiment 3 is described. Although the operation performed by the compressing element 101 according to Embodiment 3 is generally similar to that of the compressing element 101 described in Embodiment 1, the following point is different from that performed by the compressing element 101 in Embodiment 1. That is, since at least one of the vane aligners 5 and 6 and the first vane 9 are integrated with each other and at least one of the vane aligners 7 and 8 and the second vane 10 are integrated with each other, movements of the first vane 9 and the second vane 10 in the substantially centrifugal direction of the rotor portion 4*a* are fixed. Thus, the tip end portion 9*a* of the first vane 9 and the tip end portion 10*a* of the second vane 10 do not slide on the inner circumferential surface 1*b* of the cylinder 1 and are rotated while the tip end portion 9*a* of the first vane 9 and the tip end portion 10*a* of the second vane 10 are not in contact with the inner circumferential surface 1*b* of the cylinder 1 (that is, while maintaining small gaps therebetween).

Also in Embodiment 3, the flows of the refrigerating machine oil 25 are substantially the same as those in Embodiment 1 (see FIGS. 1 and 7). However, since the tip end portion 9*a* of the first vane 9 and the tip end portion 10*a* of the second vane 10 are not in contact with the inner circumferential surface 1*b* of the cylinder 1, the sliding loss of the vane tip end portions (the tip end portion 9*a* of the first vane 9 and the tip end portion 10*a* of the second vane 10) do not occur. Instead, the refrigerant leaks from the high-pressure side to the low-pressure side (for example, from the middle chamber 14 to the suction chamber 13 in FIG. 7) through the gap between the tip end portion 9*a* of the first vane 9 and the inner circumferential surface 1*b* of the cylinder 1 and the gap between the tip end portion 10*a* of the second vane 10 and the inner circumferential surface 1*b* of the cylinder 1. Thus, the leakage loss occurs. However, the leakage loss can be reduced to the minimum because the refrigerating machine oil 25 having been fed to the chambers on the high-pressure side through the vane relief portions 4*f* and 4*g* reliably seals the gap between the tip end portion 9*a* of the first vane 9 and the inner circumferential surface 1*b* of the cylinder 1 and the gap between the tip end portion 10*a* of the second vane 10 and the inner circumferential surface 1*b* of the cylinder 1. Thus, with the structure as described in Embodiment 3, there is an advantage in that the vane-type compressor 200, in which the sliding loss is reduced and the loss is generally reduced compared to that in Embodiment 1, can be provided.

The structure in which the vane and the vane aligner are integrated with each other is not limited to the structure illustrated in FIG. 12. For example, a structure as illustrated in FIG. 13 may be used to integrate the vane and the vane aligner with each other.

Figure 13:
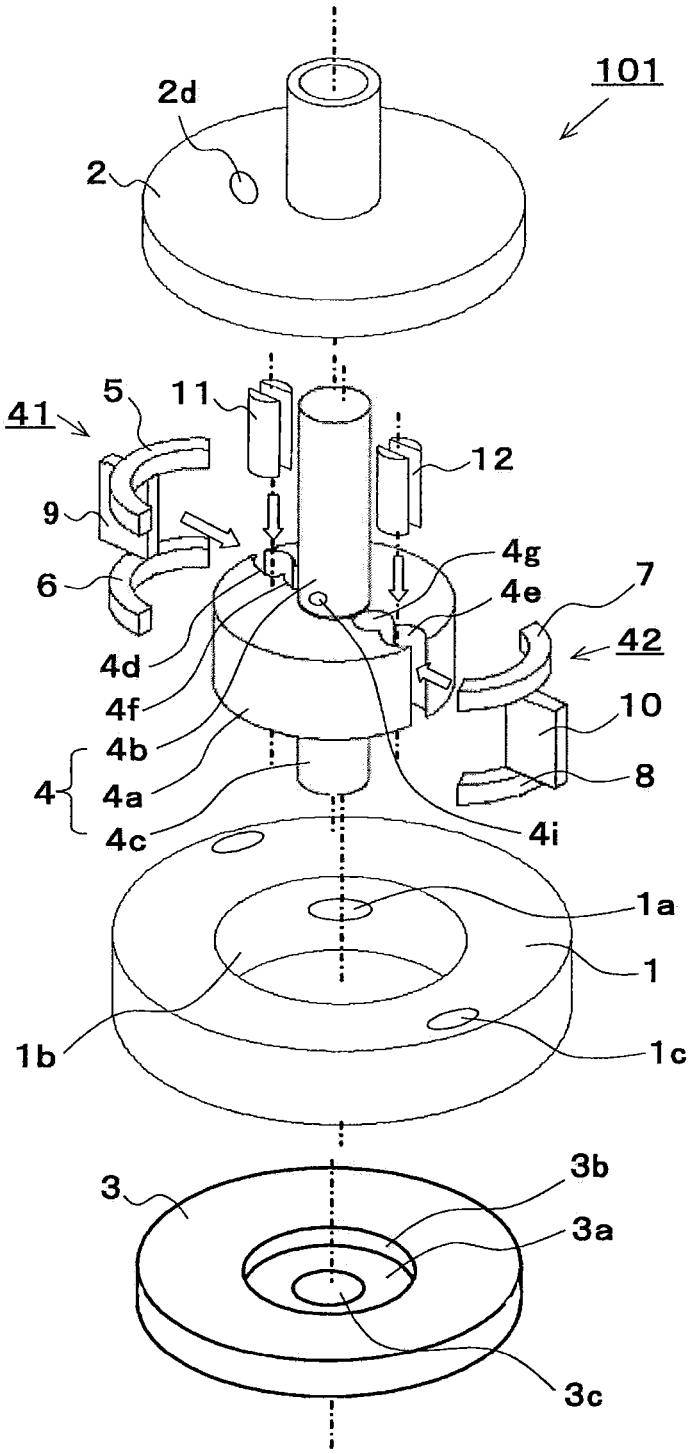
FIG. 13 is an exploded perspective view of a compressing element of another example of the vane-type compressor according to Embodiment 3 of the present invention.

FIG. 13 is an exploded perspective view of the compressing element of another example of the vane-type compressor according to Embodiment 3 of the present invention.

In the compressing element 101 of the vane-type compressor 200 illustrated in FIG. 13, the vane and the vane aligner are not separately formed components but integrated into a component. Specifically, 41 denotes a first integral vane, which is a component into which the first vane 9 and the vane aligners 5 and 6 are integrated. Also, 42 denotes a second integral vane, which is a component into which the second vane 10 and the vane aligners 7 and 8 are integrated. The vane-type compressor 200 having a structure as illustrated in FIG. 13 also operates similarly to the vane-type compressor 200 illustrated in FIG. 12, and the effect similar to that obtained with the vane-type compressor 200 illustrated in FIG. 12 can be obtained.

Although it is not illustrated in Embodiment 3, the following structure, which is similar to the structure illustrated in FIG. 10 in Embodiment 1, may be used: that is, the normals to the arcs of the vane tip end portions (the tip end portion 9*a* of the first vane 9 and the tip end portion 10*a* of the second vane 10) are substantially coincident with the normal to the inner circumferential surface 1*b* of the cylinder 1, and the longitudinal directions of the vanes are inclined relative to the directions normal to the inner circumferential surface 1*b* by a certain angle. In this structure, the lengths of the arcs of the vane tip end portions (the tip end portion 9*a* of the first vane 9 and the tip end portion 10*a* of the second vane 10) can be increased. Thus, the sealing length is increased, and accordingly, the leakage loss at the vane tip end portions (the tip end portion 9*a* of the first vane 9 and the tip end portion 10*a* of the second vane 10) can be further reduced.

Of course, it is also possible that the steps as described in Embodiment 2 are provided in the recess portions 2*a* and 3*a* of the vane-type compressor 200 according to Embodiment 3 so as to hold the vane aligners 5, 6, 7, and 8 in the grooves.

Embodiment 4

The vane-type compressor 200, in which the loss is further reduced, can be obtained by providing the following oil supply channel in the vane-type compressor 200 described in Embodiments 1 to 3. In Embodiment 4, items not specifically described are similar to those in Embodiments 1 to 3, and the same functions and structures are denoted by the same reference signs.

Figure 14:
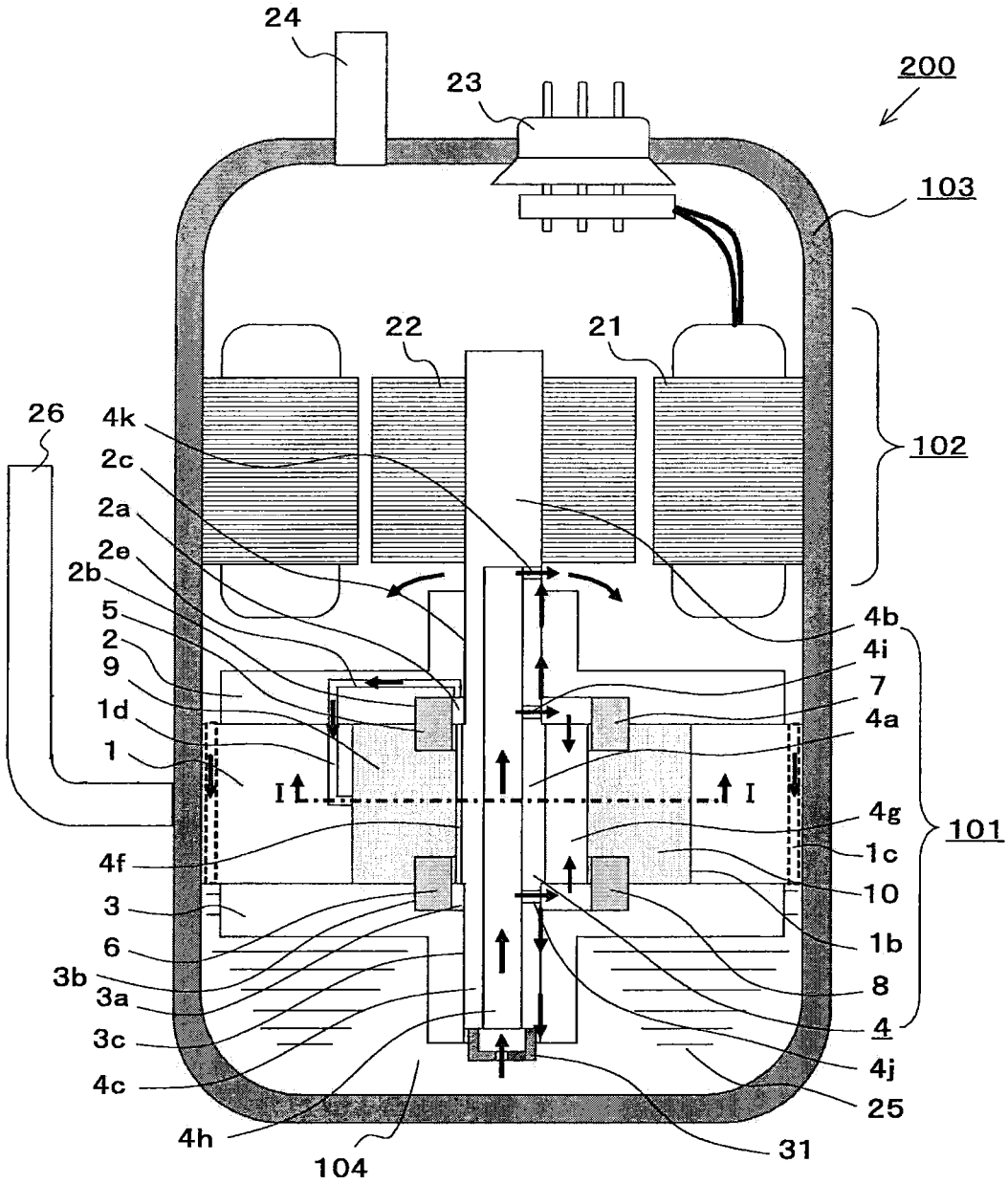
FIG. 14 is a longitudinal sectional view of a vane-type compressor according to Embodiment 4 of the present invention.
Figure 15:
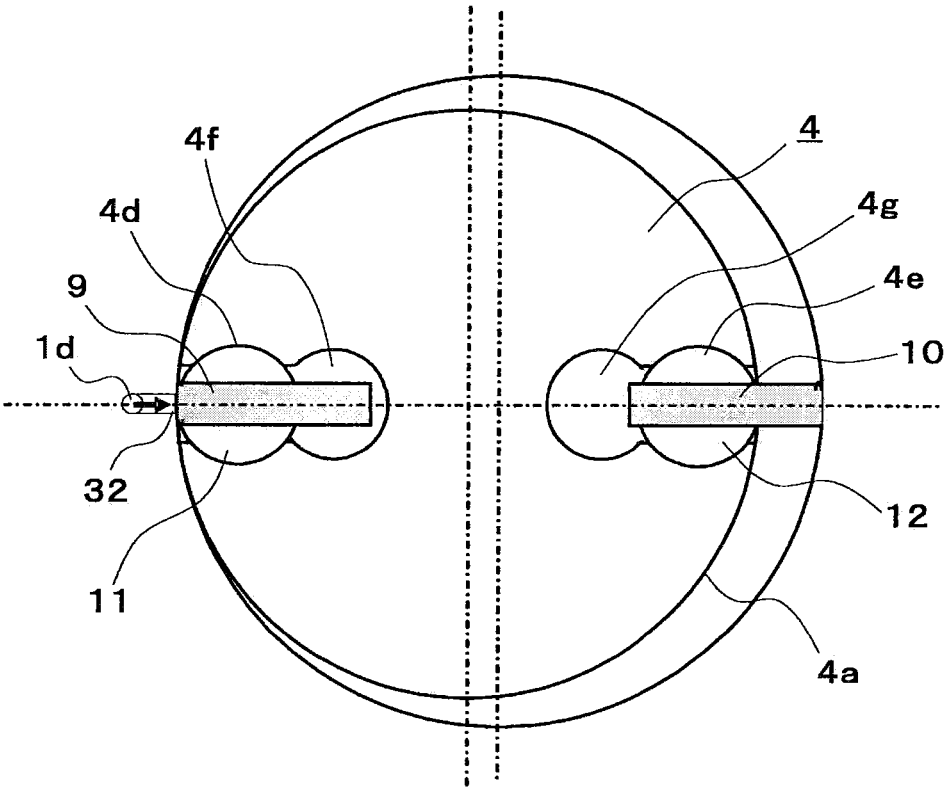
FIG. 15 is a sectional view of a compressing element of the vane-type compressor according to Embodiment 4 of the present invention taken along line I-I in FIG. 14.

FIG. 14 is a longitudinal sectional view of the vane-type compressor according to Embodiment 4 of the present invention. FIG. 15 is a sectional view of the compressing element of the vane-type compressor taken along line I-I in FIG. 14. Arrows in FIGS. 14 and 15 indicate the flows of the refrigerating machine oil 25.

In addition to the structure of the vane-type compressor 200 described in Embodiment 1, the vane-type compressor 200 according to Embodiment 4 has an oil supply channel that allows communication between the recess portion 2*a* of the frame 2 and the closest point 32 of the cylinder 1. This oil supply channel includes an oil supply channel 2*e* and an oil supply channel 1*d*. The oil supply channel 2*e* is formed in the frame 2. One of end portions of the oil supply channel 2*e* is open at the recess portion 2*a* of the frame 2, and the other end portion of the oil supply channel 2*e* is open at the cylinder 1-side end surface of the frame 2 so as to communicate with the oil supply channel 1*d*. The oil supply channel 1*d* is formed in the cylinder 1. One of end portions of the oil supply channel 1*d* is open at a frame 2-side end surface of the cylinder 1 so as to communicate with the oil supply channel 2*e*, and the other end portion of the oil supply channel 1*d* is open at the closest point 32.

Since the pressure in the recess portion 2*a* of the frame 2 is the discharge pressure, which is a high pressure, part of the refrigerating machine oil 25 having been supplied to the recess portion 2*a* of the frame 2 is supplied to the closest point 32 through the oil supply channel 2*e* and the oil supply channel 1*d*. Thus, the gap between the rotor portion 4*a* of the rotor shaft 4 and the inner circumferential surface 1*b* of the cylinder 1 is sealed by the refrigerating machine oil 25, and accordingly, leakage of the refrigerant from the high-pressure side to the low-pressure side (for example, from the compressing chamber 15 to the suction chamber 13 in FIG. 4) can be reduced.

In Embodiment 4 having been described, in addition to the effects obtained in Embodiment 1, an effect, in which the leakage loss occurring in the gap between the rotor portion 4*a* of the rotor shaft 4 and the inner circumferential surface 1*b* of the cylinder 1 can also be reduced, is obtained. Thus, there is an advantage in that the vane-type compressor 200, in which the loss is reduced more than that in Embodiment 1, can be provided.

Also in the vane-type compressor 200 according to Embodiment 4, the steps as described in Embodiment 2 may be provided so as to hold the vane aligners 5, 6, 7, and 8 in the grooves, or, similarly to Embodiment 3, the vane and the vane aligner are integrated with each other similarly to Embodiment 3. With such a structure, the vane-type compressor 200, in which the loss is reduced more than that in the vane-type compressor 200 described in Embodiments 2 and 3, can be provided.

In Embodiment 4, the oil supply channel, which allows communication between the recess portion 2*a* of the frame 2 and the closest point 32 of the cylinder 1, is provided. However, an oil supply channel corresponding to the oil supply channel 2*e* may be formed in the cylinder head 3 so as to provide an oil supply channel that allows communication between the recess portion 3*a* of the cylinder head 3 and the closest point 32 of the cylinder 1. Alternatively, an oil supply channel, which allows communication between the closest point 32 of the cylinder 1 and the recess portion 2*a* of the frame 2 and communication between the closest point 32 of the cylinder 1 and the recess portion 3*a* of the cylinder head 3, may be provided. Although the oil supply channel 1*d* is open at a single position, that is, at the closest point 32 in Embodiment 4, the oil supply channel 1*d* may be open at a plurality of positions.

Embodiment 5

The vane-type compressor 200, in which the loss is further reduced, can be obtained also by providing the following oil supply channel in the vane-type compressor 200 described in Embodiments 1 to 4. In Embodiment 5, items not specifically described are similar to those in Embodiments 1 to 4, and the same functions and structures are denoted by the same reference signs.

Figure 16:
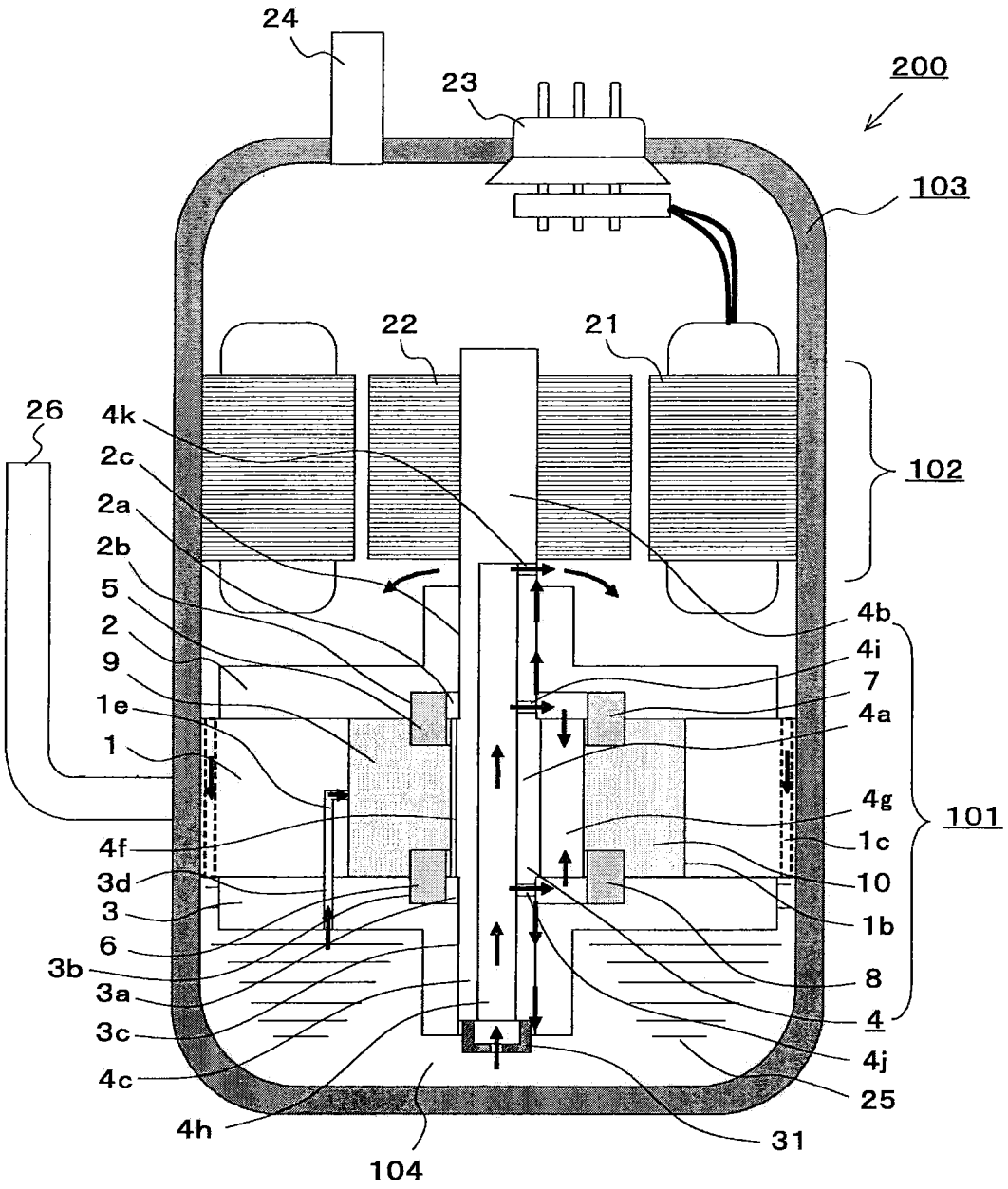
FIG. 16 is a longitudinal sectional view of a vane-type compressor according to Embodiment 5 of the present invention.

FIG. 16 is a longitudinal sectional view of the vane-type compressor according to Embodiment 5 of the present invention. Arrows in FIG. 16 indicate the flows of the refrigerating machine oil 25.

In addition to the structure of the vane-type compressor 200 described in Embodiment 1, the vane-type compressor 200 according to Embodiment 5 has an oil supply channel that allows communication between the oil reservoir 104 and the closest point 32 of the cylinder 1. This oil supply channel includes an oil supply channel 3*d* and an oil supply channel 1*e*. The oil supply channel 3*d* is formed in the cylinder head 3. One of end portions of the oil supply channel 3*d* is open at an oil reservoir 104-side end surface of the cylinder head 3, the oil reservoir 104-side end surface being in the oil reservoir 104, and the other end portion of the oil supply channel 3*d* is open at a cylinder 1-side end surface of the cylinder head 3 so as to communicate with the oil supply channel 1*d*. The oil supply channel 1*e* is formed in the cylinder 1. One of end portions of the oil supply channel 1*e* is open at a cylinder head 3-side end surface of the cylinder 1 so as to communicate with the oil supply channel 3*d*, and the other end portion of the oil supply channel 1*d* is open at the closest point 32.

Since the pressure in the oil reservoir 104 is the discharge pressure, which is a high pressure, part of the refrigerating machine oil 25 in the oil reservoir 104 is supplied to the closest point 32 through the oil supply channel 3*d* and the oil supply channel 1*e*. Thus, the gap between the rotor portion 4*a* of the rotor shaft 4 and the inner circumferential surface 1*b* of the cylinder 1 is sealed by the refrigerating machine oil 25, and accordingly, the leakage of the refrigerant from the high-pressure side to the low-pressure side (for example, from the compressing chamber 15 to the suction chamber 13 in FIG. 4) can be reduced.

In Embodiment 5 having been described, in addition to the effects obtained in Embodiment 1, an effect, in which the leakage loss occurring in the gap between the rotor portion 4*a* of the rotor shaft 4 and the inner circumferential surface 1*b* of the cylinder 1 can also be reduced, is obtained. Thus, there is an advantage in that the vane-type compressor 200, in which the loss is reduced more than that in Embodiment 1, can be provided similarly to Embodiment 4.

By forming the oil supply channel described in Embodiment 5 in the vane-type compressor 200 described in Embodiments 2 to 4, the vane-type compressor 200, in which the loss is reduced more than that in the vane-type compressor 200 described in Embodiments 2 to 4, can be provided.

Embodiment 6

The vane-type compressor 200, in which the loss is further reduced, can be obtained also by providing the following oil supply channel in the vane-type compressor 200 described in Embodiments 1 to 5. In Embodiment 6, items not specifically described are similar to those in Embodiments 1 to 5, and the same functions and structures are denoted by the same reference signs.

Figure 17:
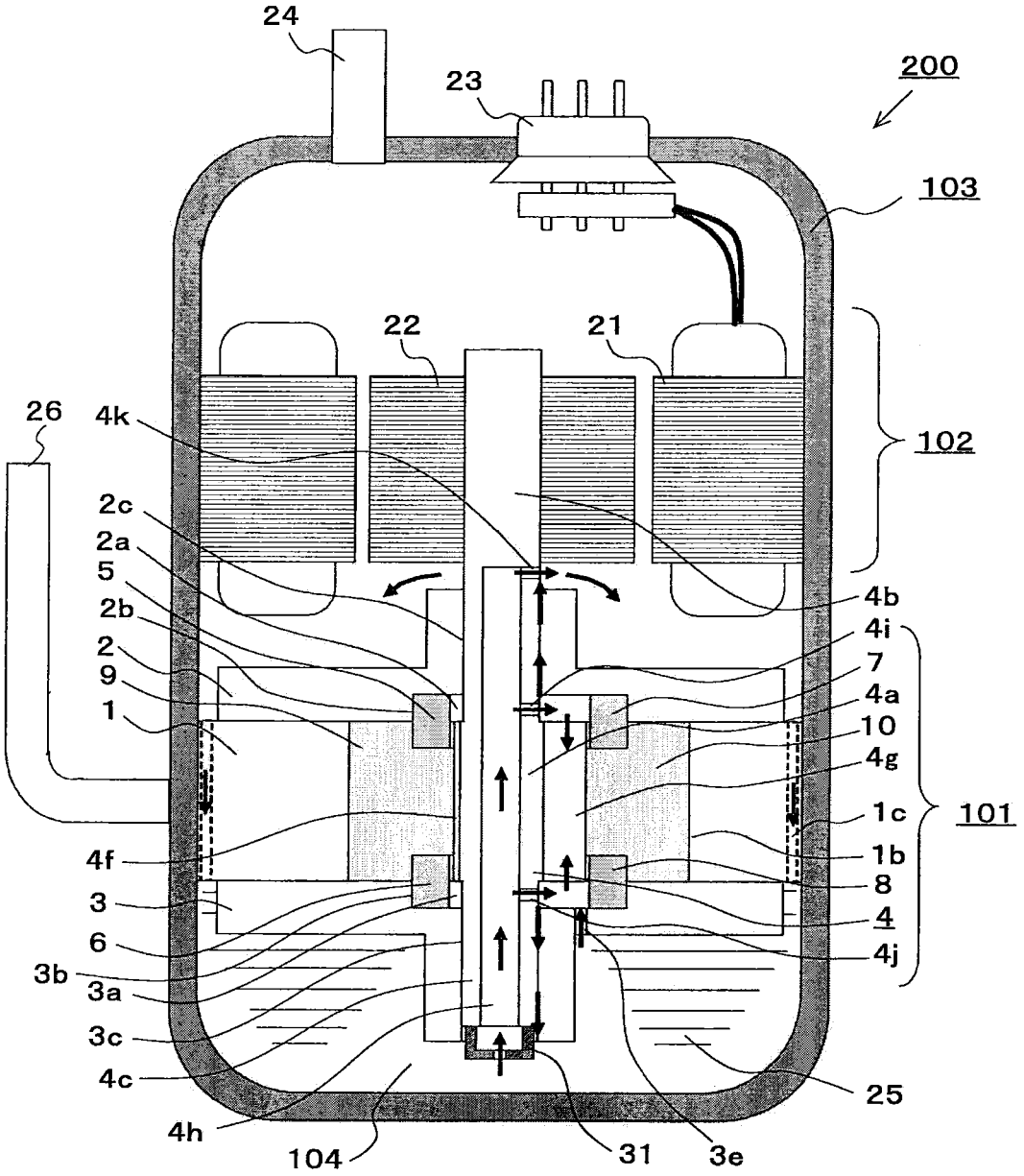
FIG. 17 is a longitudinal sectional view of a vane-type compressor according to Embodiment 6 of the present invention.

FIG. 17 is a longitudinal sectional view of the vane-type compressor according to Embodiment 6 of the present invention. Arrows in FIG. 17 indicate the flows of the refrigerating machine oil 25.

In addition to the structure of the vane-type compressor 200 described in Embodiment 1, the vane-type compressor 200 according to Embodiment 6 has an oil supply channel 3*e* provided in the cylinder head 3. The oil supply channel 3*e* allows communication between the oil reservoir 104 and the recess portion 3*a* of the cylinder head 3.

As mentioned before, the pressures in the vane relief portions 4*f* and 4*g* are the discharge pressure, which is a high pressure. Thus, the refrigerating machine oil 25 in the vane relief portions 4*f* and 4*g* are supplied to the suction chamber 13 and the middle chamber 14 by the pressure differences and the centrifugal force. At this time, since the vane-type compressor 200 according to Embodiment 6 has the oil supply channel 3*e* in addition to the oil supply channels described in Embodiment 1, the refrigerating machine oil 25 in the oil reservoir 104 is supplied to the recess portion 3*a* of the cylinder head 3 also through the oil supply channel 3*e*, and supplied to the suction chamber 13 and the middle chamber 14 through the vane relief portions 4*f* and 4*g*.

Accordingly, in Embodiment 6, in addition to the effects described in Embodiment 1, the amount of the refrigerating machine oil 25 supplied to the recess portion 3*a* of the cylinder head 3 is increased. Thus, there is an advantage in that the vane-type compressor 200, in which the loss is reduced more than that in Embodiment 1, can be provided.

By forming the oil supply channel 3*e* described in Embodiment 6 in the vane-type compressor 200 described in Embodiments 2 to 5, the vane-type compressor 200, in which the loss is reduced more than that in the vane-type compressor 200 described in Embodiments 2 to 5, can be provided.

Embodiment 7

The vane-type compressor 200, in which the loss is further reduced, can be obtained also by providing the following oil supply channel (through hole) in the vane-type compressor 200 described in Embodiments 1 to 6. In Embodiment 7, items not specifically described are similar to those in Embodiments 1 to 6, and the same functions and structures are denoted by the same reference signs.

Figure 18:
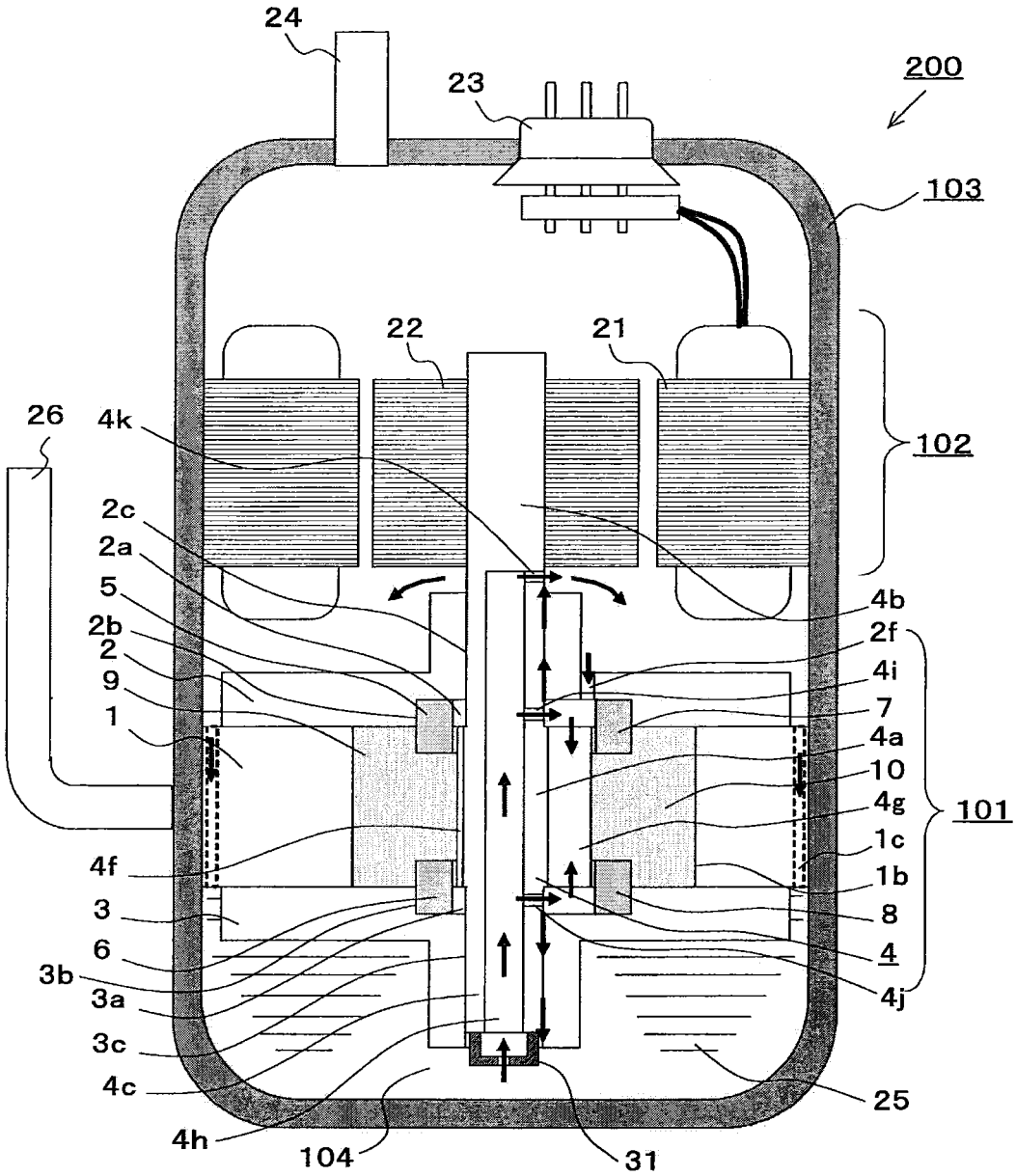
FIG. 18 is a longitudinal sectional view of a vane-type compressor according to Embodiment 7 of the present invention.

FIG. 18 is a longitudinal sectional view of the vane-type compressor according to Embodiment 7 of the present invention. Arrows in FIG. 18 indicate the flows of the refrigerating machine oil 25.

In addition to the structure of the vane-type compressor 200 described in Embodiment 1, the vane-type compressor 200 according to Embodiment 7 has a through hole 2*f* formed in the frame 2. The through hole 2*f* allows communication between the recess portion 2*a* of the frame 2 and the space above the frame 2. In this structure, part of the refrigerating machine oil 25 discharged into the space above the frame 2 through the main bearing portion 2*c* and part of the refrigerating machine oil 25 discharged into the space above the frame 2 through the oil discharge port 4*k* provided in the rotor shaft 4 is returned to the recess portion 2*a* of the frame 2 through the through hole 2*f*.

Accordingly, in Embodiment 7, in addition to the effects described in Embodiment 1, the amount of the refrigerating machine oil 25 supplied to the recess portion 2*a* of the frame 2 is increased. Thus, there is an advantage in that the vane-type compressor 200, in which the loss is reduced more than that in Embodiment 1, can be provided.

By forming the through hole 2*f* described in Embodiment 7 in the vane-type compressor 200 described in Embodiments 2 to 6, the vane-type compressor 200, in which the loss is reduced more than that in the vane-type compressor 200 described in Embodiments 2 to 6, can be provided. In particular, by forming the through hole 2*f* in the vane-type compressor 200 described in Embodiment 6, the amount of oil supplied to both the recess portion 2*a* of the frame 2 and the recess portion 3*a* of the cylinder head 3 can be increased. Thus, the loss reduction effect is further increased.

Here, with an oil retainer that communicates with an upper end of the through hole 2*f* and that has a recessed shape that opens at the top, the vane-type compressor 200, in which the loss is further reduced, can be obtained.

Figure 19:
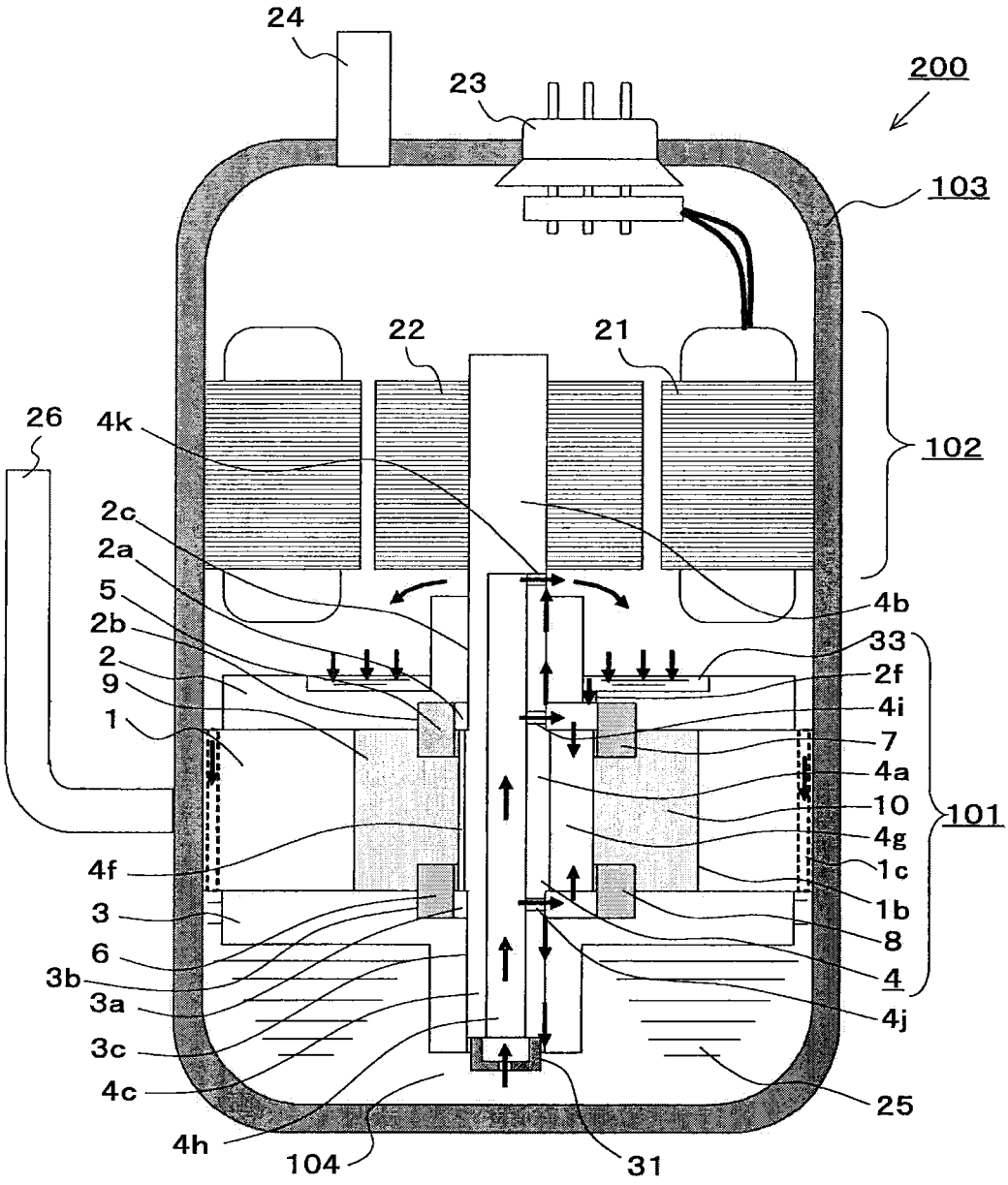
FIG. 19 is a longitudinal sectional view of another example of the vane-type compressor according to Embodiment 7 of the present invention.
Figure 20:
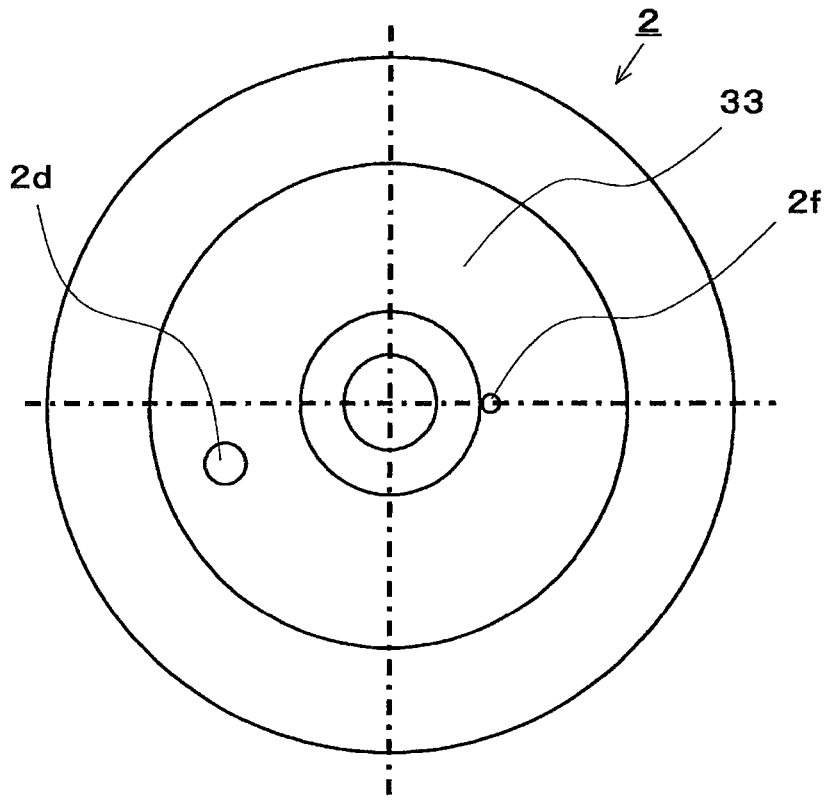
FIG. 20 is a plan view of a frame of the other example of the vane-type compressor according to Embodiment 7 of the present invention.

FIG. 19 is a longitudinal sectional view of another example of the vane-type compressor according to Embodiment 7 of the present invention. FIG. 20 is a plan view of the frame of the vane-type compressor. Arrows in FIG. 19 indicate the flows of the refrigerating machine oil 25.

In the vane-type compressor 200 illustrated in FIGS. 19 and 20, an oil retainer 33 is provided in the frame 2. The oil retainer 33 communicates with the upper end of the through hole 2*f* and has a recessed shape that opens at the top. In this structure, part of the refrigerating machine oil 25 discharged into the space above the frame 2 through the main bearing portion 2*c* and the refrigerating machine oil 25 discharged into the space above the frame 2 through the oil discharge port 4*k* provided in the rotor shaft 4 is easily accumulated in the oil retainer 33. Thus, the amount of oil returned to the recess portion 2*a* of the frame 2 through the through hole 2*f* is increased compared to that in the structure illustrated in FIG. 18. Accordingly, in the vane-type compressor 200 illustrated in FIGS. 19 and 20, there is an advantage in which the loss can be reduced more than that in the vane-type compressor 200 illustrated in FIG. 18.

Although a single through hole 2*f* is provided in the examples illustrated in FIGS. 18 to 20, a plurality of through holes 2*f* may be provided.

Embodiment 8

The vane-type compressor 200, in which the loss is further reduced, can be obtained by providing the following oil supply channel in the vane-type compressor 200 described in Embodiments 1 to 7. In Embodiment 8, items not specifically described are similar to those in Embodiments 1 to 7, and the same functions and structures are denoted by the same reference signs.

Figure 21:
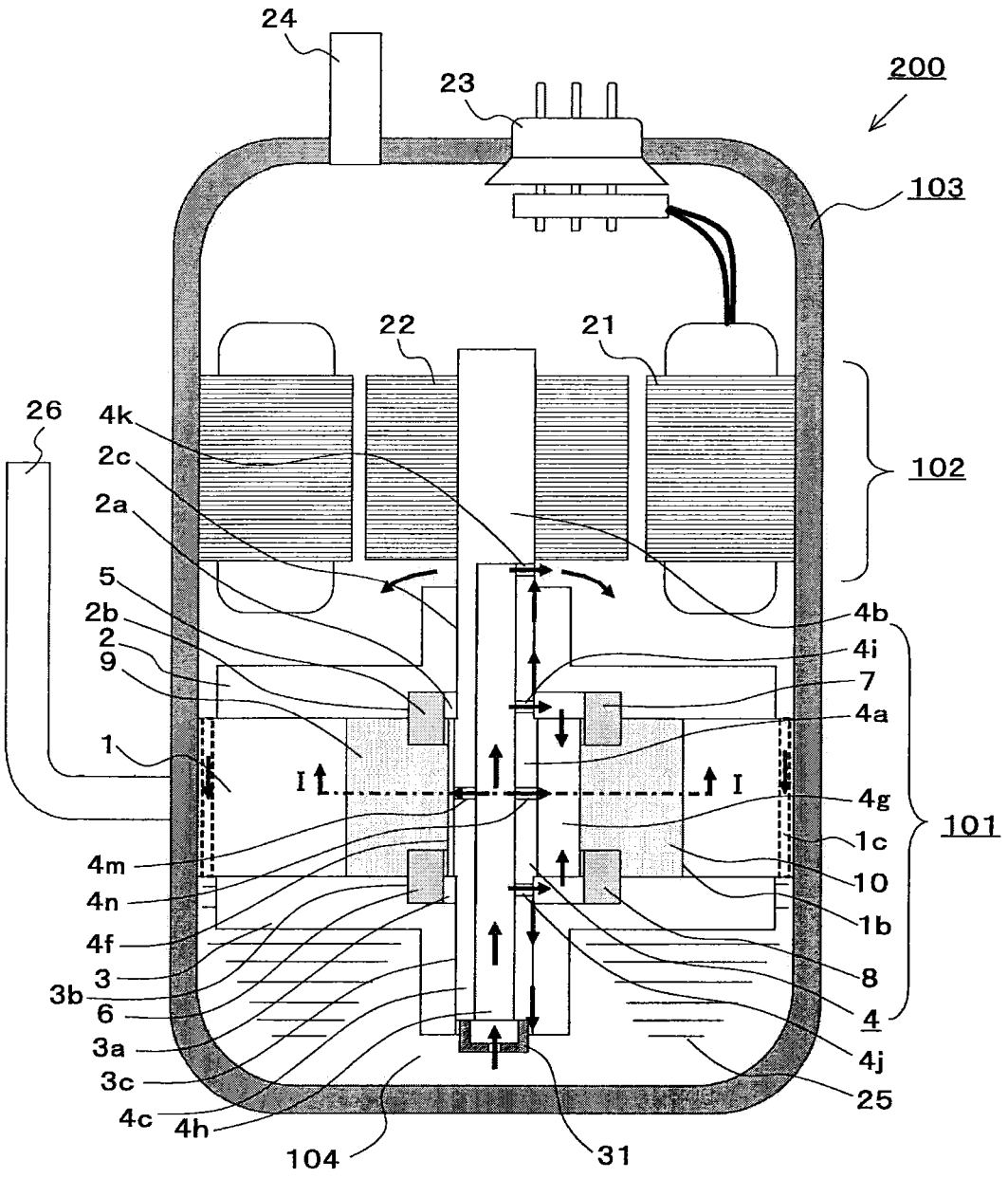
FIG. 21 is a longitudinal sectional view of a vane-type compressor according to Embodiment 8 of the present invention.
Figure 22:
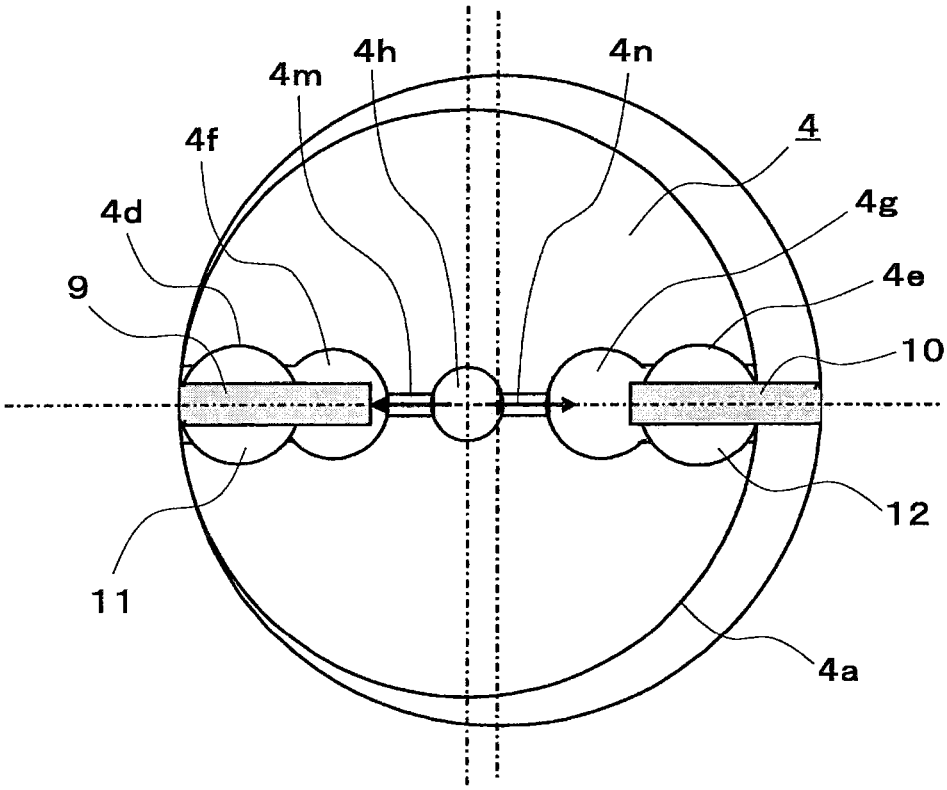
FIG. 22 is a sectional view of a compressing element of the vane-type compressor according to Embodiment 8 of the present invention taken along line I-I in FIG. 21.

FIG. 21 is a longitudinal sectional view of the vane-type compressor according to Embodiment 8 of the present invention. FIG. 22 is a sectional view of the compressing element of the vane-type compressor taken along line I-I in FIG. 21. Arrows in FIGS. 21 and 22 indicate the flows of the refrigerating machine oil 25.

In addition to the structure of the vane-type compressor 200 described in Embodiment 1, the vane-type compressor 200 according to Embodiment 8 has oil supply channels 4*m* and 4*n* that allow communication between the oil supply channel 4*h* in the rotor shaft 4 and the vane relief portions 4*f* and 4*g*. The oil supply channel 4*m* allows communication between the oil supply channel 4*h* in the rotor shaft 4 and the vane relief portion 4*f*. The oil supply channel 4*n* allows communication between the oil supply channel 4*h* in the rotor shaft 4 and the vane relief portion 4*g*. In this structure, the amount of oil supplied to the vane relief portions 4*f* and 4*g* is increased compared to that in Embodiment 1. Thus, lubrication is more preferably performed between the side surfaces of the vanes and the bushes, between the bushes and the bush holding portions, and the sliding portions of the vane tip end portions.

Although a single oil supply channel 4*m* and a single oil supply channel 4*n* are provided in Embodiment 8, a plurality of oil supply channels 4*m* and a plurality of oil supply channels 4*n* may be provided. The amount of oil supplied to the vane relief portions 4*f* and 4*g* is increased with the oil supply channels 4*m* and 4*n* in the vane-type compressor 200 described in Embodiments 2 to 7. Thus, lubrication between the side surfaces of the vanes and the bushes, between the bushes and the bush holding portions, and the sliding portions of the vane tip end portions is more preferably performed than that in the vane-type compressor 200 described in Embodiments 2 to 7 (sealing at the vane tip end portions is more preferably provided in the case of Embodiment 3).

Furthermore, when the oil supply channels 4*m* and 4*n* described in Embodiment 8 are provided, the refrigerating machine oil 25 in the oil reservoir 104 can be supplied to the vane relief portions 4*f* and 4*g* through the oil supply channels 4*m* and 4*n*. Thus, the oil can be supplied similarly to Embodiments 1 to 7 without communication between the end surfaces of the vane relief portions 4*f* and 4*g* and the recess portion 2*a* of the frame 2 and between the end surfaces of the vane relief portions 4*f* and 4*g* and the recess portion 3*a* of the cylinder head 3.

Embodiment 9

In the vane-type compressor 200 described in Embodiments 1 to 8, an oil supply channel that allows communication between the recess portion 2*a* and the vane aligner bearing portion 2*b* of the frame 2 and an oil supply channel that allows communication between the recess portion 3*a* and the vane aligner bearing portion 3*b* of the cylinder head 3 may be formed as follows. In Embodiment 9, items not specifically described are similar to those in Embodiments 1 to 8, and the same functions and structures are denoted by the same reference signs.

Figure 23:
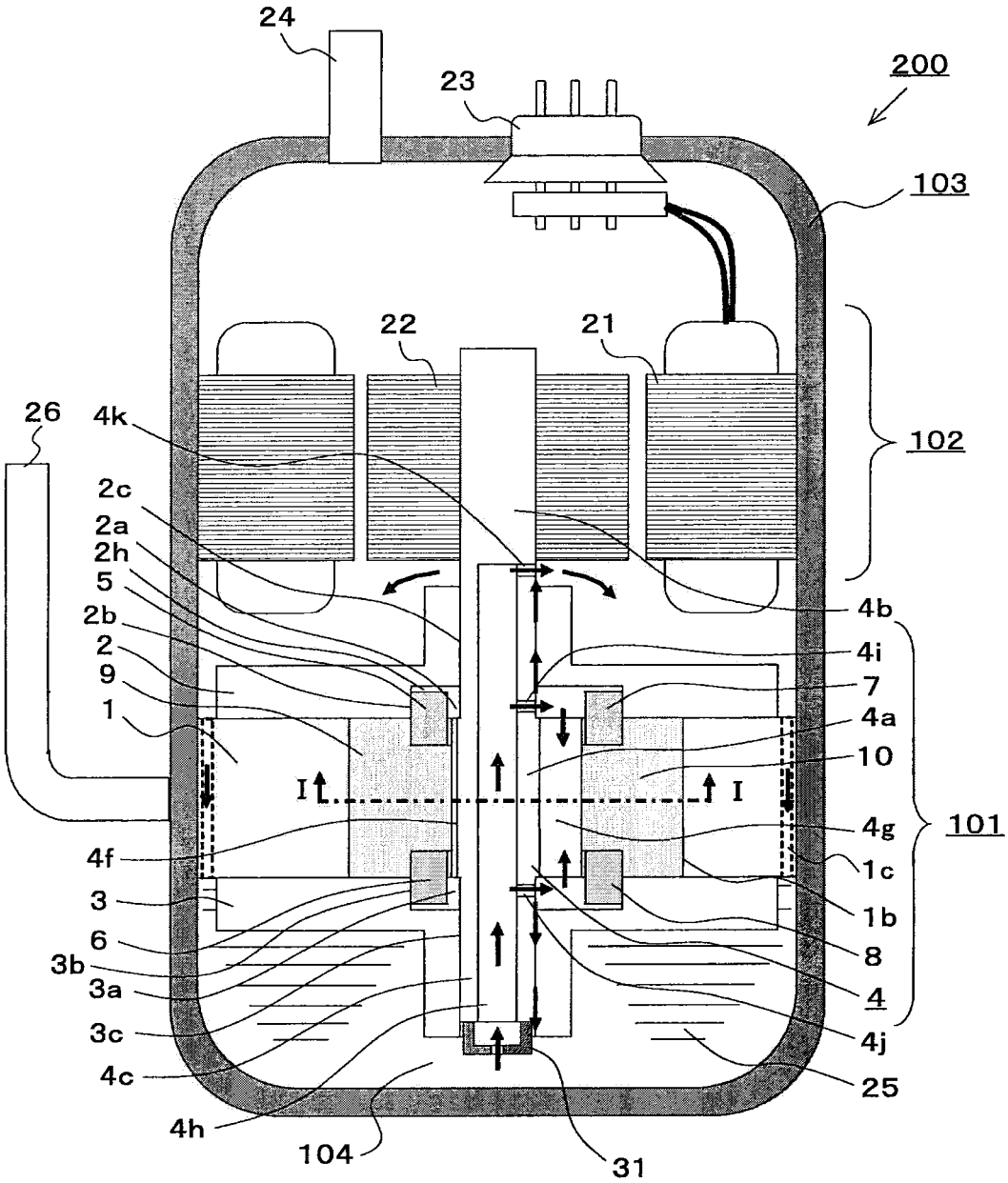
FIG. 23 is a longitudinal sectional view of a vane-type compressor according to Embodiment 9 of the present invention.
Figure 24:
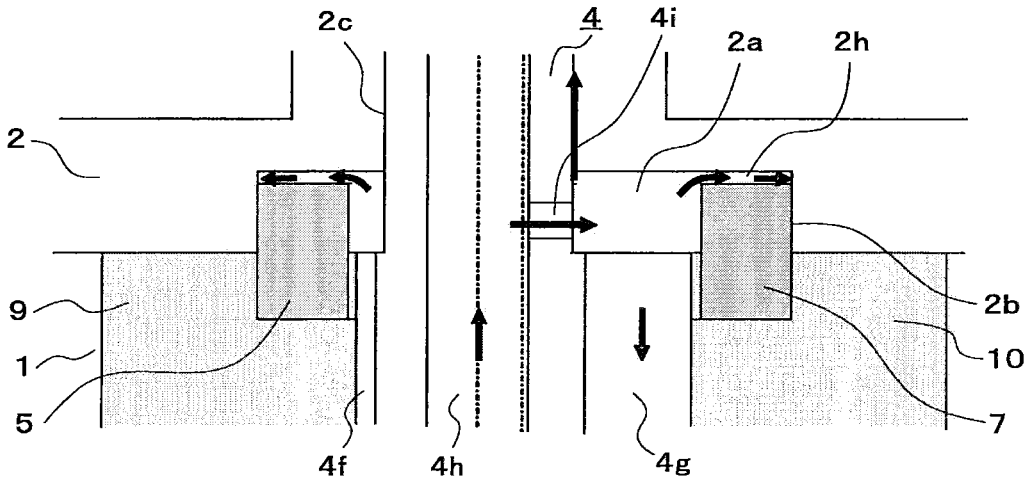
FIG. 24 is an enlarged view (longitudinal sectional view) of a main portion of a vane aligner bearing portion and a region around the vane aligner bearing portion of the vane-type compressor according to Embodiment 9 of the present invention.

FIG. 23 is a longitudinal sectional view of the vane-type compressor according to Embodiment 9 of the present invention. FIG. 24 is an enlarged view (longitudinal sectional view) of a main portion of the vane aligner bearing portion and a region around the vane aligner bearing portion of this vane-type compressor. FIG. 24 illustrates the vane aligner bearing portion 2*b* (in other words, the recess portion 2*a* of the frame 2) and the region around the vane aligner bearing portion 2*b*. Arrows in FIGS. 23 and 24 indicate the flows of the refrigerating machine oil 25.

The vane-type compressor 200 according to Embodiment 9 basically has the same structure as that of the vane-type compressor 200 described in Embodiment 1. The difference between the vane-type compressor 200 of Embodiment 9 and that of Embodiment 1 is that, in the vane-type compressor 200 of Embodiment 9, a gap 2*h* is formed between the bottom portion of the recess portion 2*a* of the frame 2 and the vane aligners 5 and 7. That is, in addition to the structure of the vane-type compressor 200 described in Embodiment 1, the vane-type compressor 200 according to Embodiment 9 has the gap 2*h* that serves as an oil supply channel that allows communication between the recess portion 2*a* and the vane aligner bearing portion 2*b* of the frame 2. Although it is not illustrated, a gap is also formed between the bottom portion of the recess portion 3*a* of the cylinder head 3 and the vane aligners 6 and 8. This gap serves as an oil supply channel that allows communication between the recess portion 3*a* and the vane aligner bearing portion 3*b* of the cylinder head 3.

In the vane-type compressor 200 having such a structure, since the gap 2*h* is formed, the refrigerating machine oil 25 having been fed to the recess portion 2*a* of the frame 2 is fed to the vane aligner bearing portion 2*b* through the gap 2*h* (space between the end surfaces of the vane aligners 5 and 7, the end surfaces each being at the end in the axial direction, and the bottom portion of the recess portion 2*a*). Thus, the oil can be more reliably supplied to the vane aligner bearing portion 2*b*, and accordingly, the vane aligner bearing portion 2*b* can be more reliably lubricated. This operation is similarly performed with the vane aligner bearing portion 3*b*.

In Embodiment 9 having been described, the oil can be more reliably supplied to the vane aligner bearing portions 2*b* and 3*b*, and accordingly, the vane aligner bearing portions 2*b* and 3*b* can be more reliably lubricated. Thus, there is an advantage in that the vane-type compressor 200, in which the loss is reduced more than that in Embodiment 1, can be provided.

By forming the gaps described in Embodiment 9 in the vane-type compressor 200 described in Embodiments 2 to 8, the vane-type compressor 200, in which the loss is reduced more than that in the vane-type compressor 200 described in Embodiments 2 to 8, can be provided.

Embodiment 10

A groove portion, for example, a groove portion as described below, may be formed in the bottom portion of each of the recess portions 2*a* and 3*a* having a bottomed cylindrical shape described in Embodiment 9. In Embodiment 10, items not specifically described are similar to those in Embodiment 9, and the same functions and structures are denoted by the same reference signs.

Figure 25:
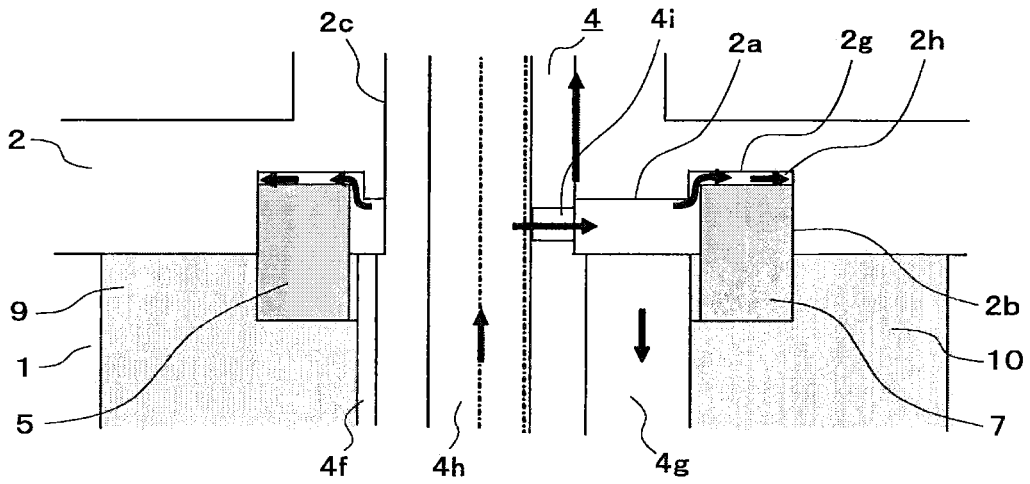
FIG. 25 is an enlarged view (longitudinal sectional view) of a main portion of a vane aligner bearing portion and a region around the vane aligner bearing portion of a vane-type compressor according to Embodiment 10 of the present invention.

FIG. 25 is an enlarged view (longitudinal sectional view) of a main portion of the vane aligner bearing portion and a region around the vane aligner bearing portion of the vane-type compressor according to Embodiment 10 of the present invention. FIG. 25 illustrates the vane aligner bearing portion 2*b* (in other words, the recess portion 2*a* of the frame 2) and the region around the vane aligner bearing portion 2*b*. Although it is not illustrated, the vane aligner bearing portion 3*b* (in other words, the recess portion 3*a* of the cylinder head 3) and a region around the vane aligner bearing portion 3*b* have the similar shapes. Arrows in FIG. 25 indicate the flows of the refrigerating machine oil 25.

In the vane-type compressor 200 according to Embodiment 10, the annular groove portion 2*g* is formed by a step provided on the outer circumferential side of the bottom portion of the recess portion 2*a* of the frame 2. The groove portion 2*g* is concentric with the inner circumferential surface 1*b* of the cylinder 1. The vane aligners 5 and 7 (more specifically, base portions 5*c* and 7*c*) are inserted into the groove portion 2*g* of the recess portion 2*a*. Furthermore, in a state in which the vane aligners 5 and 7 are inserted into the groove portion 2*g* of the recess portion 2*a*, the gap 2*h* is formed between the bottom portion of the recess portion 2*a* of the frame 2 and the vane aligners 5 and 7. By insertion of the vane aligners 5 and 7 into the groove portion 2*g* of the recess portion 2*a*, movements of the vane aligners 5 and 7 in the radial directions are regulated. Thus, the vane aligners 5 and 7 can be more stably held in the recess portion 2*a* than that in Embodiment 9. When the step of the recess portion 2*a* of the frame 2 is excessively large, a height of a radially inside space of the recess portion 2*a* of the frame 2, the height of the radially inside space being in the axial direction, is reduced. This may be resistive against the refrigerating machine oil 25 being fed to the recess portion 2*a* of the frame 2 through the oil supply channel 4*i*, and accordingly, may obstruct supply of the oil. Thus, the step of the recess portion 2*a* of the frame 2, that is, the depth of the groove portion 2*g*, is preferably formed to have an appropriate degree of size so as not to obstruct the supply of the oil.

Also in the vane-type compressor 200 structured as in Embodiment 10, since the gap 2*h* is formed, the refrigerating machine oil 25 having been fed to the recess portion 2*a* of the frame 2 is fed to the vane aligner bearing portion 2*b* through the gap 2*h* (space between the end surfaces of the vane aligners 5 and 7, the end surfaces each being at the end in the axial direction, and the bottom portion of the recess portion 2*a*). Thus, the oil can be more reliably supplied to the vane aligner bearing portion 2*b*, and accordingly, the vane aligner bearing portion 2*b* can be more reliably lubricated. This operation is similarly performed with the vane aligner bearing portion 3*b*.

Furthermore, in the vane-type compressor 200 according to Embodiment 10, the vane aligners 5 and 7 can be more stably held in the recess portion 2*a* of the frame 2 and the vane aligners 6 and 8 can be more stably held in the recess portion 3*a* of the cylinder head 3 than those in the vane-type compressor 200 described in Embodiment 9.

Embodiment 11

The vane-type compressor 200, in which the loss is further reduced, can be obtained also by providing the following oil supply channel (through hole) in the vane-type compressor 200 described in Embodiment 9 or 10. In Embodiment 11, items not specifically described are similar to those in Embodiment 9 or 10, and the same functions and structures are denoted by the same reference signs.

Figure 26:
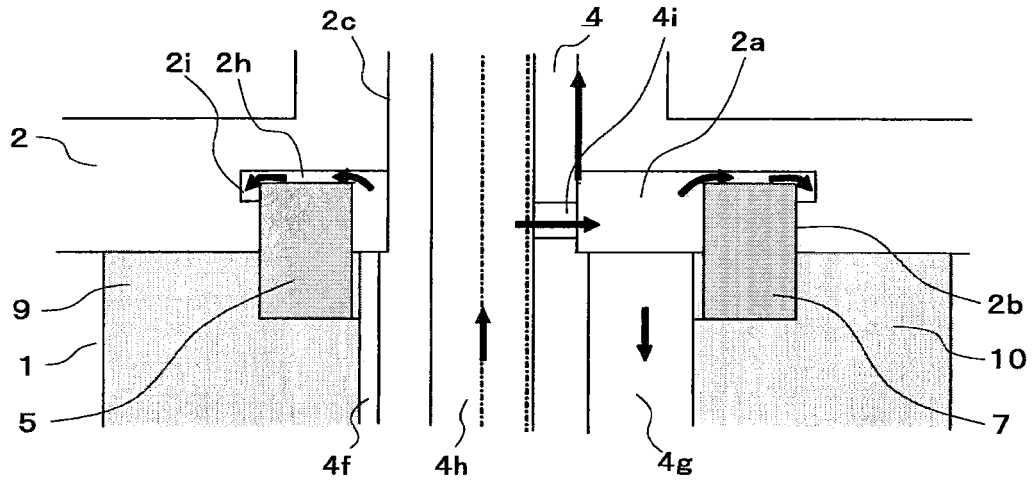
FIG. 26 is an enlarged view (longitudinal sectional view) of a main portion of a vane aligner bearing portion and a region around the vane aligner bearing portion of a vane-type compressor according to Embodiment 11 of the present invention.

FIG. 26 is an enlarged view (longitudinal sectional view) of a main portion of the vane aligner bearing portion and a region around the vane aligner bearing portion of the vane-type compressor according to Embodiment 11 of the present invention. FIG. 26 illustrates the vane aligner bearing portion 2*b* (in other words, the recess portion 2*a* of the frame 2) and the region around the vane aligner bearing portion 2*b*. Although it is not illustrated, the vane aligner bearing portion 3*b* (in other words, the recess portion 3*a* of the cylinder head 3) and a region around the vane aligner bearing portion 3*b* have the similar shapes. Arrows in FIG. 26 indicate the flows of the refrigerating machine oil 25.

In addition to the structure of the vane-type compressor 200 described in Embodiment 9, the vane-type compressor 200 according to Embodiment 11 has an oil retaining groove 2*i* in the vane aligner bearing portion 2*b*. The oil retaining groove 2*i* communicates with the gap 2*h*. In Embodiment 11, the oil retaining groove 2*i* is formed in a portion of the vane aligner bearing portion 2*b* over the entire circumference of the vane aligner bearing portion 2*b*, the portion being opposite to the cylinder 1.

In the vane-type compressor 200 having such a structure, the refrigerating machine oil 25 having been fed to the recess portion 2*a* of the frame 2 is fed to the oil retaining groove 2*i* through the gap 2*h* (space between the end surfaces of the vane aligners 5 and 7, the end surfaces each being at the end in the axial direction, and the bottom portion of the recess portion 2*a*). Since the oil retaining groove 2*i* is adjacent to the vane aligner bearing portion 2*b*, the oil is more easily supplied to the vane aligner bearing portion 2*b* than that in Embodiment 9. Thus, the vane aligner bearing portion 2*b* can be more reliably lubricated.

By forming the oil retaining groove 2*i* described in Embodiment 11 in the vane-type compressor 200 described in Embodiment 10, that is, by forming the oil retaining groove 2*i* so as to communicate with the groove portion 2*g*, the vane aligner bearing portion 2*b* can be more reliably lubricated than that in the vane-type compressor 200 described in Embodiment 9.

Embodiment 12

The oil supply channel that allows communication between the recess portion 2*a* and the vane aligner bearing portion 2*b* of the frame 2 and the oil supply channel that allows communication between the recess portion 3*a* and the vane aligner bearing portion 3*b* of the cylinder head 3 is not limited to those described in Embodiment 9 and may be formed, for example, as follows. In Embodiment 12, items not specifically described are similar to those in Embodiments 1 to 11, and the same functions and structures are denoted by the same reference signs.

Figure 27:
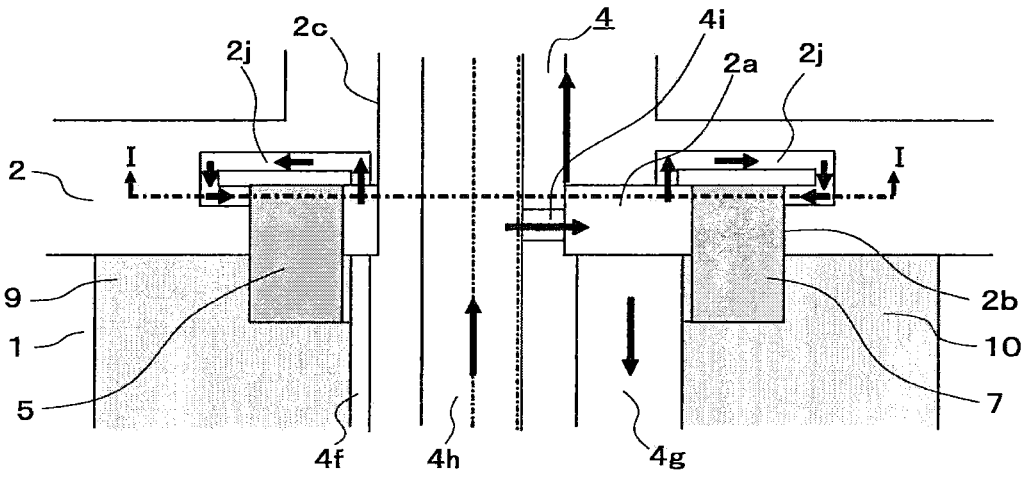
FIG. 27(*a*) and FIG. 27(*b*) include enlarged views of a main portion of a vane aligner bearing portion and a region around the vane aligner bearing portion of a vane-type compressor according to Embodiment 12 of the present invention.
Figure 27:
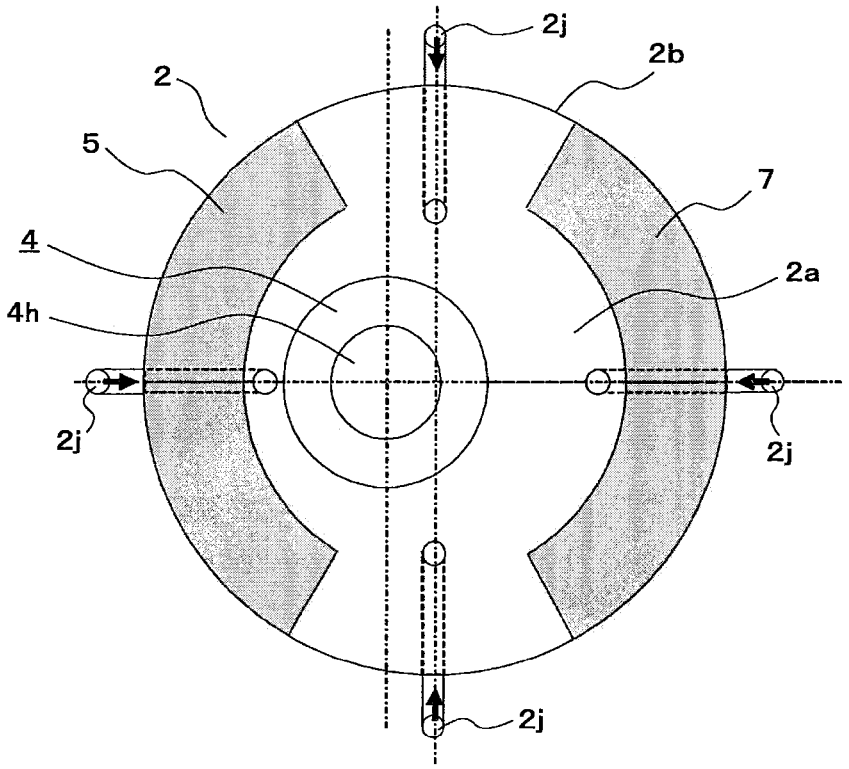

FIG. 27(*a*) and FIG. 27(*b*) include enlarged views of a main portion of the vane aligner bearing portion and a region around the vane aligner bearing portion of the vane-type compressor according to Embodiment 12 of the present invention. FIG. 27(*a*) is a longitudinal sectional view of the vane aligner bearing portion and the region around the vane aligner bearing portion, and FIG. 27(*b*) is a bottom sectional view taken along line I-I in FIG. 27(*a*). The views in FIG. 27(*a*) and FIG. 27(*b*) illustrate the vane aligner bearing portion 2*b* (in other words, the recess portion 2*a* of the frame 2) and the region around the vane aligner bearing portion 2*b*. Arrows in FIG. 27(*a*) and FIG. 27(*b*) indicate the flows of the refrigerating machine oil 25.

In the vane-type compressor 200 according to Embodiment 12, instead of the gap 2*h* described in Embodiment 9, at least one oil supply channel 2*j* that allows communication between the recess portion 2*a* and the vane aligner bearing portion 2*b* of the frame 2 is provided in the vane-type compressor 200 described in Embodiment 1. The oil supply channel 2*j* is formed in the frame 2. One of ends of the oil supply channel 2*j* is open at the vane aligner bearing portion 2*b*, and the other end of the oil supply channel 2*j* is open at the recess portion 2*a*. Although it is not illustrated, an oil supply channel, which has a structure similar to that of the oil supply channel 2*j*, is also formed in the cylinder head 3. This oil supply channel allows communication between the recess portion 3*a* and the vane aligner bearing portion 3*b* of the cylinder head 3.

In the vane-type compressor 200 having such a structure, since the oil supply channel 2*j* is formed, the refrigerating machine oil 25 having been fed to the recess portion 2*a* of the frame 2 is fed to the vane aligner bearing portion 2*b* through the oil supply channel 2*j*. Thus, also in the vane-type compressor 200 according to Embodiment 12, the oil can be more reliably supplied to the vane aligner bearing portion 2*b*, and accordingly, the vane aligner bearing portion 2*b* can be more reliably lubricated similarly to the vane-type compressor 200 described in Embodiment 9. This operation is similarly performed with the vane aligner bearing portion 3*b*.

Also, the vane-type compressor 200 according to Embodiment 12 may have the oil retaining groove 2*i* in the vane aligner bearing portion 2*b* similarly to Embodiment 11. That is, the oil retaining groove 2*i* that communicates with the oil supply channel 2*j* may be provided in the vane aligner bearing portion 2*b*.

Figure 28:
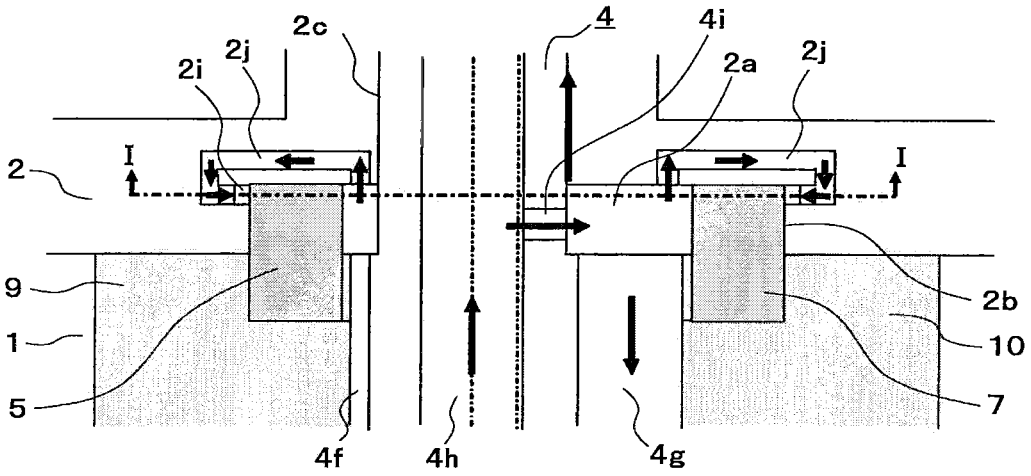
FIG. 28(*a*) and FIG. 28(*b*) include enlarged views of a main portion of a vane aligner bearing portion and a region around the vane aligner bearing portion of another example of the vane-type compressor according to Embodiment 12 of the present invention.
Figure 28:
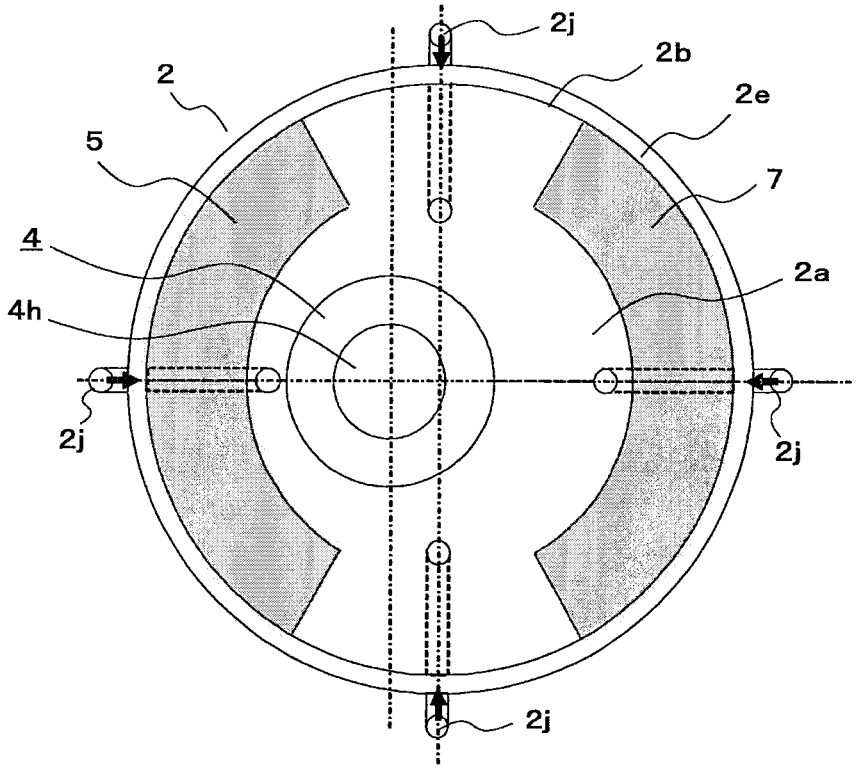

FIG. 28(*a*) and FIG. 28(*b*) include enlarged views of a main portion of the vane aligner bearing portion and a region around the vane aligner bearing portion of another example of the vane-type compressor according to Embodiment 12 of the present invention. FIG. 28(*a*) is a longitudinal sectional view of the vane aligner bearing portion and the region around the vane aligner bearing portion, and FIG. 28(*b*) is a bottom sectional view taken along line I-I in FIG. 28(*a*). The views in FIG. 28(*a*) and FIG. 28(*b*) illustrate the vane aligner bearing portion 2*b* (in other words, the recess portion 2*a* of the frame and the region around the vane al ever bearing portion 2*b*. Arrows in FIG. 28(*a*) and FIG. 28(*b*) indicate the flows of the refrigerating machine oil 25.

In the vane-type compressor 200 illustrated in FIG. 28(*a*) and FIG. 28(*b*), the oil retaining groove 2*i* is formed in a portion of the vane aligner bearing portion 2*b* over the entire circumference of the vane aligner bearing portion 2*b*, the portion being opposite to the cylinder 1. The oil retaining groove 2*i* communicates with the oil supply channel 2*j*.

In the vane-type compressor 200 having such a structure, the refrigerating machine oil 25 having been fed to the recess portion 2*a* of the frame 2 is fed to the oil retaining groove 2*i* through the oil supply channel 2*j*. Since the oil retaining groove 2*i* is adjacent to the vane aligner bearing portion 2*b*, the oil is more easily supplied to the vane aligner bearing portion 2*b* than in the vane-type compressor 200 illustrated in FIG. 27. Thus, the vane aligner bearing portion 2*b* can be more reliably lubricated.

Although it is not illustrated, when the oil retaining groove 2*i* is provided in the cylinder head 3, the effects similar to those described above can be naturally obtained also for the vane aligner bearing portion 3*b*. Of course, the oil supply channel 2*j* described in Embodiment 12 may be provided in the vane-type compressor 200 described in Embodiments 9 to 11. By doing this, the refrigerating machine oil 25 in the recess portion 2*a* is fed to the vane aligner bearing portion 2*b* through a plurality of oil supply channels. Thus, the oil is more easily supplied to the vane aligner bearing portion 2*b*. This is similarly achieved for the vane aligner bearing portion 3*b*.

By forming the oil supply channel described in Embodiment 12 in the vane-type compressor 200 described in Embodiments 2 to 8, the oil is more easily supplied to the vane aligner bearing portions 2*b* and 3*b*. Thus, the vane-type compressor 200, in which the loss is reduced more than that in the vane-type compressor 200 described in Embodiments 2 to 8, can be provided.

Embodiment 13

The oil supply channel that allows communication between the recess portion 2*a* and the vane aligner bearing portion 2*b* of the frame 2 and the oil supply channel that allows communication between the recess portion 3*a* and the vane aligner bearing portion 3*b* of the cylinder head 3 may be formed, for example, as follows. In Embodiment 13, items not specifically described are similar to those in Embodiments 1 to 12, and the same functions and structures are denoted by the same reference signs.

Figure 29:
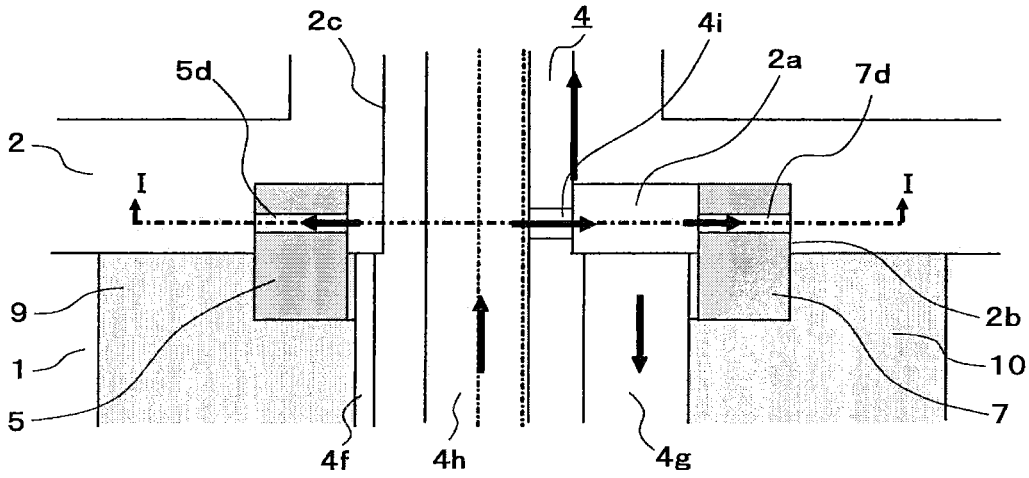
FIG. 29(*a*) and FIG. 29(*b*) include enlarged views of a main portion of a vane aligner bearing portion and a region around the vane aligner bearing portion of a vane-type compressor according to Embodiment 13 of the present invention.
Figure 29:
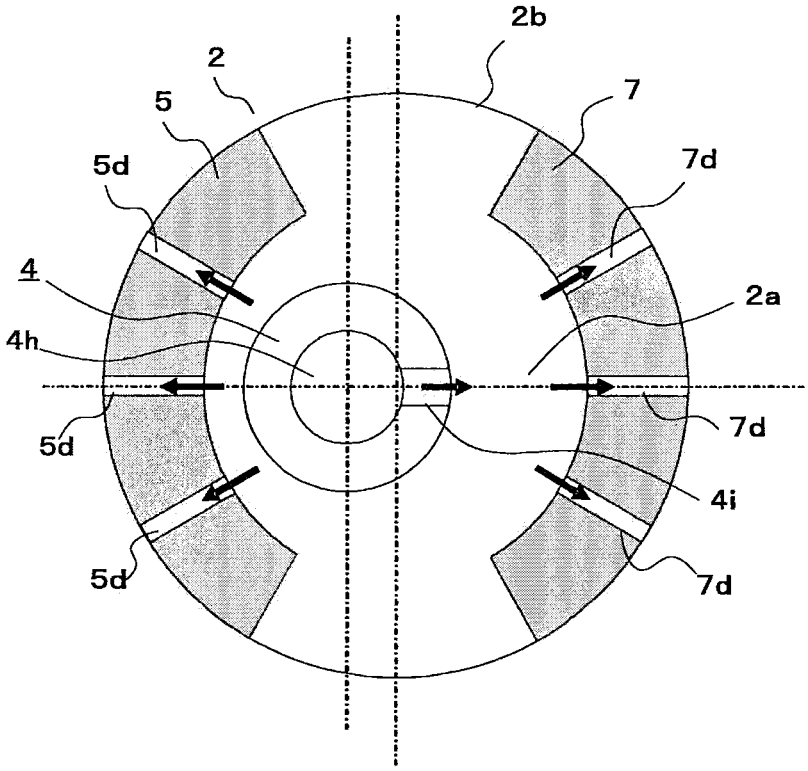

FIG. 29(*a*) and FIG. 29(*b*) include enlarged views of a main portion of the vane aligner bearing portion and a region around the vane aligned bearing portion of the vane-type compressor according to Embodiment 13 of the present invention. FIG. 29(*a*) is a longitudinal sectional view of the vane aligner bearing portion and the region around the vane aligner bearing portion, and FIG. 29(*b*) is a bottom sectional view taken along line I-I in view FIG. 29(*a*). The views in FIG. 29(*a*) and FIG. 29(*b*) illustrate the vane aligner bearing portion 2*b* (in other words, the recess portion 2*a* of the frame 2) and the region around the vane aligner bearing portion 2*b*. Arrows in FIG. 29 indicate the flows of the refrigerating machine oil 25.

In addition to the structure of the vane-type compressor 200 according to Embodiment 1, the vane-type compressor 200 according to Embodiment 13 has at least one oil supply channel 5*d* and at least one oil supply channel 7*d*, which serve as oil supply channels that allow communication between the recess portion 2*a* and the vane aligner bearing portion 2*b* of the frame 2. The oil supply channel 5*d* penetrates through the vane aligner 5 in the radial direction (from the inner circumferential side toward the outer circumferential side). The oil supply channel 7*d* penetrates through the vane aligner 7 in the radial direction (from the inner circumferential side toward the outer circumferential side). Although it is not illustrated, similar oil supply channels, which serve as oil supply channels that allow communication between the recess portion 3*a* and the vane aligner bearing portion 3*b* of the cylinder head 3, are also formed in the vane aligners 6 and 8.

In the vane-type compressor 200 having such a structure, the refrigerating machine oil 25 having been fed to the recess portion 2*a* of the frame 2 is fed to the vane aligner bearing portion 2*b* through these oil supply channels 5*d* and 7*d*. Thus, also in the vane-type compressor 200 according to Embodiment 13, the oil can be more reliably supplied to the vane aligner bearing portion 2*b*, and accordingly, the vane aligner bearing portion 2*b* can be more reliably lubricated similarly to the vane-type compressor 200 described in Embodiment 9. This operation is similarly performed with the vane aligner bearing portion 3*b*.

Of course, the oil supply channels 5*d* and 7*d* described in Embodiment 13 may be provided in the vane aligners 5 and 7 described in Embodiments 9 to 12. By doing this, the refrigerating machine oil 25 in the recess portion 2*a* is fed to the vane aligner bearing portion 2*b* through a plurality of oil supply channels. Thus, the oil is more easily supplied to the vane aligner bearing portion 2*b*. This is similarly achieved for the vane aligner bearing portion 3*b*.

By forming the oil supply channels described in Embodiment 13 in the vane-type compressor 200 described in Embodiments 2 to 8, the oil is more easily supplied to the vane aligner bearing portions 2*b* and 3*b*. Thus, the vane-type compressor 200, in which the loss is reduced more than that in the vane-type compressor 200 described in Embodiments 2 to 8, can be provided.

Embodiment 14

The oil supply channel that allows communication between the recess portion 2*a* and the vane aligner bearing portion 2*b* of the frame 2 and the oil supply channel that allows communication between the recess portion 3*a* and the vane aligner bearing portion 3*b* of the cylinder head 3 may be formed, for example, as follows. In Embodiment 14, items not specifically described are similar to those in Embodiments 1 to 13, and the same functions and structures are denoted by the same reference signs.

Figure 30:
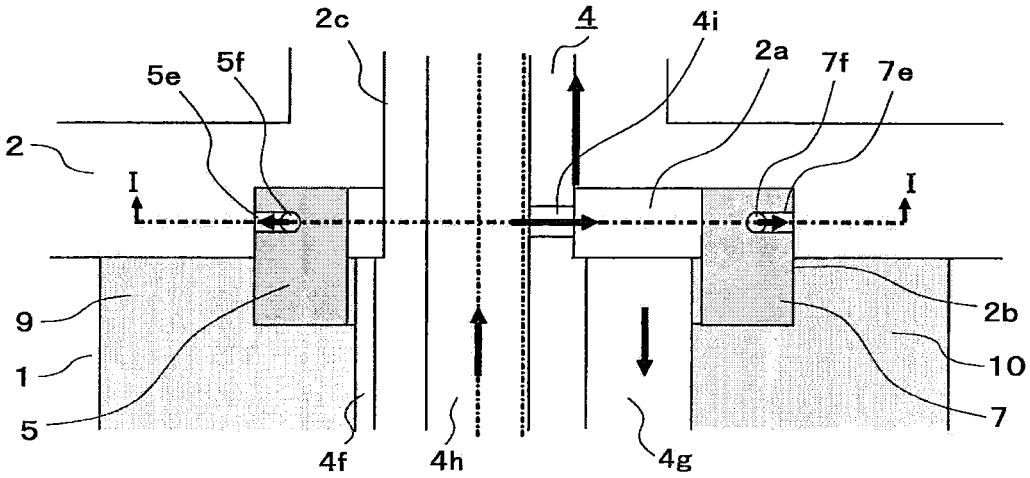
FIG. 30(*a*) and FIG. 30(*b*) include enlarged views of a main portion of a vane aligner bearing portion and a region around the vane aligner bearing portion of a vane-type compressor according to Embodiment 14 of the present invention.
Figure 30:
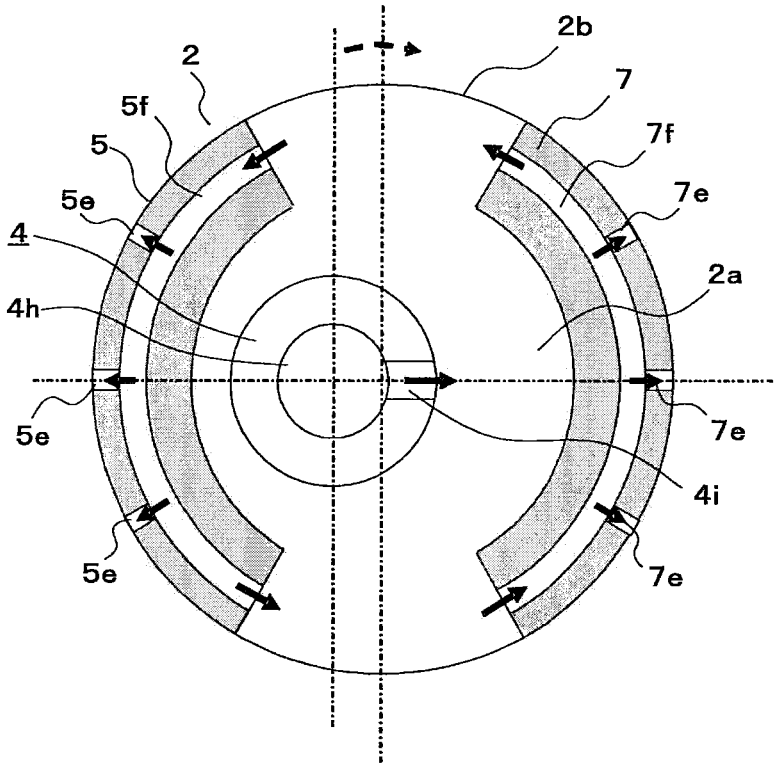

FIG. 30(*a*) and FIG. 30(*b*) include enlarged views of a main portion of the vane aligner bearing portion and a region around the vane aligner bearing portion of the vane-type compressor according to Embodiment 14 of the present invention. FIG. 30(*a*) is a longitudinal sectional view of the vane aligner bearing portion and the region around the vane aligner bearing portion, and FIG. 30(*b*) is a bottom sectional view taken along line I-I in FIG. 30(*a*). The views in FIG. 30(*a*) and FIG. 30(*b*) illustrate the vane aligner bearing portion 2*b* (in other words, the recess portion 2*a* of the frame 2) and the region around the vane aligner bearing portion 2*b*. In FIG. 30(*a*) and FIG. 30(*b*), solid arrows indicate the flows of the refrigerating machine oil 25, and a dashed arrow indicates the rotational direction of the vane aligners 5 and 7.

In addition to the structure of the vane-type compressor 200 according to Embodiment 1, the vane-type compressor 200 according to Embodiment 14 is provided with oil supply channels 5*f* and 7*f* and at least one oil supply channel 5*e* and at least one oil supply channel 7*e*. The oil supply channels 5*f* and 7*f* serve as oil supply channels in the circumferential direction and are formed in the vane aligners 5 and 7 in the circumferential direction of the base portions 5*c* and 7*c* of the vane aligners 5 and 7. The oil supply channels 5*f* and 7*f* each open at an end portions thereof on the rotational direction side and on the side opposite to the rotational direction (end portion on the counter-rotational side). The oil supply channels 5*e* and 7*e* serve as oil supply channels in the radial directions and allow communication between the oil supply channels 5*f* and 7*f* and the outer circumferential sides of the vane aligners 5 and 7. Although it is not illustrated, similar oil supply channels, which serve as oil supply channels that allow communication between the recess portion 3*a* and the vane aligner bearing portion 3*b* of the cylinder head 3, are also formed in the vane aligners 6 and 8.

In the vane-type compressor 200 having such a structure, the refrigerating machine oil 25 having been fed to the recess portion 2*a* of the frame 2 flows into the oil supply channels 5*f* and 7*f* from the end portions of the vane aligners 5 and 7 in the rotational direction, and is fed to the vane aligner bearing portion 2*b* through the oil supply channels 5*e* and 7*e*. Thus, also in the vane-type compressor 200 according to Embodiment 14, the oil can be more reliably supplied to the vane aligner bearing portion 2*b*, and accordingly, the vane aligner bearing portion 2*b* can be more reliably lubricated similarly to the vane-type compressor 200 described in Embodiment 9. This operation is similarly performed with the vane aligner bearing portion 3*b*.

The oil supply channels 5*f* and 7*f* are not necessarily open at both the end portions thereof and may alternatively have, for example, the following structure.

Figure 31:
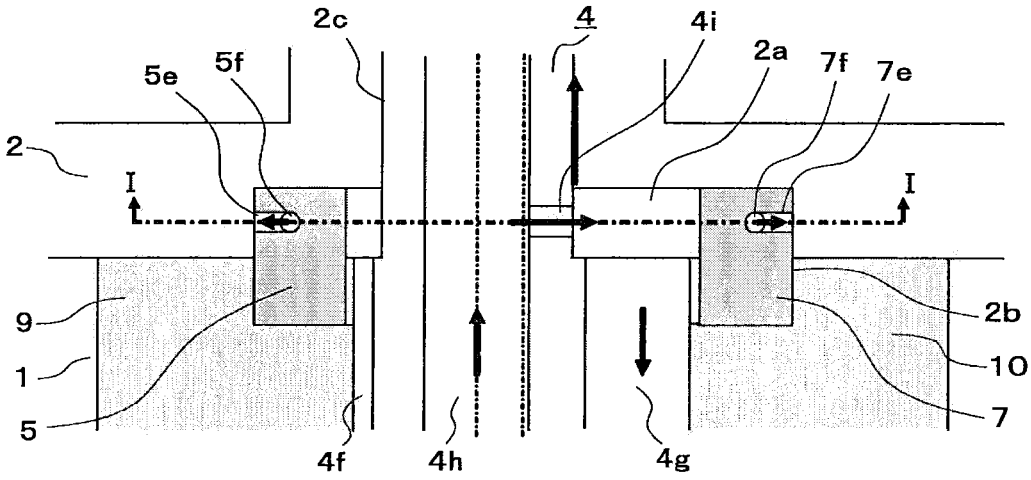
FIG. 31(*a*) and FIG. 31(*b*) include enlarged views of a main portion of a vane aligner bearing portion and a region around the vane aligner bearing portion of another example of the vane-type compressor according to Embodiment 14 of the present invention.
Figure 31:
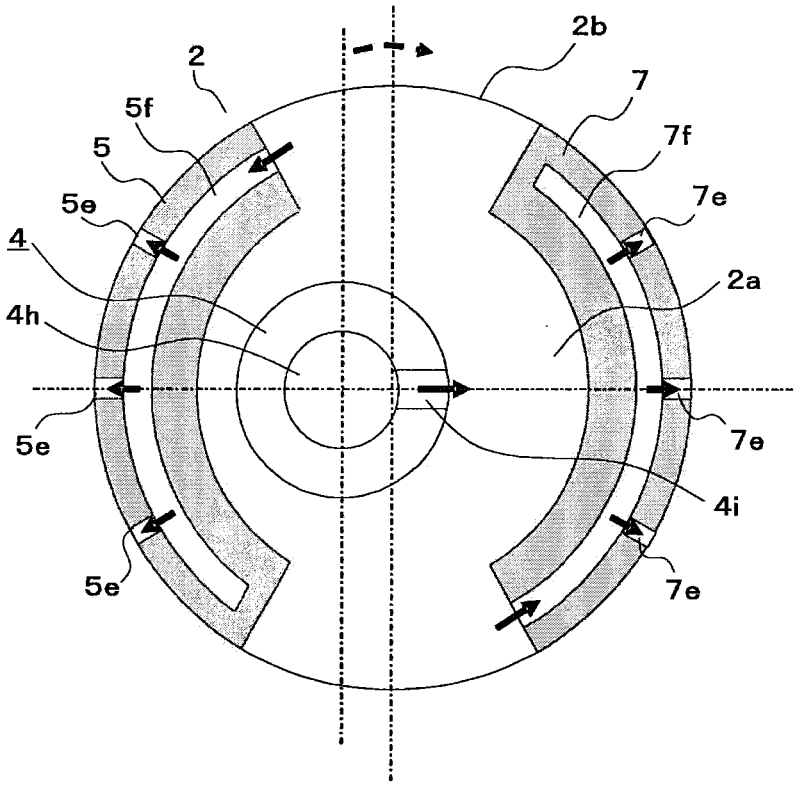

FIG. 31(*a*) and FIG. 31(*b*) include enlarged views of a main portion of the vane aligner bearing portion and a region around the vane aligner bearing portion of another example of the vane-type compressor according to Embodiment 14 of the present invention. FIG. 31(*a*) is a longitudinal sectional view of the vane aligner bearing portion and the region around the vane aligner bearing portion, and FIG. 31(*b*) is a bottom sectional view taken along line I-I in FIG. 31(*a*). The views in FIG. 31(*a*) and FIG. 31(*b*) illustrate the vane aligner bearing portion 2*b* (in other words, the recess portion 2*a* of the frame 2) and the region around the vane aligner bearing portion 2*b*. In FIG. 31(*a*) and FIG. 31(*b*), solid arrows indicate the flows of the refrigerating machine oil 25, and a dashed arrow indicates the rotational direction of the vane aligners 5 and 7.

In the vane-type compressor 200 illustrated in FIG. 31, the oil supply channels 5*f* and 7*f* are open at the end portions on the rotational direction side, and the end portions on the side opposite to the rotational direction (end portion on the counter-rotational side) are sealed.

In the vane-type compressor 200 having such a structure, the entirety of the refrigerating machine oil 25 having flowed into the oil supply channels 5*f* and 7*f* from the end portions of the vane aligners 5 and 7, the end portions being on the rotational side, is fed to the vane aligner bearing portion 2*b* through the oil supply channels 5*e* and 7*e*. Thus, the oil can be more reliably supplied to the vane aligner bearing portion 2*b*, and accordingly, the vane aligner bearing portion 2*b* can be more reliably lubricated than that in the vane-type compressor 200 illustrated in FIG. 30. This operation is similarly performed with the vane aligner bearing portion 3*b*.

Of course, the oil supply channels 5*f* and 7*f* and the oil supply channels 5*e* and 7*e* described in Embodiment 14 may be provided in the vane aligners 5 and 7 described in Embodiments 9 to 12. By doing this, the refrigerating machine oil 25 in the recess portion 2*a* is fed to the vane aligner bearing portion 2*b* through a plurality of oil supply channels. Thus, the oil is more easily supplied to the vane aligner bearing portion 2*b*. This is similarly achieved for the vane aligner bearing portion 3*b*.

By forming the oil supply channels described in Embodiment 14 in the vane-type compressor 200 described in Embodiments 2 to 8, the oil is more easily supplied to the vane aligner bearing portions 2*b* and 3*b*. Thus, the vane-type compressor 200, in which the loss is reduced more than that in the vane-type compressor 200 described in Embodiments 2 to 8, can be provided.

Embodiment 15

By forming the following oil supply channels in the vane-type compressor 200 described in Embodiments 1 to 14, the tip end portions 9*a* and 10*a* of the first vane 9 and the second vane can be more reliably lubricated. In Embodiment 15, items not specifically described are similar to those in Embodiments 1 to 14, and the same functions and structures are denoted by the same reference signs.

Figure 32:
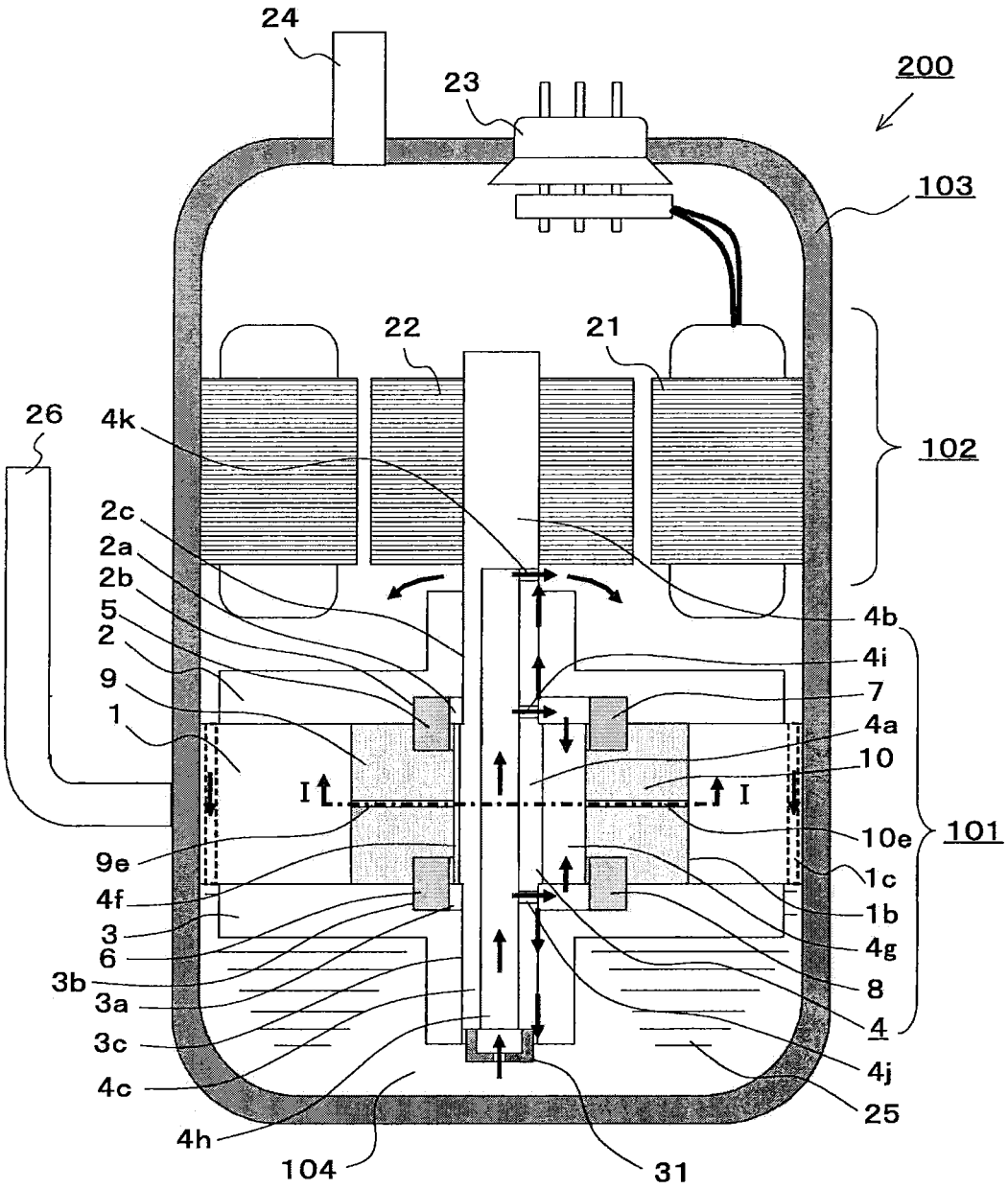
FIG. 32 is a longitudinal sectional view of a vane-type compressor according to Embodiment 15 of the present invention.
Figure 33:
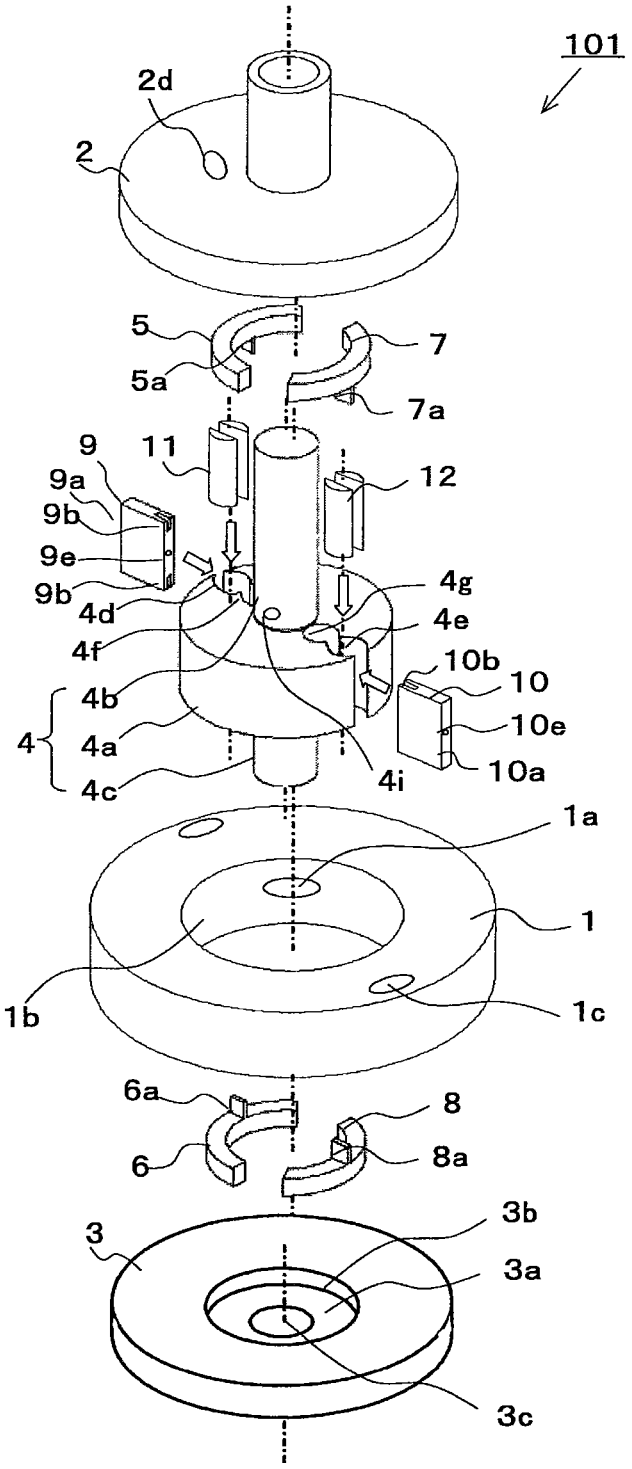
FIG. 33 is an exploded perspective view of a compressing element of the vane-type compressor according to Embodiment 15 of the present invention.
Figure 34:
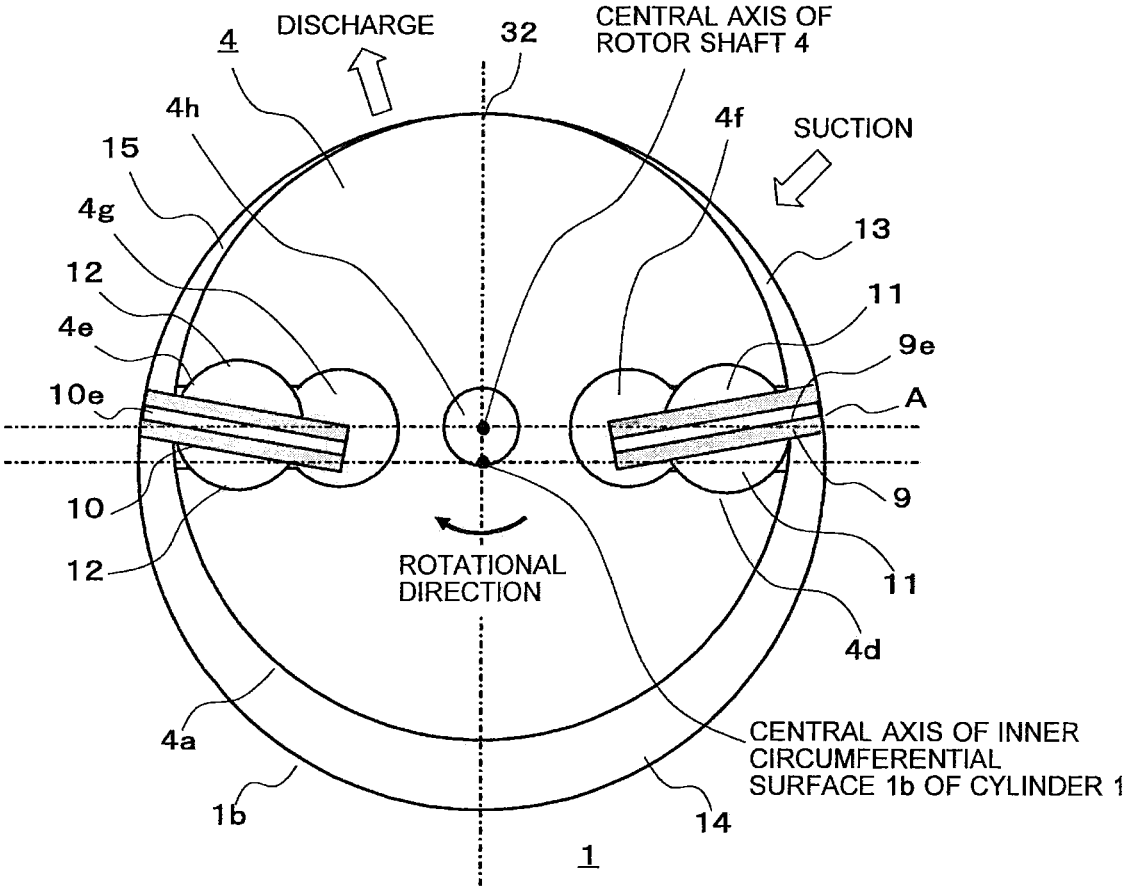
FIG. 34 is a sectional view of the compressing element of the vane-type compressor according to Embodiment 15 of the present invention taken along line I-I in FIG. 32.

FIG. 32 is a longitudinal sectional view of the vane-type compressor according to Embodiment 15 of the present invention. FIG. 33 is an exploded perspective view of a compressing element of the vane-type compressor. FIG. 34 is a sectional view of the compressing element taken along line I-I in FIG. 32. Arrows in FIG. 32 indicate the flows of the refrigerating machine oil 25.

In addition to the structure of the vane-type compressor 200 described in Embodiment 1, the vane-type compressor 200 according to Embodiment 15 has oil supply channels 9*e* and 10*e*, which respectively penetrate through the first vane 9 and the second vane 10 from the inner circumferential side to the outer circumferential side (longitudinal directions in plan view). In Embodiment 15, the oil supply channels 9*e* and 10*e* are provided near central portions of the first vane 9 and the second vane 10, the central portions each being in the center in the axial direction.

In the vane-type compressor 200 having such a structure, the refrigerating machine oil 25 flows as follows in the refrigerant compressing operation. In the vane-type compressor 200 according to Embodiment 15, the flows of the refrigerating machine oil 25 are similar to those in the vane-type compressor 200 according to Embodiment 1 except for the flows of the refrigerating machine oil 25 near the vanes 9 and 10. Thus, the refrigerating machine oil 25 except for that near the vanes 9 and 10 is described below.

Figure 35:
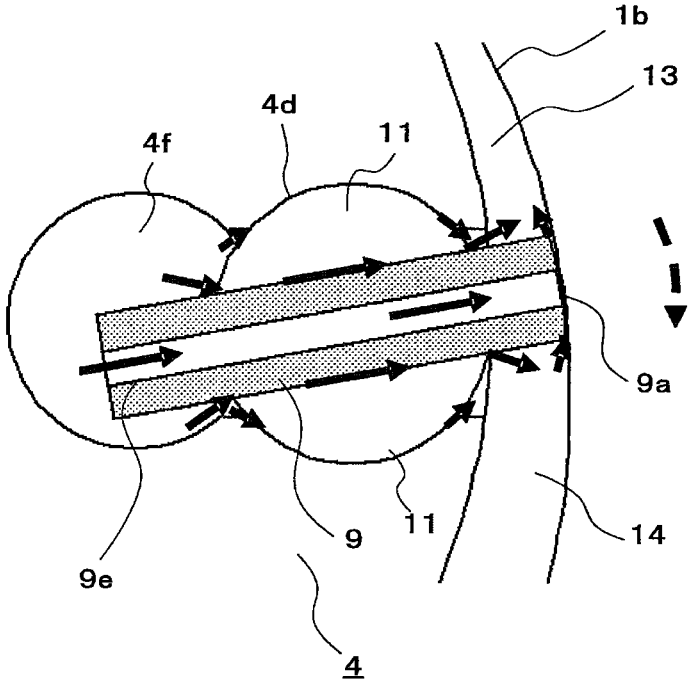
FIG. 35 is an enlarged view of a main portion of a vane and a region around the vane according to Embodiment 15 of the present invention.

FIG. 35 is an enlarged view of a main portion of the vane and a region around the vane according to Embodiment 15 of the present invention. FIG. 35 illustrates the enlarged main portion of the vane 9 and the region around the vane 9 in FIG. 34. In FIG. 35, solid arrows indicate the flows of the refrigerating machine oil 25, and a dashed arrow indicates the rotational direction.

As mentioned before, the pressure in the vane relief portion 4*f* is the discharge pressure, and higher than the pressures in the suction chamber 13 and the middle chamber 14. Thus, the refrigerating machine oil 25 having been supplied to the vane relief portion 4*f* is fed to the suction chamber 13 and the middle chamber 14 by pressure differences and the centrifugal force while lubricating the sliding portions, where the side surfaces of the first vane 9 and the bush 11 slide on one another. Also, the refrigerating machine oil 25 is fed to the suction chamber 13 and the middle chamber 14 by the pressure differences and the centrifugal force while lubricating the sliding portion, where the bush 11 and the bush holding portion 4*d* of the rotor shaft 4 slide on each other. Furthermore, the refrigerating machine oil 25 is fed to the tip end portion 9*a* through the oil supply channel 9*e* provided in the first vane 9. Here, the first vane 9 is pressed against the inner circumferential surface 1*b* of the cylinder 1 by the centrifugal force and the pressure differences between the vane relief portion 4*f* and the suction chamber 13 and between the vane relief portion 4*f* and the middle chamber 14. Thus, the tip end portion 9*a* of the first vane 9 slides along the inner circumferential surface 1*b* of the cylinder 1. At this time, in the vane-type compressor 200 according to Embodiment 15, the nip between the tip end portion 9*a* of the first vane 9 and the inner circumferential surface 1*b* of the cylinder 1 can be lubricated also with the refrigerating machine oil 25 fed to the tip end portion 9*a* of the first vane 9 through the oil supply channel 9*e*. Part of the refrigerating machine oil 25 used to lubricate the tip end portion 9*a* of the first vane 9 flows into the suction chamber 13, in which the pressure is low.

Here, part of the refrigerating machine oil 25 having fed to the middle chamber 14 also flows into the suction chamber 13 while lubricating the tip end portion 9*a* of the first vane 9. Since the amount of the oil supplied to the tip end portion 9*a* of the first vane 9 can be increased with the oil supply channel 9*e* of the first vane 9, the tip end portion 9*a* of the first vane 9 is more reliably and preferably lubricated. In so doing, the radius of the arc of the tip end portion 9*a* of the first vane 9 is substantially coincident with the radius of the inner circumferential surface 1*b* of the cylinder 1. Furthermore, the normal to the arc is substantially coincident with the normal to the inner circumferential surface 1*b*. Thus, a sufficient oil film is formed between the inner circumferential surface 1*b* and the arc of the tip end portion 9*a* of the first vanes 9, thereby hydrodynamic lubrication is achieved therebetween.

In FIG. 35, the case where the spaces separated from each other by the first vane 9 are the suction chamber 13 and the middle chamber 14 is illustrated. The operation is similarly performed in the case where the spaces separated from each other by the first vane 9 are the middle chamber 14 and the compressing chamber 15 when the rotor shaft 4 is further rotated. Furthermore, even when the pressure in the compressing chamber 15 reaches the same discharge pressure as the pressure in the vane relief portion 4*f*, the refrigerating machine oil 25 is fed toward the compressing chamber 15 by the centrifugal force. The operation with the first vane 9 has been described, the operation with the second vane 10 is similarly performed.

In Embodiment 15 having been described, the oil supply channels 9*e* and 10*e*, which penetrate through the vanes 9 and 10 from the inner circumferential side to the outer circumferential side (longitudinal directions in plan view) are provided in addition to the structure of Embodiment 1. Thus, the refrigerating machine oil 25 in the oil reservoir 104 can be more sufficiently supplied to the tip end portions 9*a* and 10*a* of the first vane 9 and the second vane 10 than that in Embodiment 1, and accordingly, the tip end portions 9*a* and 10*a* of the first vane 9 and the second vane 10 can be more reliably lubricated than those in Embodiment 1.

By forming the oil supply channels 9*e* and 10*e* described in Embodiment 15 in the vane-type compressor 200 described in Embodiments 2 to 14, the vane-type compressor 200, in which the tip end portions 9*a* and 10*a* of the first vane 9 and the second vane 10 are more reliably lubricated than those in the vane-type compressor 200 described in Embodiments 2 to 14, can be provided.

In the vane-type compressor 200 illustrated in FIGS. 32 to 35, a single oil supply channel 9*e* and a single oil supply channel 10*e* are provided near central portions of the first vane 9 and the second vane 10, the central portions each being in the center in the axial direction, respectively. However, any numbers of the oil supply channels 9*e* and 10*e* can be provided. The vane-type compressor 200 may have, for example, the following structure.

Figure 36:
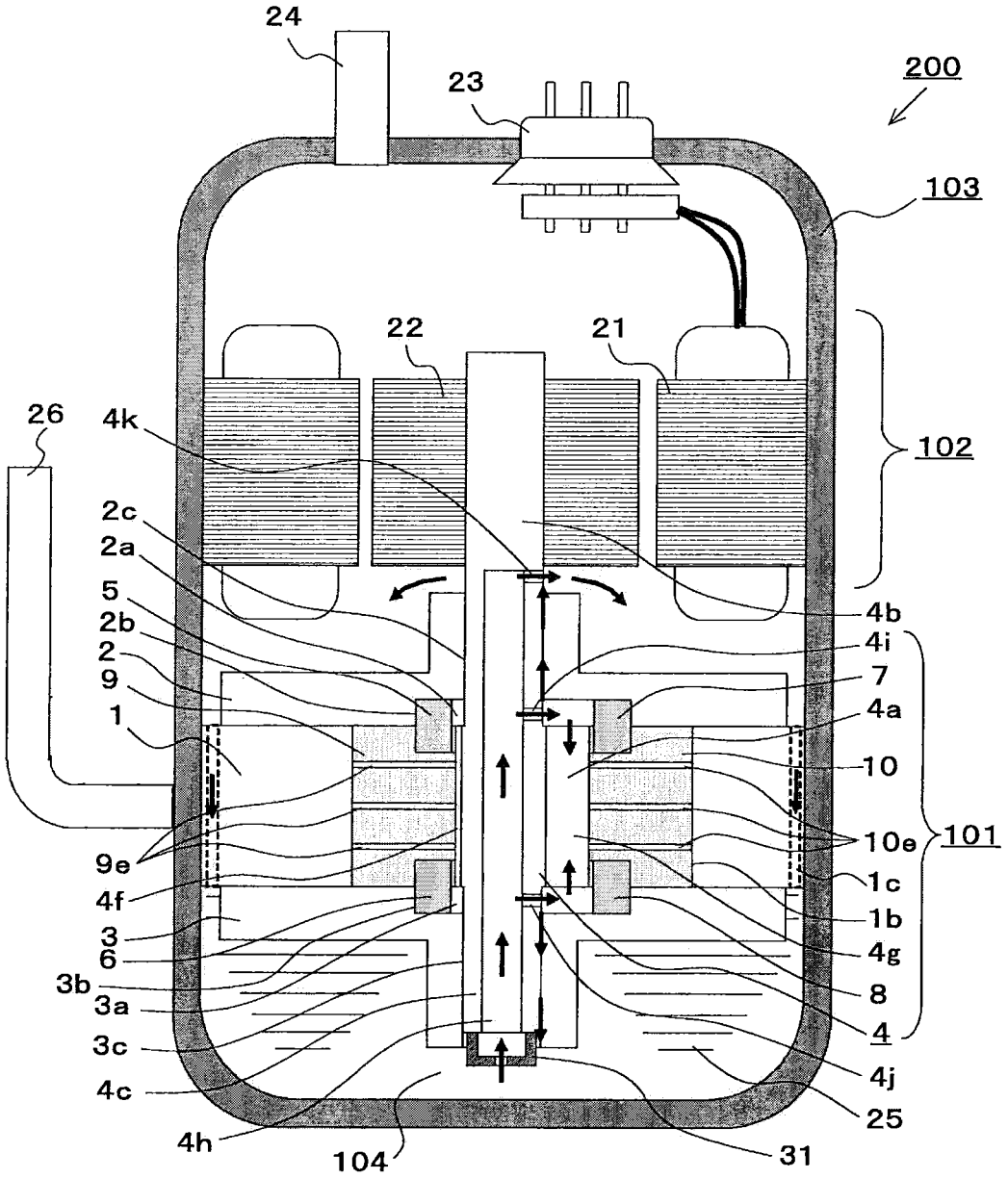
FIG. 36 is a longitudinal sectional view of another example of the vane-type compressor according to Embodiment 15 of the present invention.

FIG. 36 is a longitudinal sectional view of another example of the vane-type compressor according to Embodiment 15 of the present invention. Arrows in FIG. 36 indicate the flows of the refrigerating machine oil 25.

In the vane-type compressor 200 illustrated in FIG. 36, three oil supply channels 9*e* are provided in the axial direction in the first vane 9, and three oil supply channels 10*e* are provided in the axial direction in the second vane 10.

With the vane-type compressor 200 having such a structure, the refrigerating machine oil 25 can be supplied to the tip end portions 9*a* and 10*a* of the first vane 9 and the second vane 10 more uniformly in the axial direction than that in the vane-type compressor 200 illustrated in FIGS. 32 to 35. Thus, lubrication can be more reliably performed. Although the vane-type compressor 200 illustrated in FIG. 36 has three oil supply channels 9*e* and three oil supply channels 10*e*, two oil supply channels 9*e* and two oil supply channels 10*e* or four or more oil supply channels 9*e* and four or more oil supply channels 10*e* may be provided. As the numbers of the oil supply channels increases, the tip end portions 9*a* and 10*a* of the first vane 9 and the second vane 10 can be more uniformly lubricated.

Embodiment 16

The following oil supply channels may be formed also in the vane-type compressor 200 described in Embodiment 15. In Embodiment 16, items not specifically described are similar to those in Embodiment 15, and the same functions and structures are denoted by the same reference signs.

Figure 37:
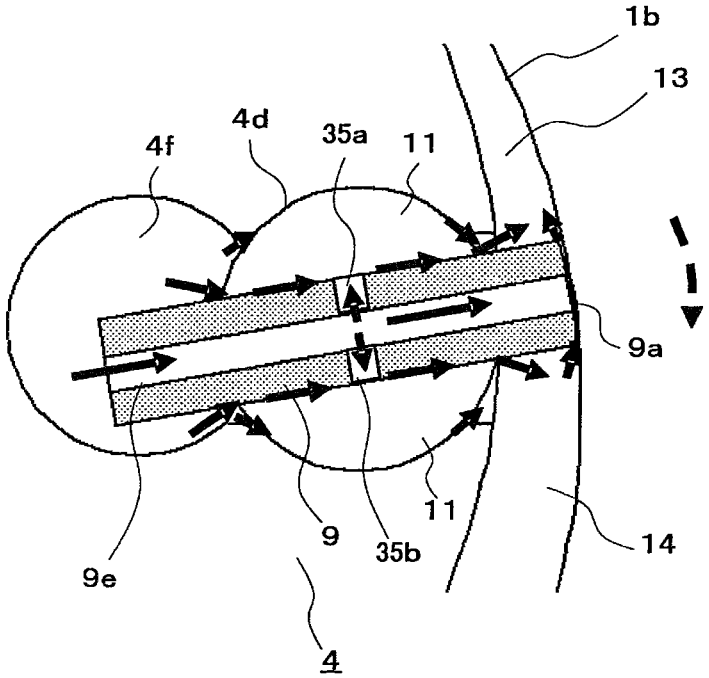
FIG. 37 is an enlarged view of a main portion of a vane and a region around the vane of a vane-type compressor according to Embodiment 16 of the present invention.

FIG. 37 is an enlarged view of a main portion of the vane and a region around the vane of the vane-type compressor according to Embodiment 16 of the present invention. FIG. 37 illustrates the enlarged main portion of the vane 9 in the rotational angle 90° position and the region around the vane 9. In FIG. 37, solid arrows indicate the flows of the refrigerating machine oil 25, and a dashed arrow indicates the rotational direction.

In addition to the structure of the vane-type compressor 200 according to Embodiment 15, the vane-type compressor 200 according to Embodiment 16 is provided with the oil supply channels 35*a* and 35*b*. The oil supply channel 35*a* allows communication between the oil supply channel 9*e* and the side-surface side of the vane 9, the side surface being on a side opposite to the rotational direction (sliding portion where part of the bush 11 on the counter rotational side and the side surface of the first vane 9 slide on each other). The oil supply channel 35*b* allows communication between the oil supply channel 9*e* and the side-surface side of the vane 9, the side surface being in the rotational direction (sliding portion where part of the bush 11 on the rotational side and the side surface of the first vane 9 slide on each other). Although it is not illustrated, similar oil supply channels are formed in the second vane 10.

In Embodiment 15, the refrigerating machine oil 25 is directly supplied from the vane relief portion 4*f* to the sliding portions, where the bush 11 and the side surfaces of the first vane 9 slide on one another. In Embodiment 16, in addition to the above-described direct oil supply, the refrigerating machine oil 25 is supplied from the vane relief portion 4*f* to the sliding portions, where the bush 11 and the side surfaces of the first vane 9 slide on one another, through the oil supply channel 9*e* and the oil supply channels 35*a* and 35*b* provided in the first vane 9. Thus, in the vane-type compressor 200 according to Embodiment 16, the sliding portions, where the bush 11 and the side surfaces of the first vane 9 slide on one another, can be more preferably lubricated than those in the vane-type compressor 200 described in Embodiment 15. Of course, the above-described operation and effect are similarly performed and obtained with the second vane 10.

It is not necessary that both the oil supply channels 35*a* and 35*b* be provided. The oil supply channel 35*b* may be omitted.

Figure 38:
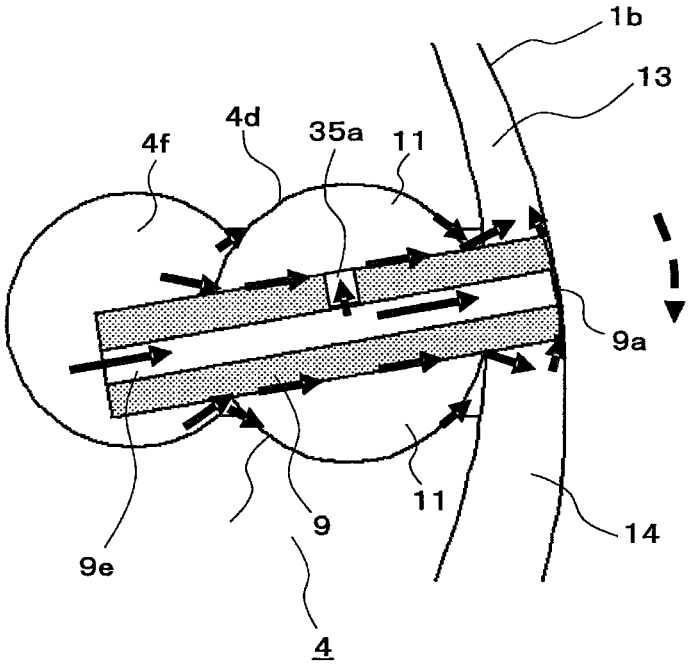
FIG. 38 is an enlarged view of a main portion of a vane and a region around the vane of another example of the vane-type compressor according to Embodiment 16 of the present invention.

FIG. 38 is an enlarged view of a main portion of the vane and a region around the vane of another example of the vane-type compressor according to Embodiment 16 of the present invention. FIG. 38 illustrates the enlarged main portion of the vane 9 in the rotational angle 90° position and the region around the vane 9. In FIG. 38, solid arrows indicate the flows of the refrigerating machine oil 25, and a dashed arrow indicates the rotational direction.

Only the oil supply channel 35*a* is provided in the vane-type compressor 200 illustrated in FIG. 38. The operation and the effect of the vane-type compressor 200 illustrated in FIG. 38 are as follows.

Figure 39:
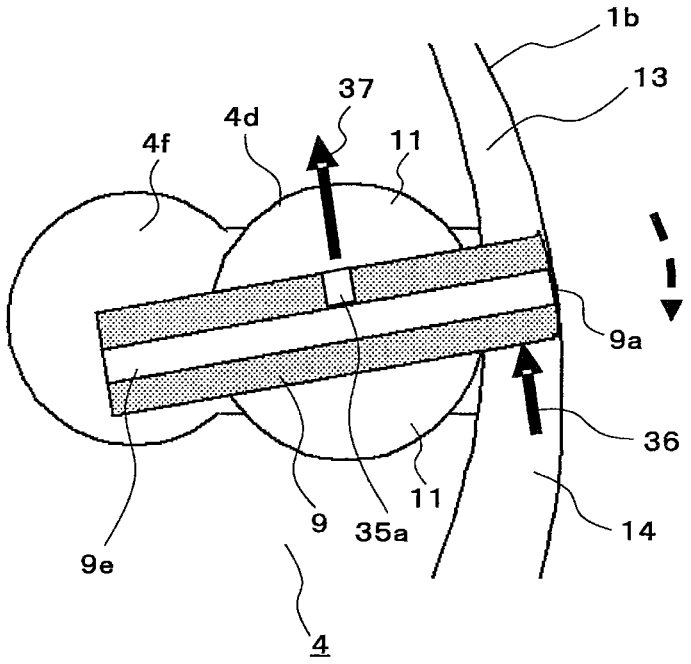
FIG. 39 is a schematic view illustrating loads acting on the vane and a bush of the vane-type compressor illustrated in FIG. 38.

FIG. 39 is a schematic view illustrating loads acting on the vane and the bush of the vane-type compressor illustrated in FIG. 38. A solid arrow 36 in the drawing indicates a load acting on the first vane 9 in a direction perpendicular to the length direction by the pressure difference between the middle chamber 14 and the suction chamber 13. A solid arrow 37 indicates a load acting on the bush 11 in a direction perpendicular to the length direction of the first vane 9. A dashed arrow indicates the rotational direction.

As described about the compressing operation in Embodiment 1 (more specifically in FIG. 5), the refrigerant is compressed in the rotational direction. Thus, the normal direction of a load 36 acting on the first vane 9 is the direction illustrated in FIG. 39 (counter-rotational direction). For this reason, the normal direction of a load 37 acting on the bush 11 in a direction perpendicular to the length direction of the first vane 9 is the direction illustrated in FIG. 39 (counter-rotational direction). Accordingly, out of the sliding portions where the side surfaces of the first vane 9 and the bush 11 slide on one another, lubrication is difficult in the sliding portion on the counter-rotational side compared to that in the rotational side. Accordingly, the oil supply channel 35*b* is not necessarily provided. With only the oil supply channel 35*a*, the refrigerating machine oil 25 supplied to the sliding portion on the counter-rotational side, where lubrication is difficult, can be increased by about as much as the amount of the refrigerating machine oil 25 that would otherwise unnecessarily flow through the oil supply channel 35*b*. Thus, the effect can be improved.

Embodiment 17

By forming the following oil supply channels in the vane-type compressor 200 described in Embodiments 1 to 14, the sliding portion, where the bush 11 and the bush holding portion 4*d* of the rotor shaft 4 slide on each other, can be more reliably lubricated. In Embodiment 17, items not specifically described are similar to those in Embodiments 1 to 16, and the same functions and structures are denoted by the same reference signs.

Figure 40:
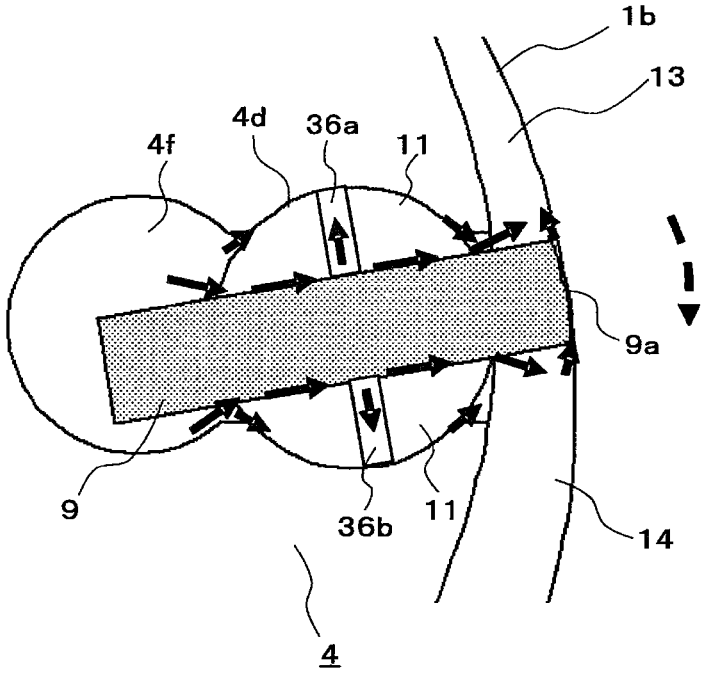
FIG. 40 is an enlarged view of a main portion of a vane and a region around the vane of a vane-type compressor according to Embodiment 17 of the present invention.

FIG. 40 is an enlarged view of a main portion of the vane and a region around the vane of the vane-type compressor according to Embodiment 17 of the present invention. FIG. 40 illustrates the enlarged main portion of the vane 9 in the rotational angle 90° position and the region around the vane 9. In FIG. 40, solid arrows indicate the flows of the refrigerating machine oil 25, and a dashed arrow indicates the rotational direction.

In addition to the structure of the vane-type compressor 200 described in Embodiment 1, the vane-type compressor 200 according to Embodiment 17 has oil supply channels 36*a* and 36*b* formed in the bush 11. One end of each of the oil supply channels 36*a* and 36*b* is open at the side surface on the first vane 9 side and the other end of each of the oil supply channels 36*a* and 36*b* is open at the side surface on the bush holding portion 4*d* side. The oil supply channels 36*a* and 36*b* allow communication between the sliding portion, where the bush 11 and the bush holding portion 4*d* the rotor shaft 4 slide on each other, and the sliding portions, where the bush 11 and the side surfaces of the first vane 9 slide on one another. The oil supply channel 36*a* is formed on the counter-rotational side and the oil supply channel 36*b* is formed on the rotational side.

In the vane-type compressor 200 having such a structure, part of the refrigerating machine oil 25 having been fed from the vane relief portion 4*f* to the sliding portions, where the bush 11 and the side surfaces of the first vane 9 slide on one another, is supplied to the sliding portion, where the bush 11 and the bush holding portion 4*d* of the rotor shaft 4 slide on each other, though the oil supply channels 36*a* and 36*b*. Thus, in the vane-type compressor 200 according to Embodiment 17, the sliding portion, where the bush 11 and the bush holding portion 4*d* of the rotor shaft 4 slide on each other, can be more preferably lubricated than that in the vane-type compressor 200 described in Embodiment 1. Of course, the above-described operation and effect are similarly performed and obtained with the second vane 10.

By forming the oil supply channels described in Embodiment 17 in the vane-type compressor 200 described in Embodiments 2 to 14, the sliding portions, where the bushes 11 and 12 and the bush holding portions 4*d* and 4*e* slide on one another, can be more preferably lubricated than those in the vane-type compressor 200 described in Embodiments 2 to 14.

The oil supply channels described in Embodiment 17 may be provided in the vane-type compressor 200 described in Embodiment 16.

Figure 41:
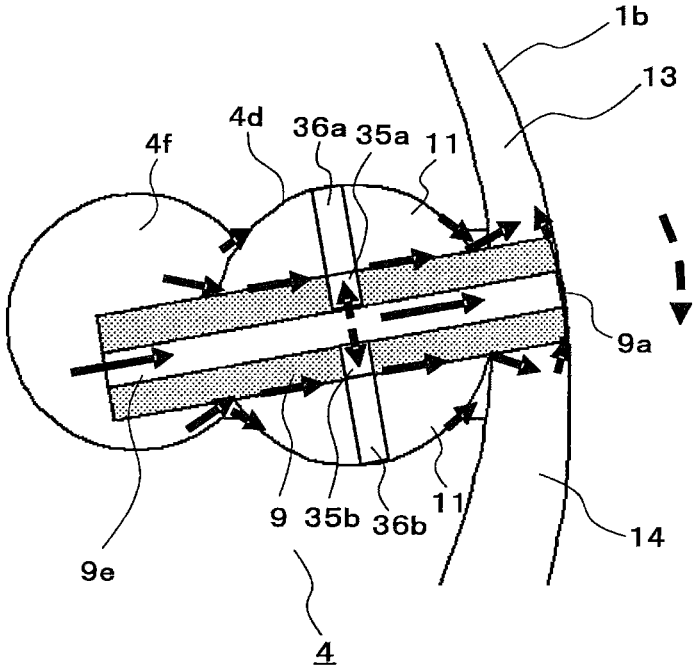
FIG. 41 is an enlarged view of a main portion of a vane and a region around the vane of another example of the vane-type compressor according to Embodiment 17 of the present invention.

FIG. 41 is an enlarged view of a main portion of the vane and a region around the vane of another example of the vane-type compressor according to Embodiment 17 of the present invention. FIG. 41 illustrates the enlarged main portion of the vane 9 in the rotational angle 90° position and the region around the vane 9. In the drawing, solid arrows indicate the flows of the refrigerating machine oil 25, and a dashed arrow indicates the rotational direction.

In the vane-type compressor 200 illustrated in FIG. 41, the oil supply channels 36*a* and 36*b* are provided so as to respectively communicate with the oil supply channels 35*a* and 35*b* formed in the first vane 9. In the vane-type compressor 200 having such a structure, similarly to that in the vane-type compressor described in Embodiment 16, the refrigerating machine oil 25 having been supplied to the vane relief portion 4*f* is supplied to the sliding portions, where the bush 11 and the bush holding portion 4*d* of the rotor shaft 4 slide on each other, though the sliding portions, where the bush 11 and the side surfaces of the first vane 9 slide on one another, and the oil supply channels 36*a* and 36*b*. Furthermore, in the vane-type compressor 200 illustrated in FIG. 41, the refrigerating machine oil 25 having been supplied to the vane relief portion 4*f* is supplied to the sliding portion, where the bush 11 and the bush holding portion 4*d* of the rotor shaft 4 slide on each other, also through the oil supply channels 9*e*, 35*a*, and 35*b*. Thus, in the vane-type compressor 200 illustrated in FIG. 41, compared to the vane-type compressor described in Embodiment 16, the amount of oil supplied to the sliding portion, where the bush 11 and the bush holding portion 4*d* of the rotor shaft 4 slide on each other, is increased, and accordingly, the effect is improved.

As can be clearly seen from FIG. 39, lubrication is more difficult on the counter-rotational side also in the sliding portion where the bush 11 and the bush holding portion 4*d* of the rotor shaft 4 slide on each other. Thus, although it is not illustrated, only the oil supply channel 36*a* on the counter-rotational side may be provided in the vane-type compressor 200 illustrated in FIG. 40. With only the oil supply channel 36*a*, the refrigerating machine oil 25 supplied to the sliding portion on the counter-rotational side, where lubrication is difficult, can be increased by about as much as the amount of the refrigerating machine oil 25 that would otherwise unnecessarily flow through the oil supply channel 36*b*. Thus, the effect can be improved. Only the oil supply channels 35*a* and 36*a* on the counter-rotational side may be provided in the vane-type compressor 200 illustrated in FIG. 41. With only the oil supply channels 35*a* and 36*a*, the refrigerating machine oil 25 supplied to the sliding portion on the counter-rotational side, where lubrication is difficult, can be increased by about as much as the amount of the refrigerating machine oil 25 that would otherwise unnecessarily flow through the oil supply channels 35*b* and 36*b*. Thus, the effect can be improved. Thus, the effect is improved.

Of course, the above-described operation and effect are similarly performed and obtained with the second vane 10. Of course, the oil supply channels described in Embodiment 17 may be formed in the vane-type compressor 200 described in Embodiment 15.

Embodiment 18

By also forming the following oil supply channels in the vane-type compressor 200 described in Embodiments 1 to 16, the sliding portion, where the bush 11 and the bush holding portion 4*d* of the rotor shaft 4 slide on each other, can be more reliably lubricated. In Embodiment 18, items not specifically described are similar to those in Embodiments 1 to 17, and the same functions and structures are denoted by the same reference signs.

Figure 42:
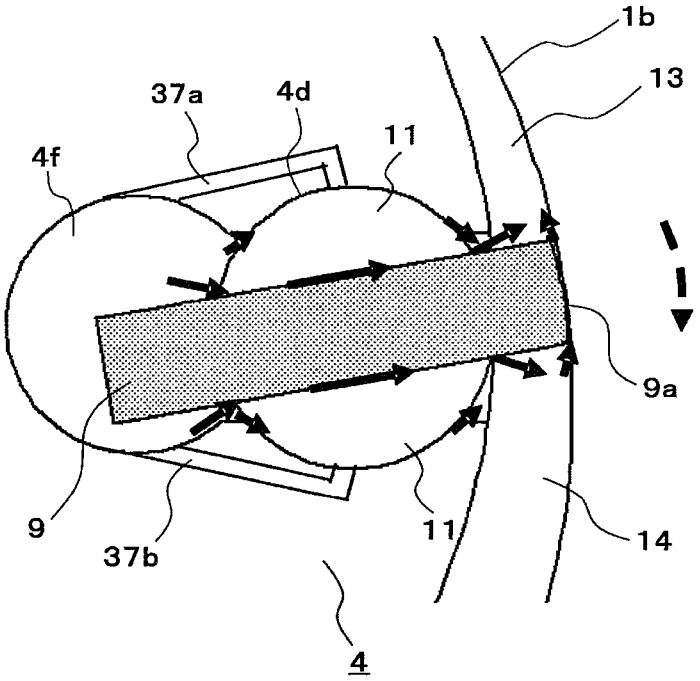
FIG. 42 is an enlarged view of a main portion of a vane and a region around the vane of a vane-type compressor according to Embodiment 18 of the present invention.

FIG. 42 is an enlarged view of a main portion of the vane and a region around the vane of the vane-type compressor according to Embodiment 18 of the present invention. FIG. 42 illustrates the enlarged main portion of the vane 9 in the rotational angle 90° position and the region around the vane 9. In FIG. 42, solid arrows indicate the flows of the refrigerating machine oil 25, and a dashed arrow indicates the rotational direction.

In addition to the structure of the vane-type compressor 200 described in Embodiment 1, the vane-type compressor 200 according to Embodiment 18 has oil supply channels 37*a* and 37*b* formed in the rotor portion 4*a* of the rotor shaft 4. One end of each of the oil supply channels 37*a* and 37*b* is open at the vane relief portion 4*f* and the other end of each of the oil supply channels 37*a* and 37*b* is open at the bush holding portion 4*d*. The oil supply path 37*a* is open at a region of the bush holding portion 4*d*, the region opposing a substantially semi-cylindrical portion of the bush 11 on the counter-rotational side relative to the vane 9. The oil supply path 37*b* is open at a region of the bush holding portion 4*d*, the region opposing a substantially semi-cylindrical portion of the bush 11 on the rotational side relative to the vane 9.

In the vane-type compressor 200 having such a structure, the refrigerating machine oil 25 is supplied from the vane relief portion 4*f* to the sliding portion, where the bush 11 and the bush holding portion 4*d* of the rotor shaft 4 slide on each other, through the oil supply channels 37*a*, and 37*b*. Thus, in the vane-type compressor 200 according to Embodiment 18, the sliding portion, where the bush 11 and the bush holding portion 4*d* of the rotor shaft 4 slide on each other, can be more preferably lubricated than that in the vane-type compressor 200 described in Embodiment 1. Of course, the above-described operation and effect are similarly performed and obtained with the second vane 10.

Although it is not illustrated, only the oil supply channel 37*a* on the counter-rotational side may be provided in the vane-type compressor 200 illustrated in FIG. 42. With only the oil supply channel 37*a*, the refrigerating machine oil 25 supplied to the sliding portion on the counter-rotational side, where lubrication is difficult, can be increased by about as much as the amount of the refrigerating machine oil 25 that would otherwise unnecessarily flow through the oil supply channel 37*b*. Thus, the sliding portion, where the bush 11 and the bush holding portion 4*d* of the rotor shaft 4 slide on each other, is more preferably lubricated.

By forming the oil supply channels described in Embodiment 18 in the vane-type compressor 200 described in Embodiments 2 to 17, the sliding portions, where the bushes 11 and 12 and the bush holding portions 4*d* and 4*e* slide on one another, can be more preferably lubricated than those in the vane-type compressor 200 described in Embodiments 2 to 17. In particular, by forming the oil supply channels described in Embodiment 18 in the vane-type compressor 200 described in Embodiment 17, the refrigerating machine oil 25 is supplied to the sliding portions, where the bushes 11 and 12 and the bush holding portions 4*d* and 4*e* slide on one another, through a plurality of oil supply channels so as to lubricate these sliding portions. Thus, the sliding portions, where the bushes 11 and 12 and the bush holding portions 4*d* and 4*e* slide on one another, can be more preferably lubricated.

Although two vanes are provided in Embodiments 1 to 18 having been described, the similar structure can be used and the similar effects can be obtained in the case where a single vane is used or three or more vanes are used. Except for Embodiment 14, in the case where a single vane is used, the vane aligner may use a ring structure instead of a partial ring structure.

In Embodiments 1 to 18, the oil pump 31 that utilizes the centrifugal force of the rotor shaft 4 is used. However, any type of the oil pump may be used. For example, the oil pump 31 may use a displacement type oil pump described in Japanese Unexamined Patent Application Publication No. 2009-62820.

REFERENCE SIGNS LIST

1 cylinder, 1*a* suction port, 1*b* inner circumferential surface, 1*c* oil return port, 1*d* oil supply channel, 1*e* oil supply channel, 2 frame, 2*a* recess portion, 2*b* vane aligner bearing portion, 2*c* main bearing portion, 2*d* discharge port, 2*e* oil supply channel, 2*f* oil supply channel, 2*g* groove portion, 2*h* gap, 2*i* oil retaining groove, 2*j* oil supply channel, 3 cylinder head, 3*a* recess portion, 3*b* vane aligner bearing portion, 3*c* main bearing portion, 3*d* oil supply channel, 3*e* oil supply channel, 4 rotor shaft, 4*a* rotor portion, 4*b* rotating shaft portion, 4*c* rotating shaft portion, 4*d* bush holding portion, 4*e* bush holding portion, 4*f* vane relief portion, 4*g* vane relief portion, 4*h* oil supply channel, 4*i* oil supply channel, 4*j* oil supply channel, 4*k* oil discharge port, 4*m* oil supply channel, 4*n* oil supply channel, 5 vane aligner, 5*a* vane holding portion, 5*c* base portion, 5*d* oil supply channel, 5*e* oil supply channel, 5*f* oil supply channel, 6 vane aligner, 6*a* vane holding portion, 6*c* base portion, 7 vane aligner, 7*a* vane holding portion, 7*b* vane holding groove, 7*c* base portion, 7*d* oil supply channel, 7*e* oil supply channel, 7*f* oil supply channel, 8 vane aligner, 8*a* vane holding portion, 8*b* vane holding groove, 8*c* base portion, 9 first vane, 9*a* tip end portion, 9*b* rear surface groove, 9*c* thin portion, 9*e* oil supply channel, 10 second vane, 10*a* tip end portion, 10*b* rear surface groove, 10*c* thin portion, 10*d* projecting portion, 10*e* oil supply channel, 11 bush, 12 bush, 13 suction chamber, 14 middle chamber, compressing chamber, 21 stator, 22 rotor, 23 glass terminal unit, 24 discharge pipe, 25 refrigerating machine oil, 26 suction pipe, 31 oil pump, 32 closest point, 33 oil retainer, 35*a* oil supply channel, 35*b* oil supply channel, 36*a* oil supply channel, 36*b* oil supply channel, 41 first integral vane, 42 second integral vane, 101 compressing element, 102 electrical drive element, 103 sealed container, 104 oil reservoir, and 200 vane-type compressor.

The invention claimed is:

1. A vane-type compressor comprising:

a sealed container;

an oil reservoir disposed at a bottom portion of the sealed container, and configured to accumulate therein refrigerating machine oil; and an electrical drive element and a compressing element disposed in the sealed container, the compressing element including a cylinder having a cylindrical inner circumferential surface, a rotor shaft that includes a cylindrical rotor portion that rotates in the cylinder about a rotational axis offset from a central axis of the inner circumferential surface by a predetermined distance, and a shaft portion, wherein a rotational force is transmitted from the electrical drive element to the rotor portion through the shaft portion, and a lower end of the shaft portion is disposed in the oil reservoir, a frame that closes one of open ends of the inner circumferential surface of the cylinder, wherein the shaft portion is rotatably supported by a bearing portion of the frame, a cylinder head that closes the other open end of the inner circumferential surface of the cylinder, wherein the shaft portion is rotatably supported by a bearing portion of the cylinder head, and at least one vane disposed in the rotor portion, the vane having a tip end portion on an outer circumferential side, the tip end portion projecting from the rotor portion, the tip end portion having an outwardly convex arc shape, wherein a vane angle adjuster is provided which holds the vane so as to allow a compressing operation to be performed while constantly maintaining a normal to the arc shape of the tip end portion of the vane to be coincident with a normal to the inner circumferential surface of the cylinder and which supports the vane such that the vane is swingable and movable in a centrifugal direction relative to the rotor portion, wherein the vane angle adjuster at least includes:

vane aligners that have respective base portions having a ring shape or a partial ring shape, each base portion having one of a projection and a recess, the vane having end portions, each end portion of the vane having the other of the projection and the recess, the vane aligners being connected to the vane each projecting portion being inserted into a corresponding one of the recesses, or the base portions of the vane aligners being integrated with the respective end portions of the vane, and vane aligner bearing portions disposed in outer circumferential surfaces of recess portions, the recess portions being formed in cylinder-side end surfaces of the frame and the cylinder head, the recess portions each having a bottomed cylindrical shape, the recess portions each being coaxial with the inner circumferential surface of the cylinder, wherein the base portions of the vane aligners is inserted into the recess portions, outer circumferential surfaces of the base portions of the vane aligners are slidably supported by the vane aligner bearing portions, wherein an oil supply channel that is formed in the rotor shaft and allows communication between the oil reservoir and the recess portions of the frame and the cylinder head and oil supplier that supplies the refrigerating machine oil in the oil reservoir to the oil supply channel are provided.

2. The vane-type compressor of claim 1, wherein ring-shaped groove portions are formed at bottom portions of the recess portions of the frame and the cylinder head such that the groove portions are each coaxial with the inner circumferential surface of the cylinder, and wherein the base portions of the vane aligners are inserted into the groove portion.

3. The vane-type compressor of claim 1, wherein a cylindrical bush holding portion, which penetrates though the rotor portion in the rotational axis direction, is formed in the rotor portion, wherein a pair of semi-cylindrical bushes are inserted into the bush holding portion, and wherein the vane is clamped and supported by the bushes so as to be supported by the rotor portion swingably and movably in a centrifugal direction.

4. The vane-type compressor of claim 3, wherein the rotor portion has a cylindrical vane relief portion that is formed on a side closer to an inner circumferential side than the bush holding portion so as not to cause a tip end portion of the vane, the tip end portion being on the inner circumferential side, to be brought into contact with the rotor portion and penetrates therethrough in the rotational axis direction so as to communicate with the bush holding portion, and wherein the vane relief portion communicates with the recess portions of the frame and the cylinder head.

5. The vane-type compressor of claim 4, wherein the oil supply channel that is provided in the rotor shaft and allows communication between the oil reservoir and the vane relief portion and oil supplier that supplies the refrigerating machine oil in the oil reservoir to the oil supply channel are provided.

6. The vane-type compressor of claim 4, further comprising:

at least one oil supply channel that is formed in the vane and penetrates through the vane from the inner circumferential side to the outer circumferential side.

7. The vane-type compressor of claim 4, wherein a pressure in the vane relief portion is a discharge pressure.

8. The vane-type compressor of claim 1, wherein an oil supply channel is provided, which has an opening at a position where the rotor portion and the inner circumferential surface of the cylinder are closest to each other and allows communication between the opening and the recess portion of at least one of the frame and the cylinder head.

9. The vane-type compressor of claim 1, further comprising:

oil supply channels that allow communication between the vane aligner bearing portion and the recess portion of the frame and between the vane aligner bearing portion and the recess portion of the cylinder head.

10. The vane-type compressor of claim 9, wherein gaps are formed between the base portions of the vane aligners and bottom portions of the respective recess portions of the frame and the cylinder head, the gaps serving as the oil supply channels that allow communication between the vane aligner bearing portion and the recess portion of the frame and between the vane aligner bearing portion and the recess portion of the cylinder head.

11. The vane-type compressor of claim 10, wherein oil retaining grooves are formed in the vane aligner bearing portions, and the oil retaining grooves communicate with the respective oil supply channels that allow communication between the vane aligner bearing portion and the recess portion of the frame and between the vane aligner bearing portion and the recess portion of the cylinder head.

12. The vane-type compressor of claim 1, wherein a pressure in the sealed container is a discharge pressure.

13. The vane-type compressor claim 1, wherein a radius of the arc shape of the tip end portion of the vane is equal to a radius of the inner circumferential surface of the cylinder.

* * * * *